US007760168B2

(12) United States Patent
Ogura

(10) Patent No.: US 7,760,168 B2
(45) **Date of Patent: *Jul. 20, 2010**

(54) DISPLAY APPARATUS, DISPLAY DRIVING APPARATUS AND METHOD FOR DRIVING SAME

(75) Inventor: Jun Ogura, Fussa (JP)

(73) Assignee: Casio Computer Co., Ltd., Tokyo (JP)

( * ) Notice: Subject to any disclaimer, the term of this patent is extended or adjusted under 35 U.S.C. 154(b) by 125 days.

This patent is subject to a terminal disclaimer.

(21) Appl. No.: 11/904,291

(22) Filed: Sep. 26, 2007

(65) Prior Publication Data

US 2008/0074413 A1 Mar. 27, 2008

(30) Foreign Application Priority Data

Sep. 26, 2006 (JP) ..... 2006-260650
Mar. 28, 2007 (JP) ..... 2007-083360

(51) Int. Cl.
*G09G 3/30* (2006.01)

(52) U.S. Cl. ..... 345/77; 345/82; 345/95; 345/212; 345/690

(58) Field of Classification Search ..... 345/76–100, 345/204–215, 690–699
See application file for complete search history.

(56) References Cited

U.S. PATENT DOCUMENTS

2002/0047839 A1 4/2002 Kasai
2004/0239596 A1 12/2004 Ono et al.
2005/0088103 A1 4/2005 Kageyama et al.
2005/0269958 A1 12/2005 Choi et al.
2007/0164959 A1 7/2007 Childs
2008/0074362 A1 3/2008 Ogura
2008/0158119 A1* 7/2008 Park et al. ..... 345/87

FOREIGN PATENT DOCUMENTS

EP 1 191 512 A2 3/2002
JP 8-330600 A 12/1996
WO WO 2005/069267 A1 7/2005
WO WO 2006/000101 A1 1/2006

OTHER PUBLICATIONS

Related U.S. Appl. No. 11/903,984, filed Sep. 25, 2007; Inventor Jun Ogura, Published as US 2008/0074362 (listed above).

* cited by examiner

*Primary Examiner*—Vijay Shankar
(74) *Attorney, Agent, or Firm*—Frishauf, Holtz, Goodman & Chick, P.C.

(57) ABSTRACT

A light-emitting element capable of emitting light having a preferred gradation level depending on display data. During a precharge period, a data driver applies a precharge voltage to a capacitor via a data line. After the application of the precharge voltage, a voltage converter reads a first reference voltage Vref(t1) and a second reference voltage Vref(t2) to generate a compensation voltage based on a difference between the respective reference voltages. Based on the compensation voltage, a voltage calculator compensates an original gradation level voltage Vorg having a value in accordance with display data generated by a gradation level voltage generator. The voltage calculator generates a compensated gradation level voltage Vpix corresponding to a variation amount of an element characteristic for a transistor Tr13 for driving light emission to apply the compensated gradation level voltage Vpix to a data line Ld.

25 Claims, 42 Drawing Sheets

DURING WRITING OPERATION

DURING WRITING OPERATION

DURING LIGHT-EMITTING OPERATION

DURING LIGHT-EMITTING OPERATION

EQUIVALENT CIRCUIT DURING WRITING OPERATION

EQUIVALENT CIRCUIT DURING LIGHT-EMITTING OPERATION

SELECTION STEP

NOT-SELECTED STATUS
SWITCHING STEP

SHIFT FROM SELECTION STEP TO NOT-SELECTED STATUS

VOLTAGE CHANGE IN NOT-SELECTED STATUS RETENTION STEP

NOT-SELECTED STATUS
RETENTION STEP

POWER SOURCE VOLTAGE
SWITCHING STEP

LIGHT-EMITTING STEP

DURING WRITING OPERATION

DISPLAY APPARATUS, DISPLAY DRIVING APPARATUS AND METHOD FOR DRIVING SAME

CROSS REFERENCE TO RELATED APPLICATIONS

This application is based on Japanese Patent Application No. 2006-260650 filed on Sep. 26, 2006, and Japanese Patent Application No. 2007-083360 filed on Mar. 28, 2007, the entire contents of both of which are incorporated herein by reference.

BACKGROUND OF THE INVENTION

1. Field of the Invention

The present invention relates to a display driving apparatus and a method for driving a display driving apparatus as well as a display apparatus and a method for driving a display apparatus.

2. Description of the Related Art

There exists a display apparatus that includes a display panel in which current driving-type light-emitting elements (e.g., organic electroluminescence (EL) elements, inorganic EL elements, light-emitting diodes (LED)) are arranged in a matrix manner.

For example, Unexamined Japanese Patent Application KOKAI Publication No. H8-330600 discloses an active matrix-type driving display apparatus that is current-controlled by a voltage signal. This driving display apparatus is structured so that a current control thin film transistor and a switching film transistor are provided for each pixel. The current control thin film transistor flows a current in an organic EL element when a voltage signal corresponding to image data is applied to a gate, and the switching thin film transistor turns ON or OFF the supply of the voltage signal to the gate of the current control thin film transistor. The driving display apparatus disclosed in Unexamined Japanese Patent Application KOKAI Publication No. H8-330600 controls the brightness when an organic EL element emits light by controlling a voltage value of the voltage signal applied to the gate of the current control thin film transistor.

However, a threshold voltage of a transistor generally varies as time passes. Thus, in the case of the driving display apparatus of Unexamined Japanese Patent Application KOKAI Publication No. H8-330600, a threshold voltage of a current control thin film transistor for supplying current to an organic EL element varies as time passes, which causes a variation in a value of current flowing in the organic EL element. As a result, there is a risk that brightness during the light emission by the organic EL element may vary.

SUMMARY OF THE INVENTION

The present invention has been made in view of the above disadvantage.

It is an object of the present invention to provide a display apparatus in which a light-emitting element displays an image with an appropriate gradation level even when variation is caused in a threshold voltage of a transistor which supplies light-emitting current to the light-emitting element.

In order to achieve the object, a display apparatus in accordance with the present invention includes a light-emitting element for emitting light having a gradation level depending on supplied current;

a pixel driving circuit for supplying to the light-emitting element, current depending on a voltage applied via a data line;

a precharge voltage source for applying a predetermined precharge voltage to the pixel driving circuit via the data line;

a voltage reader for reading at a plurality of times, after the application of the precharge voltage by the precharge voltage source, the voltage of the data line with different timings in a predetermined transient response period; and a compensated gradation data signal generator for generating, based on a voltage difference among the voltages of the data line read at the different timings, a compensated gradation data signal having a voltage value corresponding to an element characteristic unique to the pixel driving circuit to apply the compensated gradation data signal to the pixel driving circuit.

A driving method in accordance with the invention is designed to cause the display apparatus of the present invention to perform the characteristic operation thereof.

A display driving apparatus in accordance with the present invention includes a light-emitting element for emitting light having a gradation level depending on applied current;

a pixel driving circuit for supplying to the light-emitting element, current depending on a voltage applied via a data line;

a precharge voltage source for applying a predetermined precharge voltage to the pixel driving circuit via the data line;

a voltage reader for reading at a plurality of times, after the application of the precharge voltage by the precharge voltage source, the voltage of the data line with different timings in a predetermined transient response period; and a compensated gradation data signal generator for generating, based on a voltage difference among the voltages of the data line read at the different timings and a voltage retained in the pixel driving circuit, a compensated gradation data signal having a voltage value corresponding to an element characteristic unique to the pixel driving circuit to apply the compensated gradation data signal to the pixel driving circuit.

A driving method in accordance with the invention is designed to cause the display driving apparatus to perform the characteristic operation thereof.

In accordance with the present invention, even when a variation is caused in a threshold voltage of a transistor which supplies light-emitting current to an organic EL element, the light-emitting element can emit light having a desired brightness of gradation level.

BRIEF DESCRIPTION OF THE DRAWINGS

These objects mentioned above and other objects and advantages of the present invention will become more apparent upon reading of the following detailed description and the accompanying drawings in which.

DETAILED DESCRIPTION

Hereinafter, a display apparatus and a display driving apparatus according to an embodiment of the present invention will be described. This embodiment is an example in which the display apparatus of the present invention is a display apparatus 1 using a current driving-type light-emitting element to display an image. This light-emitting element may be an arbitrary light-emitting element. However, the following will describe a case where the light-emitting element is an organic EL element.

Figure 1:
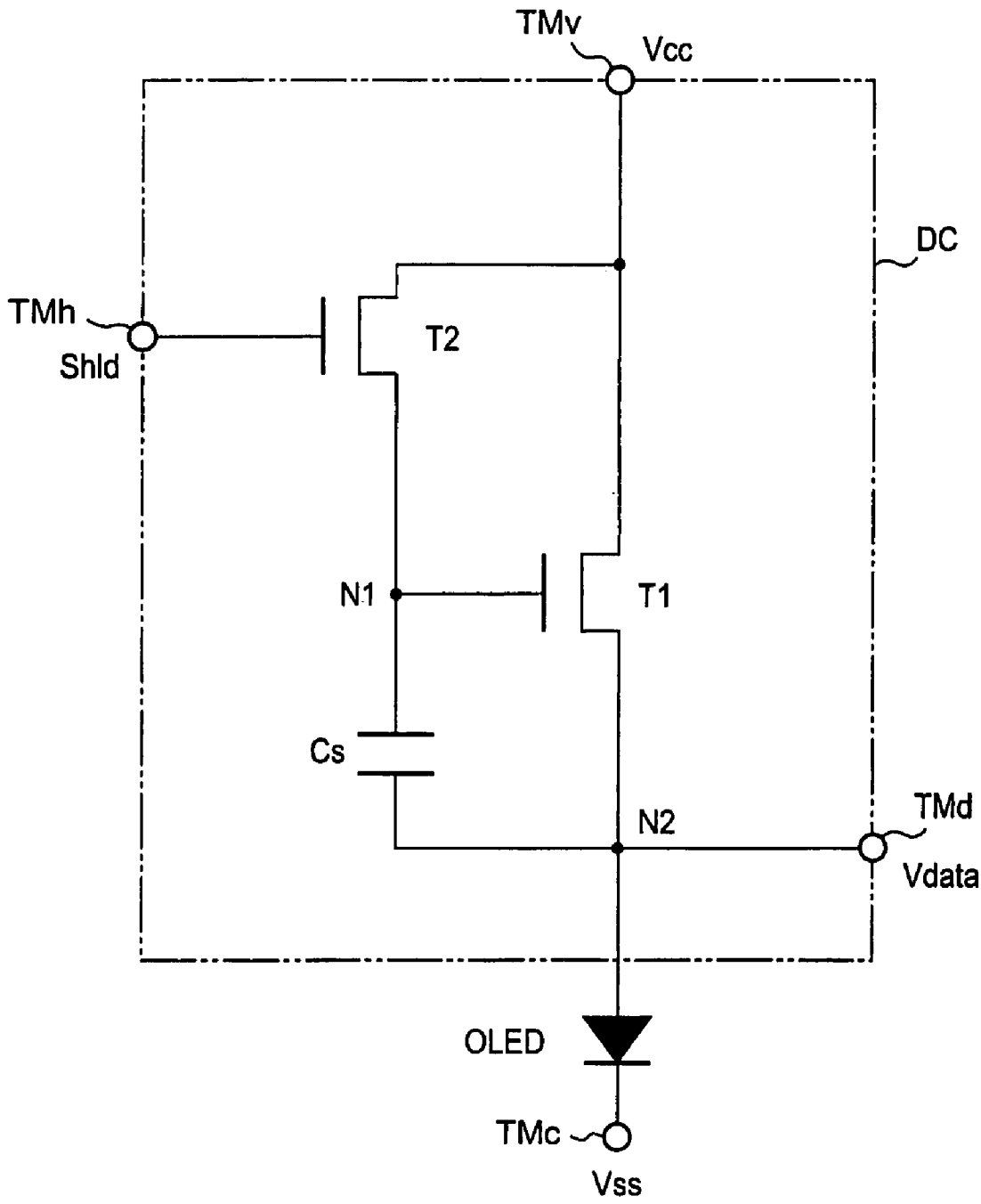
FIG. 1 illustrates the main structure of a display pixel used in a display apparatus according to an embodiment of the present invention.

First, a display pixel PIX of the display apparatus 1 of this embodiment will be described. As shown in FIG. 1, the display pixel PIX includes a pixel driving circuit DC and an organic EL element OLED. The pixel driving circuit DC includes a transistor T1, a transistor T2, and a capacitor Cs. The transistor T1 and the transistor T2 may have arbitrary element structures and characteristics. However, the following will describe a case where the transistor T1 and the transistor T2 are n channel-type thin film transistors.

The transistor T1 is an n channel-type thin film transistor (hereinafter referred to as "driving transistor") for driving the organic EL element OLED to emit light. The driving transistor T1 is structured so that a drain terminal is connected to a power source terminal TMv, a source terminal is connected to a contact point N2, and a gate terminal is connected to a contact point N1. This power source terminal TMv is applied with a power source voltage Vcc having different voltage values depending on an operation status of the pixel driving circuit DC.

The transistor T2 is an n channel-type thin film transistor that is hereinafter referred to as a "retention transistor". The retention transistor T2 is structured so that a drain terminal is connected to the power source terminal TMv (a drain terminal of the driving transistor T1), a source terminal is connected to the contact point N1, and a gate terminal is connected to the control terminal TMh. The control terminal TMh is applied with a retention control signal Shld.

The capacitor Cs is connected between the gate terminal and the source terminal of the driving transistor T1 (between the contact point N1 and the contact point N2). The capacitor Cs may be parasitic capacitance formed between the gate and source terminals of the driving transistor T1 or also may be the parasitic capacitance connected with a capacitive element in parallel thereto.

The organic EL element OLED is an organic EL element that emits light having a gradation level depending on supplied current. The organic EL element OLED is structured so that an anode terminal is connected to the contact point N2 and a cathode terminal TMc is applied with a reference voltage Vss. This reference voltage Vss has a fixed value. A data terminal TMd connected to the contact point N2 is applied with a data voltage Vdata corresponding to the gradation level value of display data.

Next, a method for controlling the display pixel PIX having the above structure will be described.

The pixel driving circuit DC applies a voltage corresponding to the gradation level value of display data to the capacitor Cs to charge the capacitor Cs (hereinafter referred to as a "writing operation"). After the writing operation, the capacitor Cs retains the written voltage (hereinafter referred to as a "retention operation"). Based on the charging voltage retained by the capacitor Cs, gradation level current corresponding to the gradation level of the display data flows in the organic EL element OLED and the organic EL element OLED emits light (hereinafter referred to as a "light-emitting operation"). The brightness of the light emitted by the organic EL element OLED corresponds to the gradation level of the display data.

Figure 2:
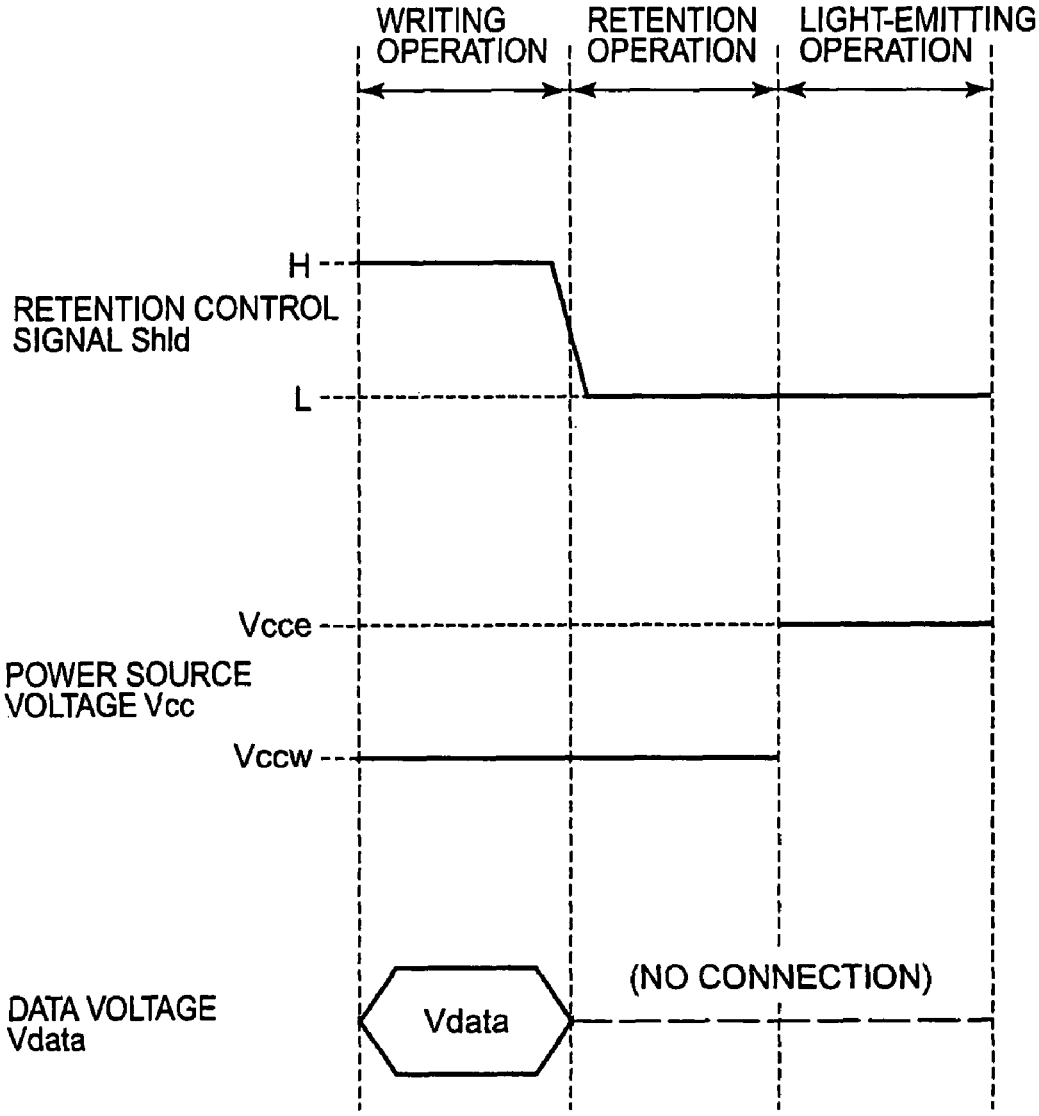
FIG. 2 illustrates a signal waveform in the respective operations of a display pixel.

As shown in FIG. 2, the pixel driving circuit DC sequentially performs the above-described writing operation, retention operation, and light-emitting operation. The following will describe conditions required for the display pixel PIX to perform the respective operations.

(Writing Operation)

In the writing operation, the capacitor Cs is written with a voltage corresponding to the gradation level value of the display data. During the writing operation, the organic EL element OLED is in a light off status in which the organic EL element OLED does not emit light. During the writing operation by the pixel driving circuit DC, the driving transistor T1 has an operating characteristic shown in FIG. 4A.

Figure 4A:
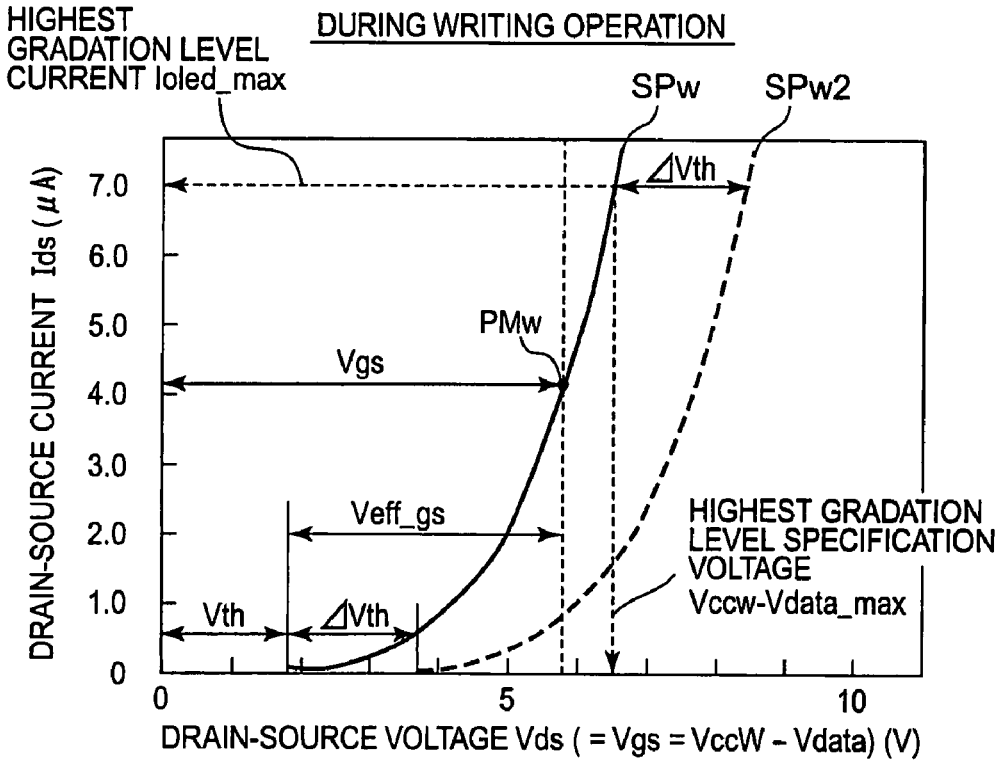
FIG. 4A shows an example of an operating characteristic of a driving transistor in a writing operation of a display pixel.

In FIG. 4A, a characteristic line SPw, represented by a solid line, shows a relationship between the drain-source voltage Vds and a drain-source current Ids in an initial state in which the n channel-type thin film transistor used as the driving transistor T1 is diode-connected. A point PMw on the characteristic line SPw is an operation point of the driving transistor T1. A characteristic line SPw2, represented by a broken line in FIG. 4A, shows a relationship between the drain-source voltage Vds and the drain-source current Ids when the driving transistor T1 has a characteristic change due to its driving history. As shown in FIG. 4A, the drain-source voltage Vds is a sum of a threshold voltage Vth and a voltage Veff_gs as shown in the following formula (1).

$$Vds = Vth + Veff_gs \quad (1)$$

When the drain-source voltage Vds exceeds the threshold voltage Vth (a threshold voltage between a gate and a source=a threshold voltage between a drain and a source), the drain-source current Ids increases nonlinearly with an increase of the drain-source voltage Vds as shown by the characteristic line SP2. Thus, Veff_gs in FIG. 4A represents a voltage effectively forming the drain-source current Ids.

Figure 4B:
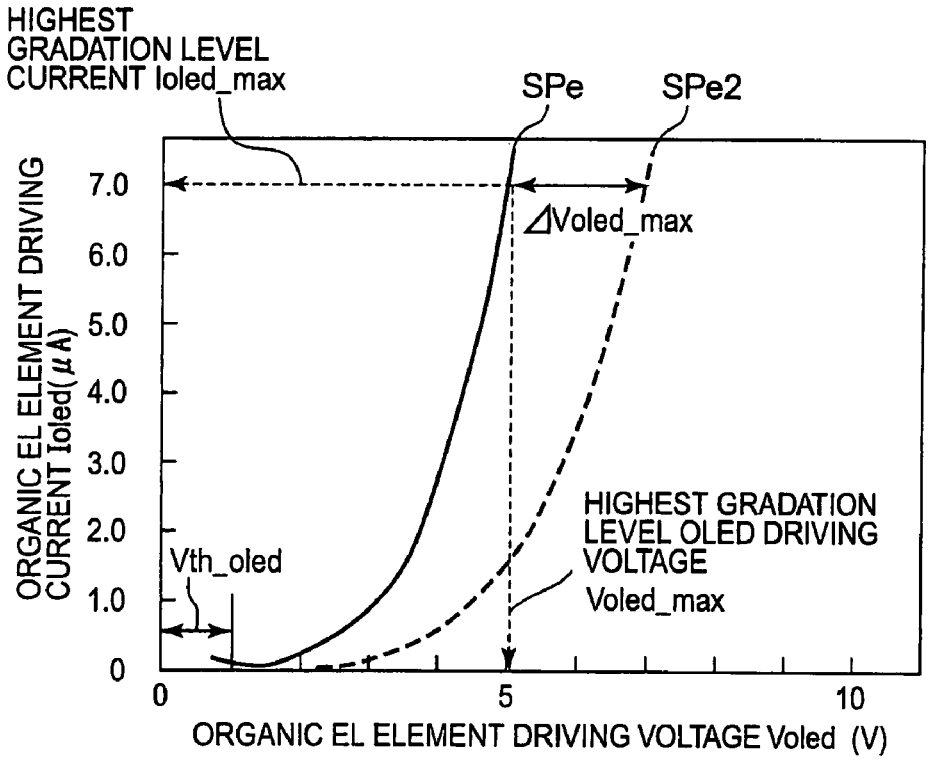
FIG. 4B shows an example of a relationship between the driving current of an organic EL element and a driving voltage in a writing operation.

During the writing operation shown in FIG. 2, the driving current and the driving voltage of the organic EL element OLED has the characteristic shown in FIG. 4B. In FIG. 4B, the characteristic line SPe, represented by the solid line, shows a relationship in an initial state between a driving voltage Voled applied between an anode and a cathode of the organic EL element OLED and the driving current Ioled flowing between the anode and the cathode. When the driving voltage Voled exceeds the threshold voltage Vth_oled, the driving current Ioled increases nonlinearly with an increase of the driving voltage Voled as shown by the characteristic line SPe. In FIG. 4B, a characteristic line SPe2 represents an example of a relationship between the driving voltage Voled and the driving current Ioled when the characteristic changes in accordance with the driving history of the organic EL element OLED.

Figure 3A:
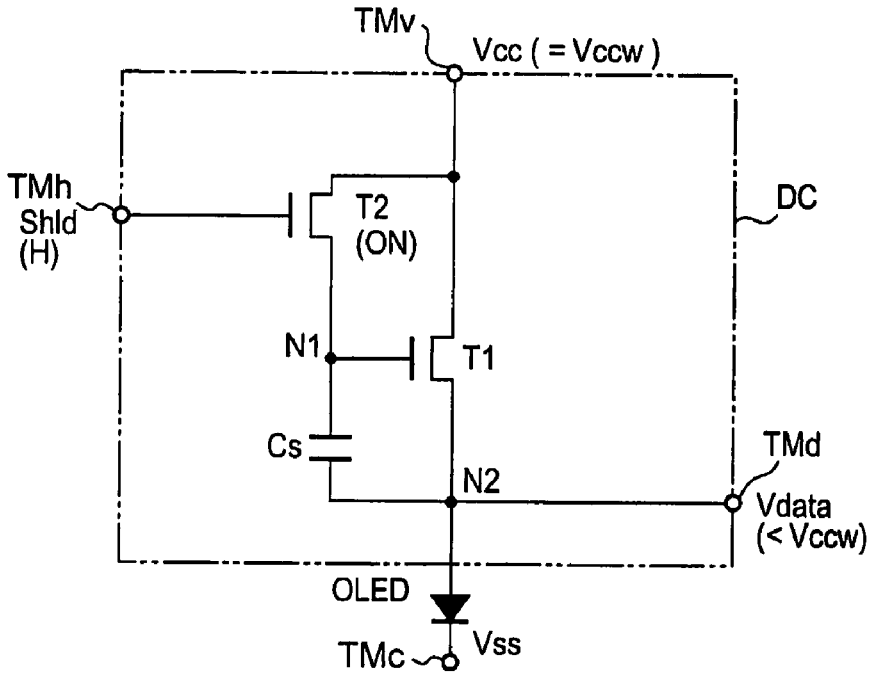
FIG. 3A illustrates an operation status in a writing operation of a display pixel.

As shown in FIG. 3A, during the writing operation, the control terminal TMh of the retention transistor T2 is applied with a retention control signal Shld of an ON-level (high level H) to turn ON the retention transistor T2. As a result, the connection (short-circuiting) between the gate and the drain of the driving transistor T1 is established to cause the driving transistor T1 to be in a diode-connected state. The power source terminal TMv is applied with the first power source voltage Vccw for a writing operation and the data terminal TMd is applied with a data voltage Vdata corresponding to the gradation level value of the display data.

Figure 3B:
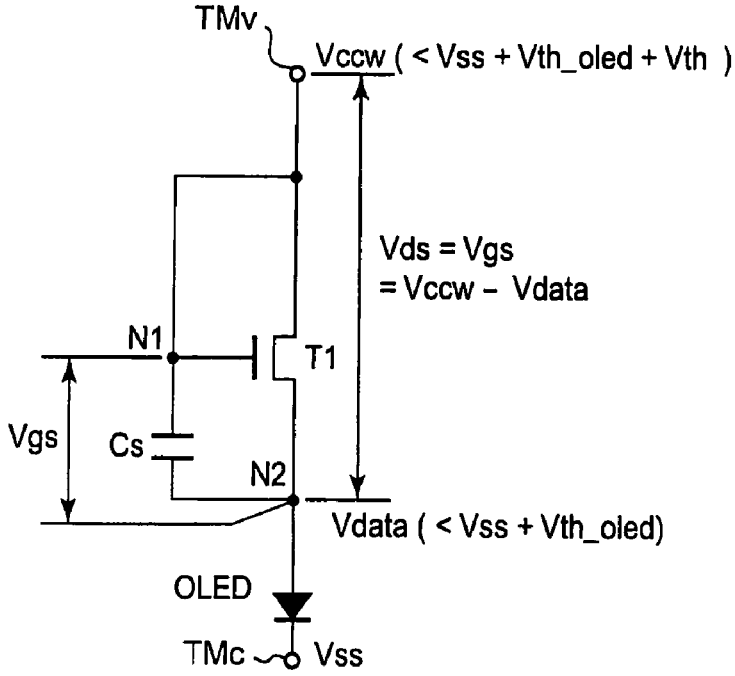
FIG. 3B illustrates an equivalent circuit in a writing operation of a display pixel.

Then, the drain and source of the driving transistor T1 have therebetween current Ids corresponding to the potential difference between the drain and the source (Vccw−Vdata) (hereinafter referred to as "expected value current"). The data voltage Vdata is set to include this expected value current Ids as a voltage value required for obtaining a current value that is required for the organic EL element OLED to emit light having an appropriate brightness depending on the gradation level value of the display data. At this timing, as mentioned above, short-circuiting is caused between the gate and the drain of the driving transistor T1 and the drain of the driving transistor T1 is in a diode-connected status. Thus, as shown in FIG. 3B, the drain-source voltage Vds of the driving transistor T1 equals to the gate-source voltage Vgs and is represented by formula (2). Capacitor Cs is written (or charged) with this gate-source voltage Vgs.

$$Vds=Vgs=Vccw-V\text{data} \quad (2)$$

Next, the first power source voltage Vccw will be described. The driving transistor T1 is an n channel-type transistor. Thus, in order to flow the drain-source current Ids of the driving transistor T1, the gate potential must be higher than the source potential (positive potential). As shown in FIG. 3B, the gate potential equals the drain potential (the first power source voltage Vccw) and the source potential equals the data voltage Vdata. Thus, to flow the drain-source current Ids, the following formula (3) must be established.

$$\text{Vdata}<\text{Vccw} \quad (3)$$

In order for the organic EL element OLED to be in a light-off state, a difference between a voltage of the anode terminal of the organic EL element OLED and a voltage of the cathode terminal TMc is equal to or less than the light-emitting threshold voltage Vth_oled of the organic EL element OLED. As shown in FIG. 3B, the contact point N2 is connected to the anode terminal of the organic EL element OLED. The contact point N2 is also connected to the data terminal TMd and is applied with the data voltage Vdata. On the other hand, the cathode terminal TMc is applied with the reference voltage Vss having a fixed value.

Therefore, in order to cause the organic EL element OLED to be in a light-of state in the writing operation, a difference between the data voltage Vdata and the reference voltage Vss must be equal to or less than the light-emitting threshold voltage Vth_oled of the organic EL element OLED. In this case, the contact point N2 has the potential Vdata; therefore the following formula (4) must be satisfied in order for the organic EL element OLED to be in a light-off state during the writing operation. It is noted that, when the reference voltage Vss is set to a ground potential of 0 V, the formula (4) can be represented by the following formula (5).

$$V\text{data}-Vss\leqq Vth_oled \quad (4)$$

$$\text{Vdata}\leqq\text{Vth_oled} \quad (5)$$

Thus, in order to cause the capacitor Cs to be written with the gate-source voltage Vgs of the driving transistor T1 and to cause the organic EL element OLED not to emit light during a writing operation, a relationship shown in the following formula (6) based on the above-described formula (2) and formula (5) must be established.

$$Vccw-Vgs\leqq Vth_oled \quad (6)$$

Then, the relationship of formula (1) established for the gate-source voltage Vgs when the driving transistor T1 is diode-connected (Vgs=Vds=Vth+Veff_gs) is substituted into formula (6) to provide the following formula (7).

$$Vccw\leqq Vth_oled+Vth+Veff_gs \quad (7)$$

When voltage Veff_gs=0 is established, at which the drain-source current Ids is formed, the formula (7) is represented by the following formula (8). As shown by this formula (8), during a writing operation, the first power source voltage Vccw at a writing level must have a value that is equal to or less than the sum of the light-emitting threshold voltage Vth_oled and the threshold voltage Vth of the driving transistor T1 (a gate-source threshold voltage=a drain-source threshold voltage).

$$Vccw\leqq Vth_oled+Vth \quad (8)$$

Generally, the characteristic of the driving transistor T1 of FIG. 4A and the characteristic of the organic EL element shown in FIG. 4B change in accordance with the driving history. The following will describe an influence of the change in the characteristic of the driving transistor T1 and the organic EL element OLED in accordance with the driving history in a writing operation.

First, the characteristic of the driving transistor T1 will be described. As shown in FIG. 4A, the threshold voltage Vth of the driving transistor T1 in the initial state increases in accordance with the driving history by a threshold voltage change amount ΔVth. When the threshold voltage varies in accordance with the driving history, the characteristic line becomes a characteristic line SPw2 obtained by substantially translating the initial characteristic line SPw to a higher voltage side. In this case, in order to obtain gradation level current (drain-source current Ids) in accordance with the gradation level value of the display data, the data voltage Vdata must be increased by the threshold voltage change amount ΔVth.

Next, the following will describe an influence of the change in the characteristic of the organic EL element OLED during a writing operation. Generally, the organic EL element has resistance that increases in accordance with the driving history. As shown in FIG. 4B, in the characteristic line SPe2 after a change in the resistance of the organic EL element OLED, a rate at which the driving current Ioled increases with regard to an increase in the driving voltage Voled (increase rate) decreases when compared with the initial characteristic line SPe before the resistance change.

In order to allow the organic EL element OLED to emit light having an appropriate brightness depending on the gradation level value of the display data even when the resistance is high, the driving current Ioled in accordance with the gradation level value must be supplied to the organic EL element OLED. In order to supply such a driving current Ioled, the driving voltage Voled must be increased by a difference between the voltage corresponding to the necessary driving current Ioled for the gradation level in the characteristic line SPe2 and the voltage corresponding to the necessary driving current Ioled for the gradation level in the characteristic line SPe. It is noted that this difference voltage reaches the maximum value ΔVoled_max when the driving current Ioled is the maximum value Ioled_max. When the writing operation is completed to satisfy the above-described conditions, the display pixel PIX carries out a retention operation.

(Retention Operation)

Figure 5A:
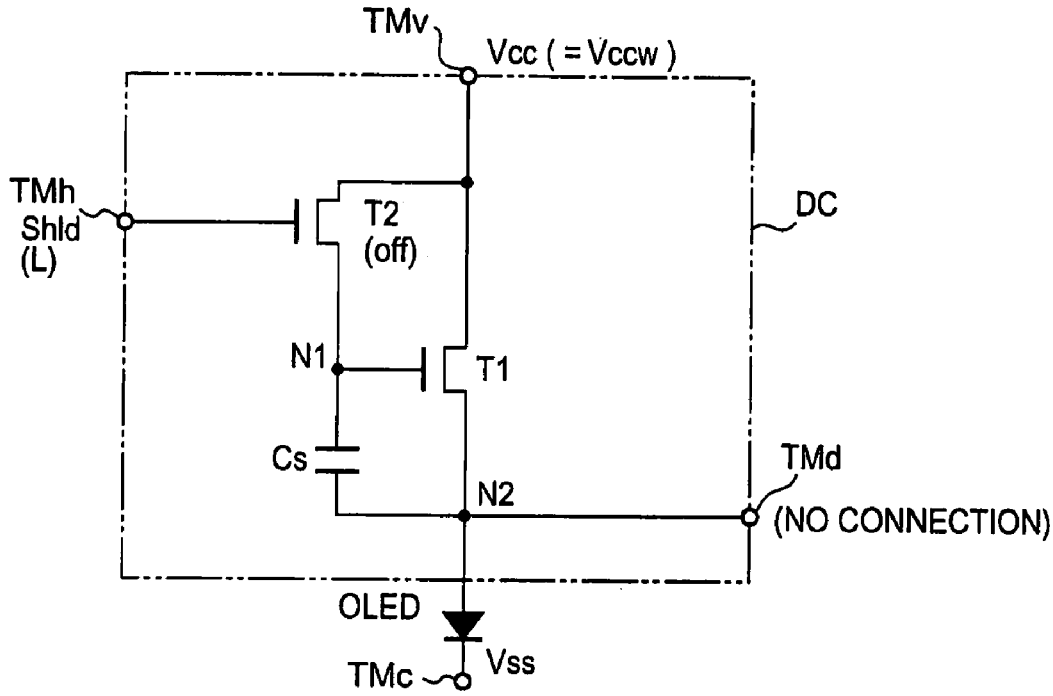
FIG. 5A illustrates an operation status in a retention operation of a display pixel.
Figure 5B:
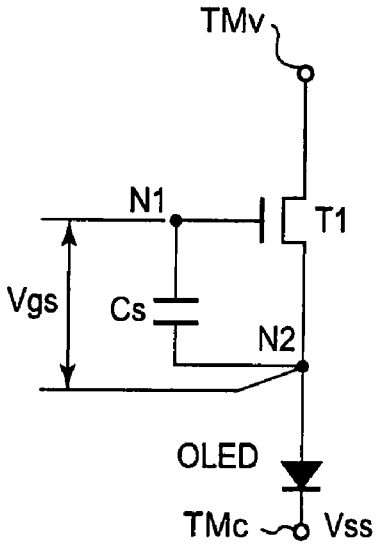
FIG. 5B illustrates an equivalent circuit in a retention operation of a display pixel.

During the retention operation, as shown in FIG. 5A, the control terminal TMh is applied with the retention control signal Shld of an OFF level (low level L). As a result, the retention transistor T2 is turned OFF to block electric connection between the gate and the drain of the driving transistor T1. Thus, the diode connection of the driving transistor T1 is cancelled to stop the charging of the capacitor Cs. As shown in FIG. 5B, the capacitor Cs retains the drain-source voltage Vds of the driving transistor T1 (=gate-source voltage Vgs) charged during the writing operation.

Figure 6:
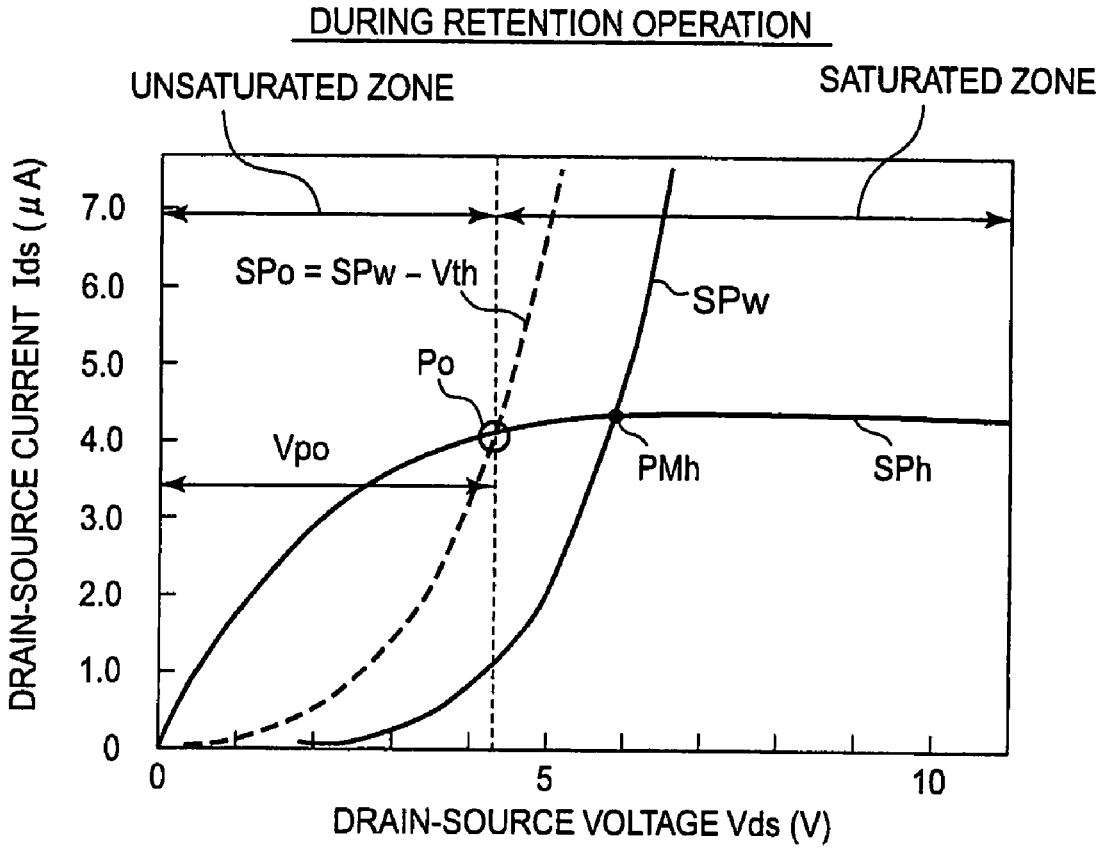
FIG. 6 illustrates an operating characteristic of a driving transistor in a retention operation of a display pixel.

The relationship between the drain-source voltage Vds and the drain-source current Ids when the diode connection of the driving transistor T1 is cancelled follows the characteristic line SPh represented by the solid line in FIG. 6. The gate-source voltage Vgs in this case is maintained to have a fixed value (e.g., a value of a voltage retained by the capacitor Cs during the retention operation).

The characteristic line SPw in FIG. 6 is substantially the same as the characteristic line SPw during the writing operation shown in FIG. 4A and shows the characteristic when the driving transistor T1 is diode-connected. An intersecting point of the characteristic line SPh and the characteristic line SPw is at the operation point PMh during the retention operation. The characteristic line SPo in FIG. 6 is obtained by deducting the threshold voltage Vth from the voltages Vgs of the characteristic line SPw. At the intersecting point Po of the characteristic line SPo and the characteristic line SPh, the drain-source voltage Vds has a pinch-off voltage Vpo.

When the driving transistor T1 operates in accordance with the characteristic line SPh, a zone within which the drain-source voltage Vds changes from 0 V to a pinch-off voltage Vpo is an unsaturated zone. In the unsaturated zone, the drain-source current Ids increases with an increase of the drain-source voltage Vds. A zone within which the voltage Vds is equal to or greater than the pinch-off voltage Vpo is a saturated zone. In the saturated zone, there is substantially no change in the drain-source current Ids even when the drain-source voltage Vds increases.

It is noted that the retention control signal Shld may be switched from an ON level to an OFF level when the power source voltage Vcc is switched from the first power source voltage Vccw for a writing operation to the second power source voltage Vcce for a light-emitting operation (when the retention operation is switched to the light-emitting operation).

When the retention operation is completed in the manner described above, the display pixel PIX carries out a light-emitting operation.

(Light-emitting Operation)

Figure 7A:
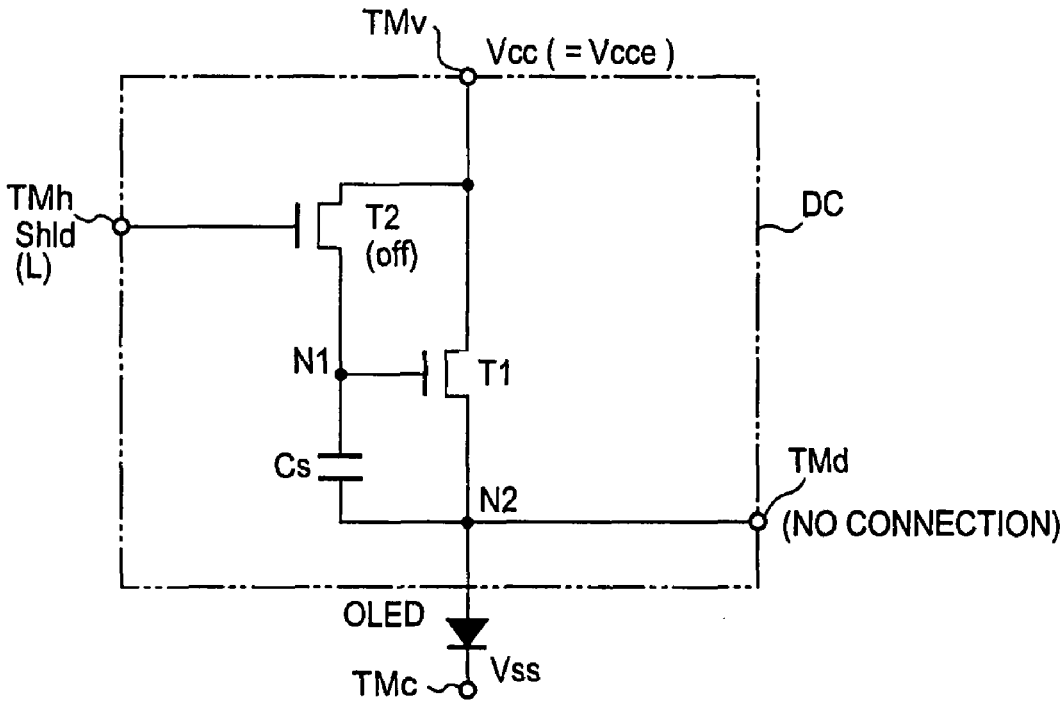
FIG. 7A illustrates an operation status in a light-emitting operation of a display pixel.

As shown in FIG. 7A, during a light-emitting operation, after the above-described retention operation, the diode connection of the driving transistor T1 remains cancelled. The power source terminal TMv is applied with the second power source voltage Vcce for a light-emitting operation as the terminal voltage Vcc instead of the first power source voltage Vccw for a writing operation. This second power source voltage Vcce has a higher potential than that of the first power source voltage Vccw.

Figure 7B:
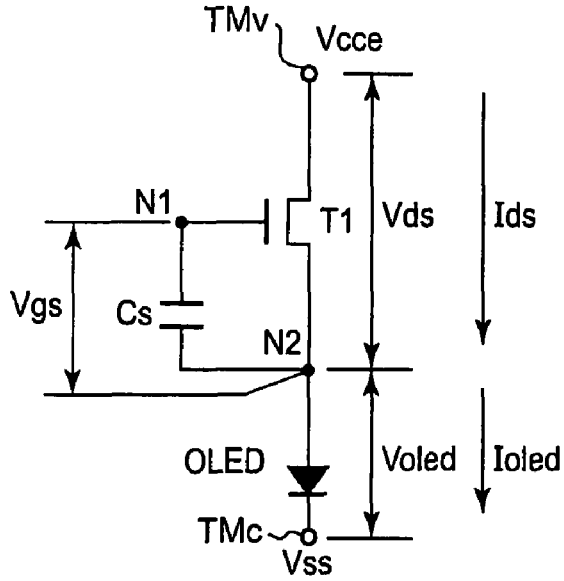
FIG. 7B illustrates an equivalent circuit in a light-emitting operation of a display pixel.

As a result, as shown in FIG. 7B, the current Ids in accordance with the value of the gate-source voltage Vgs flows between the drain and source of the driving transistor T1. This current Ids is supplied to the organic EL element OLED to allow the organic EL element OLED to emit light having a brightness in accordance with the value of the current Ids. During the light-emitting operation, the current Ids can be maintained at a fixed level by maintaining the gate-source voltage Vgs at a fixed level. Thus, a voltage retained by the capacitor Cs (a voltage applied to the capacitor Cs from a retention operation period to a light-emitting operation period) may be applied between the gate and the source for example.

Figure 8A:
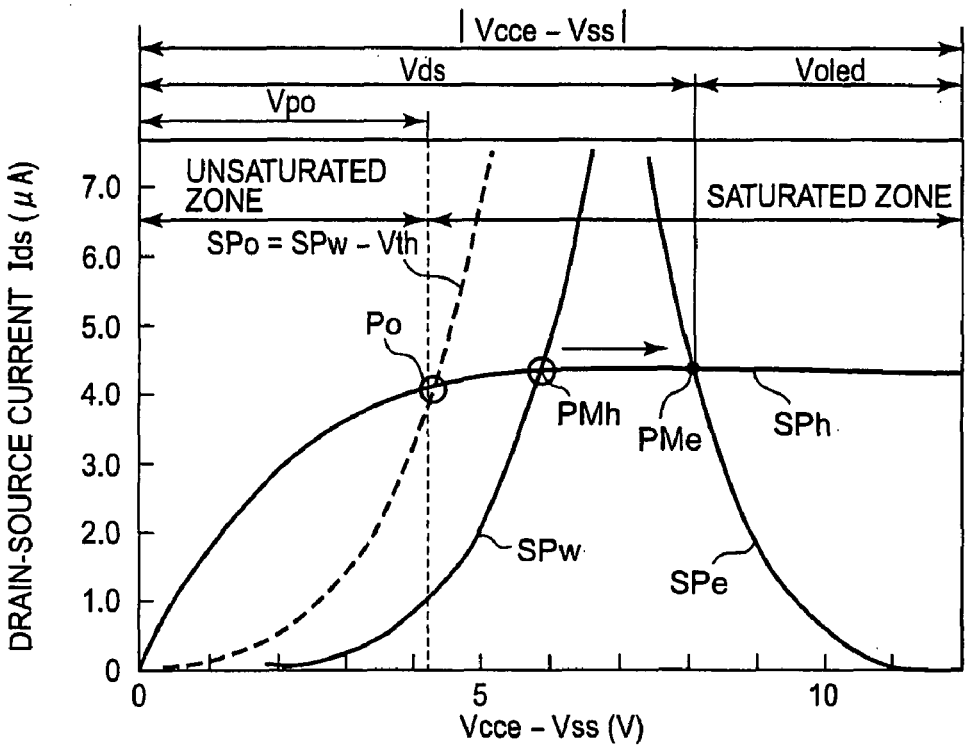
FIG. 8A shows an example of an operating characteristic of a driving transistor in a light-emitting operation of a display pixel.

During the light-emitting operation, when the gate-source voltage Vgs is fixed, the organic EL element OLED operates based on a load line SPe represented by the solid line in FIG. 8A. The load line SPe represents an inverted relationship between the driving voltage Voled and the driving current Ioled of the organic EL element OLED with regard to a value of a potential difference (Vcce−Vss) between the power source terminal TMv and the cathode terminal TMc of the organic EL element OLED as reference. In FIG. 8A, the characteristic line SPh is substantially the same as the characteristic line SPh shown in FIG. 6 during the retention operation.

As shown in FIG. 8A, when processing proceeds from the retention operation to the light-emitting operation, the operation point of the driving transistor T1 moves from the operation point PMh during the retention operation to an operation point PMe during the light-emitting operation (an intersecting point during the retention operation of the characteristic line SPh and the load line SPe of the organic EL element OLED). As shown in FIG. 8A, this operation point PMe is a point at which a potential difference (Vcce−Vss) between the power source terminal TMv and the cathode terminal TMc of the organic EL element is distributed between the drain and the source of the driving transistor T1 and between the anode and the cathode of the organic EL element OLED. Specifically, at the operation point PMe during the light-emitting operation, the voltage Vds is applied between the drain and the source of the driving transistor T1 and the driving voltage Voled is applied between the anode and the cathode of the organic EL element OLED as shown in FIG. 7B.

When the expected value current Ids flowing between the drain and the source of the driving transistor T1 during the writing operation is equal to the driving current Ioled supplied to the organic EL element OLED during the light-emitting operation, the organic EL element OLED emits light having a brightness depending on the gradation level value of the display data. To realize this, the operation point PMe of the driving transistor T1 during the light-emitting operation must be maintained within the saturated zone shown in FIG. 8A.

On the other hand, the driving voltage Voled of the organic EL element OLED has the maximum value Voled_max when the highest display gradation level is reached. Specifically, in order to allow the organic EL element OLED to emit light having a brightness depending on the gradation level value of the display data, the second power source voltage Vcce for a light-emitting operation may be set to satisfy a relation shown in the following formula (9). It is noted that the left-hand side of formula (9) represents a voltage applied between the above-described power source terminal TMv and the cathode terminal TMc of the organic EL element OLED. When the reference voltage Vss applied to the cathode terminal of the organic EL element OLED is set to have the ground potential of 0V, the formula (9) can be by the following formula (10).

$$Vcce-Vss \leqq Vpo+Voled_\max \quad (9)$$

$$Vcce \geqq Vpo+Voled_\max \quad (10)$$

Next, the following will describe an influence of a change in the characteristic of the organic EL element OLED during the light-emitting operation.

As shown in FIG. 4B, the organic EL element OLED has higher resistance in accordance with the driving history and as a result the increase rate of the driving current Ioled with respect to the driving voltage Voled decreases. Then, the load line SPe of the organic EL element OLED more gently inclines as shown by SPe2 and SPe3 in FIG. 8B. Specifically, the load line of the organic EL element OLED changes in accordance with the driving history to cause a change in the load line from SPe through SPe2 to SPe3. As a result, the operation point of the driving transistor T1 changes on the characteristic line SPh from PMe through PMe2 to PMe3.

When the operation point of the driving transistor T1 exists in the saturated zone (PMe to PMe2), the driving current Ioled maintains a value of the expected value current Ids during the writing operation. When the operation point exists in the unsaturated zone (when the operating point moves from PMe2 to PMe3, for example) however, the driving current Ioled decreases and is lower than the expected value current Ids during the writing operation. The decrease in the driving current Ioled causes the light-emitting element to emit light with a gradation level lower than the brightness corresponding to the gradation level value of the display data.

Figure 8B:
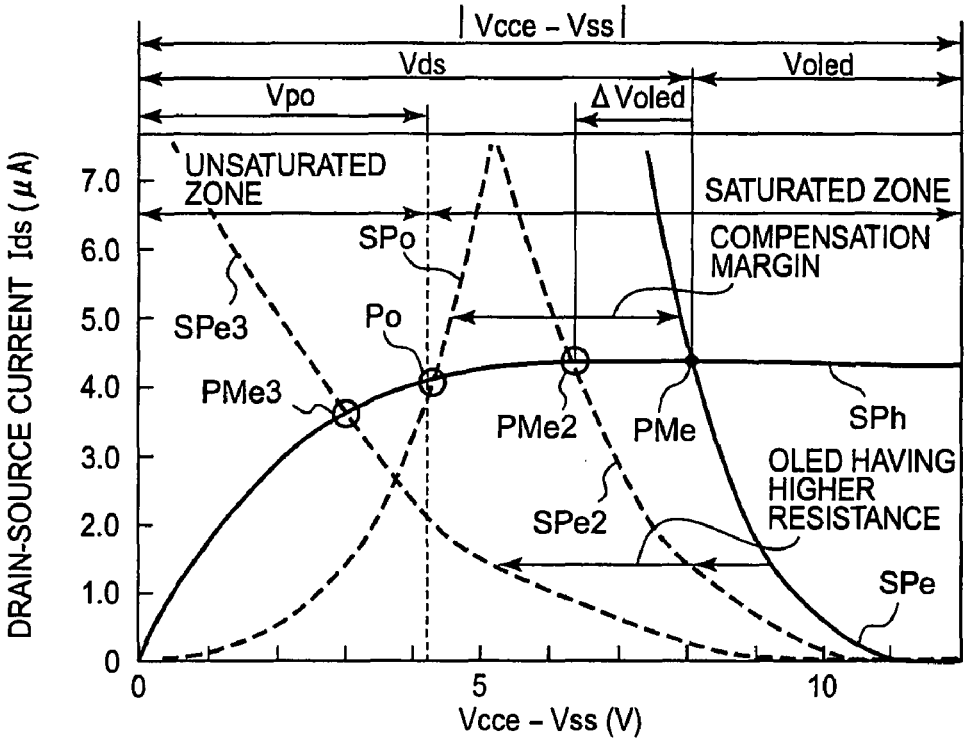
FIG. 8B shows an example of a load characteristic of the organic EL element in a light-emitting operation.

In the example of FIG. 8B, the pinch-off point Po exists at a boundary between the unsaturated zone and the saturated zone. Thus, a potential difference between the operation point PMe and the pinch-off point Po during the light-emitting operation functions, when the organic EL element has a higher resistance, as a compensation margin for maintaining a driving current Ioled during the light-emitting operation. In other words, a compensation margin corresponding to the current value of the driving current Ioled functions as a potential difference on the characteristic line SPh between a pinch-off point trajectory SPo and the load line SPe of the organic EL element. It is noted that the compensation margin decreases with an increase of the driving current Ioled. The compensation margin increases when a voltage that is applied between the power source terminal TMv and the cathode terminal TMc of the organic EL element OLED (Vcce−Vss) increases.

In the above-described illustrative embodiment, a transistor voltage is used to control brightness of the respective light-emitting elements (hereinafter referred to as "voltage gradation level control"). The data voltage Vdata is set based on initial characteristics of the previously determined transistor drain-source voltage Vds and the drain-source current Ids. However, the data voltage Vdata set based on the method described above causes an increase in the threshold voltage Vth in accordance with the driving history. Thus, the driving current supplied to the light-emitting element fails to correspond to the display data (data voltage) and thus the light-emitting element does not emit light having a preferred brightness. When the transistor is an amorphous transistor in particular, the element characteristic remarkably varies.

In an n-channel-type amorphous silicon transistor, a driving history or temporal change causes carrier trap to a gate insulating film. This carrier trap offsets a gate field and the characteristic between the drain-source voltage Vds and the drain-source current Ids have an increased threshold voltage Vth. In the example of FIG. 4A, during the writing operation, the threshold voltage Vth shifts from the characteristic SPw in an initial status to the characteristic SPw2 at a higher voltage. When the drain-source voltage Vds is fixed in this case, the drain-source current Ids decreases and the light-emitting element has reduced a brightness. It is noted that the amorphous transistor in the example shown in FIG. 4A is designed to have a gate insulating film thickness of 300 nm (3000 Å), a channel width of 500 μm, a channel length of 6.28 μm, and a threshold voltage of 2.4 V.

When the element characteristic of the transistor varies, the threshold voltage Vth generally increases. After the variation in the element characteristic, the characteristic line SPw2 showing the relationship between the drain-source voltage Vds and the drain-source current Ids is a substantial translation of the characteristic line SPw in the initial state. Thus, a characteristic substantially corresponding to the varied characteristic line SPw2 can be obtained by adding a fixed voltage (hereinafter referred to as "OFFSET voltage Vofst") corresponding to the change amount ΔVth of the initial threshold voltage Vth to the drain-source voltage Vds of the initial characteristic line SPw. Specifically, during an operation for writing the display data to the pixel driving circuit DC, the source terminal of the driving transistor T1 (contact point N2) is applied with a voltage obtained by the drain-source voltage Vds on the characteristic line SPw with and an OFFSET voltage Vofst (hereinafter referred to as "compensated gradation level voltage Vpix").

In this manner, a change in the element characteristic due to the variation in the threshold voltage Vth can be compensated for. Specifically, the light emission driving current Iem having a value depending on display data can be supplied to the organic EL element OLED. The organic EL element OLED, having received the light emission driving current Iem, emits light having a brightness in accordance with the display data.

First Embodiment

Figure 9:
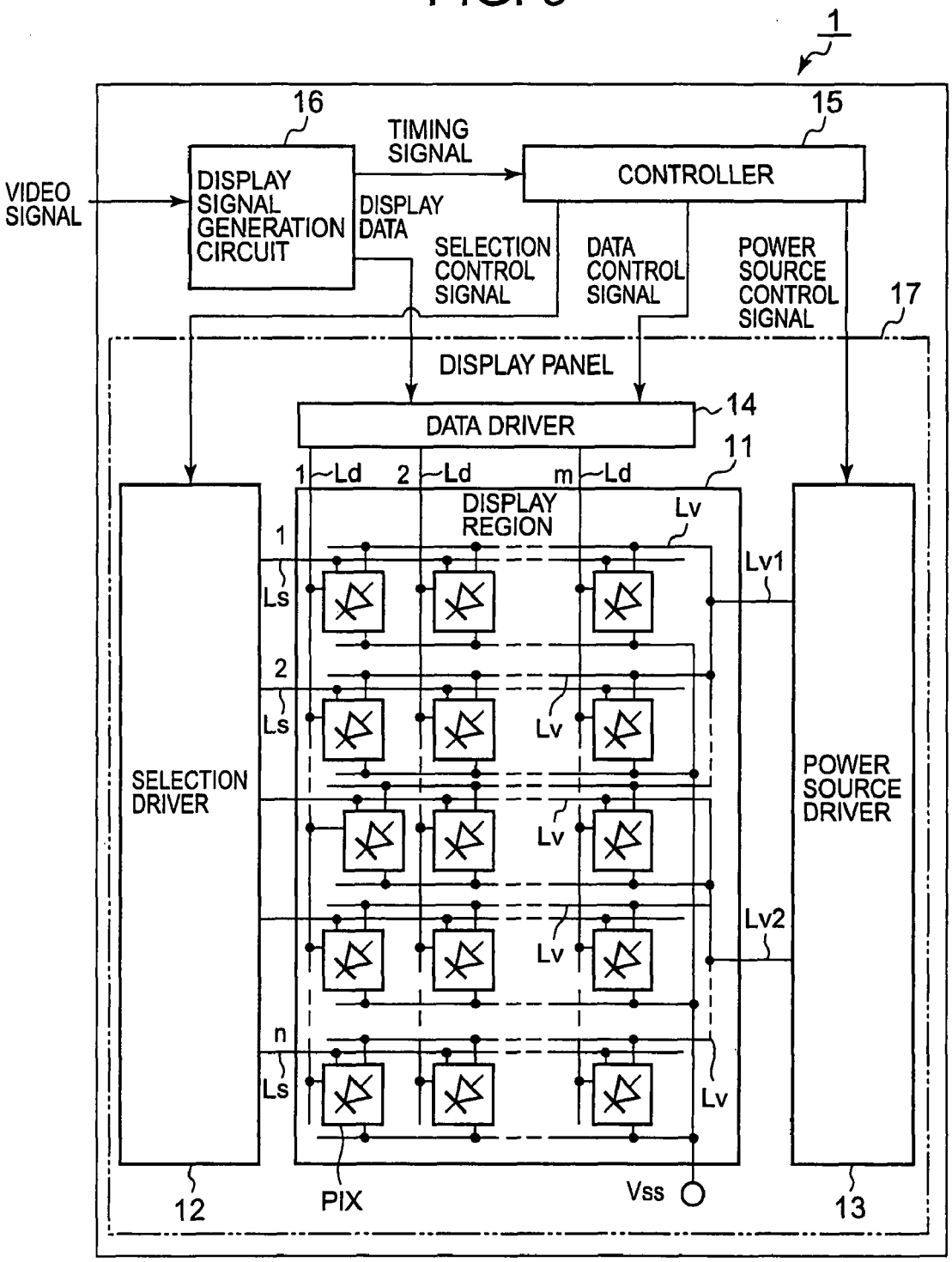
FIG. 9 is a block diagram showing the structure of the display apparatus in a first embodiment of the invention.

The following section will describe the display apparatus 1 of a first embodiment of the invention which displays an image using the above-described display pixel PIX. First, the structure of the display apparatus 1 will be described. As shown in FIG. 9, the display apparatus 1 includes a display zone 11, a selection driver 12, a power source driver 13, a data driver (display driving apparatus) 14, a controller 15, a display signal generation circuit 16, and a display panel 17.

The display zone 11 includes a plurality of selection lines Ls, a plurality of data lines Ld, and a plurality of display pixels PIX. The respective selection lines Ls are arranged in a horizontal row of the display zone 11 (left-and-right direction in FIG. 9). The respective selection lines Ls are thus parallel to one another. The respective data lines Ld are arranged in a vertical column of the display zone 11 (up-and-down direction in FIG. 9). The respective data lines Ld are thus parallel to one another. The respective display pixels PIX are arranged in the vicinity of the respective intersecting points of the respective selection lines Ls and the respective data lines Ld and in a lattice-like manner in "n" rows×"m" columns (n and m are positive integers).

The selection driver 12 supplies a selection signal Ssel to the respective selection lines Ls at or with a predetermined timing. This selection signal Ssel is a signal for instructing the capacitor Cs with regard to the display pixel PIX to which a voltage corresponding to the gradation level value of the display data should be written. The selection driver 12 may include an Integrated Circuit (IC) chip or a transistor.

The power source driver 13 supplies, with a predetermined timing, the power source voltage Vcc of the predetermined voltage level to a plurality of power source voltage lines Lv arranged in the selection line Ls in parallel with the selection line Ls.

The data driver (display driving apparatus) 14 applies the compensated gradation level voltage Vpix (e.g., Vpix(i), Vpix (i+1)) to the respective data lines Ld with a predetermined timing.

The controller 15 generates a signal for controlling the operations of the respective members to supply the signal to the respective members based on a timing signal supplied from the display signal generation circuit 16. For example, the controller 15 supplies a selection control signal for controlling the operation of the selection driver 12, a power source control signal for controlling the operation of the power source driver 13, and a data control signal for controlling the operation of the data driver 14.

The display signal generation circuit 16 generates display data (data for brightness corresponding to an emitting color) based on a video signal input from the exterior of the display apparatus 1 to supply the display data to the data driver 14. Based on the generated display data, the display signal generation circuit 16 also extracts a timing signal (e.g., system clock) for displaying an image in the display zone 11 to supply the timing signal to the controller 15. This timing signal also may be generated by the display signal generation circuit 16.

The display panel 17 is a board including the display zone 11, the selection driver 12, and the data driver 14. This board also may include the power source driver 13. The display panel 17 may include a part of the data driver 14 and the remaining part thereof may be provided at the exterior of the display panel 17. In this case, a part of the data driver 14 in the display panel 17 may include an IC chip or a transistor.

The display panel 17 has, at the center thereof, the display panel 17 in which the respective display pixels PIX are arranged in a lattice-like manner. The respective display pixels PIX are divided into a group positioned at an upper zone of the display zone 11 and a group positioned at a lower zone. The display pixels PIX included in each group are connected to branched power source voltage lines Lv, respectively. The group at the upper zone in the first embodiment includes the first to (n/2)th display pixels PIX ("n" is an even number). The group at the lower zone includes the (n/2+1) to "n"th display pixels PIX.

The respective power source voltage lines Lv in the group at the upper zone are connected to the first power source voltage line Lv1. The respective power source voltage lines Lv in the group at the lower zone are connected to the second power source voltage line Lv2. The first power source voltage line Lv1 and the second power source voltage line Lv2 are connected to the power source driver 13 independent of one another. Thus, the power source voltage Vcc is commonly applied to the first to (n/2)th display pixels PIX via the first power source voltage line Lv1. The (n/2+1) to "n"th display pixels PIX are commonly applied with the power source voltage Vcc via the second power source voltage line Lv2. The power source driver 13 applies the power source voltage Vcc via the first power source voltage line Lv1 at a timing different from a timing at which the power source driver 13 applies the power source voltage Vcc via the second power source voltage line Lv2.

Figure 10:
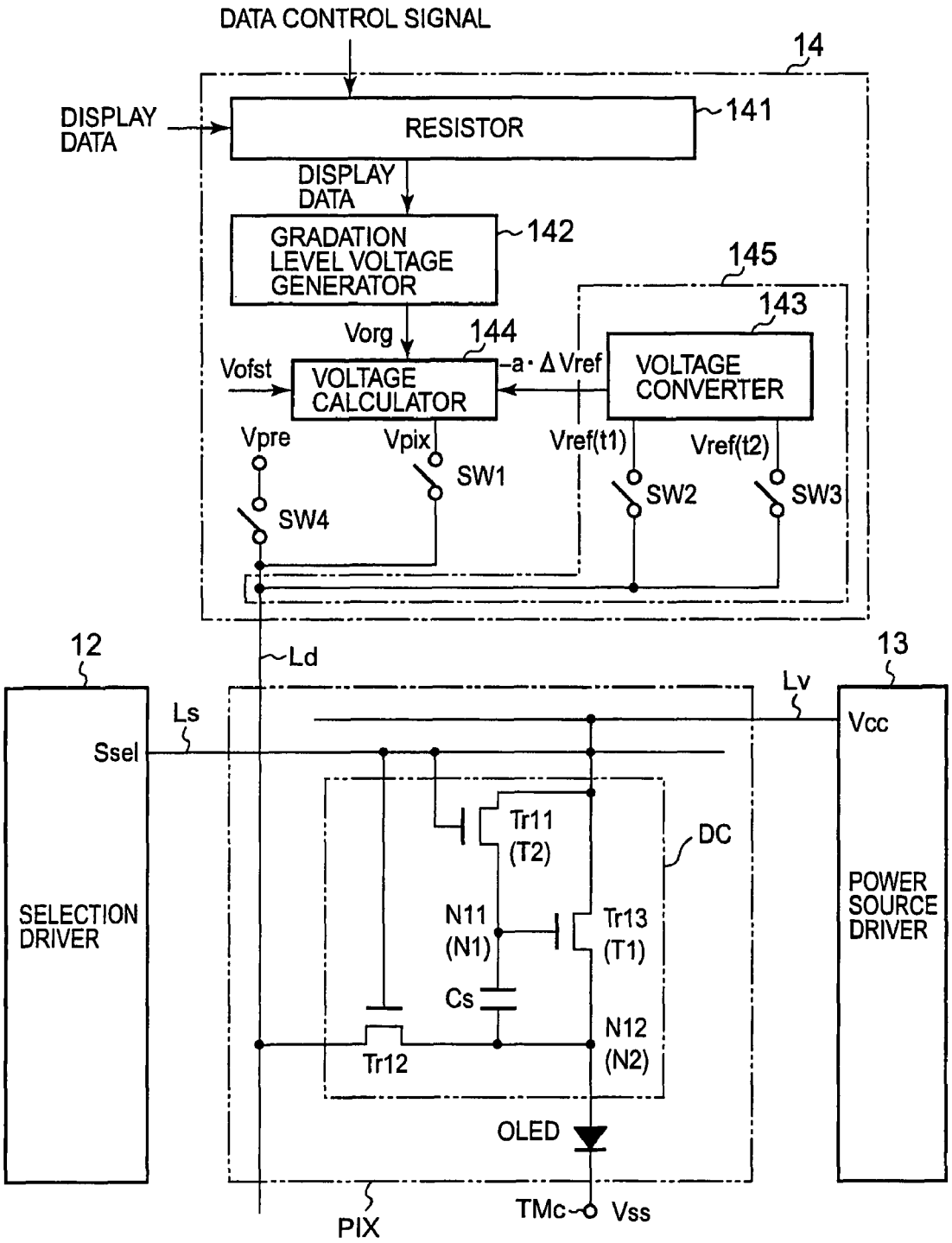
FIG. 10 shows the structure of the main part of the data driver and the display pixel (pixel driving circuit, light-emitting element) in the first embodiment of the invention.

The display pixel PIX shown in FIG. 9 includes, as shown in FIG. 10, the pixel driving circuit DC and the organic EL element OLED. The pixel driving circuit DC has a transistor Tr11, a selection transistor Tr12, a driving transistor Tr13, and a capacitor Cs. This transistor Tr11 corresponds to the retention transistor T2 shown in FIG. 1 and the driving transistor Tr13 corresponds to the driving transistor T1 shown in FIG. 1. The respective transistors Tr11 to Tr13 may be an arbitrary type of transistor but the respective transistors Tr11 to Tr13 in the following description are all n channel-type field effect-type transistors. The retention transistor Tr11 is a transistor for diode connection of the driving transistor Tr13. The retention transistor Tr11 is structured so that a gate terminal is connected to the selection line Ls, a drain terminal is connected to the power source voltage line Lv, and a source terminal is connected to the contact point N11. The selection line Ls is applied with the selection signal Ssel. This selection signal Ssel is identical with the retention control signal Shld shown in FIG. 2.

The selection transistor Tr12 shown in FIG. 10 is structured so that a gate terminal is connected to the selection line Ls, a source terminal is connected to the data line Ld, and a drain terminal is connected to the contact point N12. This contact point N12 corresponds to the contact point N2 shown in FIG. 1. The driving transistor Tr13 is structured so that a gate terminal is connected to the contact point N11, a drain terminal is connected to the power source voltage line Lv, and a source terminal is connected to the contact point N12. The contact point N11 corresponds to the contact point N1 shown in FIG. 1.

The capacitor Cs is identical to that shown in FIG. 1. The capacitor Cs shown in FIG. 10 is connected between the contact point N11 and the contact point N12 (between the gate and the source of the driving transistor Tr13). The organic EL element OLED is structured so that an anode terminal is connected to the contact point N12 and the cathode terminal TMc is applied with a fixed reference voltage Vss.

During the writing operation, the compensated gradation level voltage Vpix corresponding to the gradation level value of the display data is applied to the capacitor Cs in the pixel driving circuit DC. Then, the compensated gradation level voltage Vpix, the reference voltage Vss, and the power source voltage Vcc (Vcce) having a high potential applied to the power source voltage line Lv for a light-emitting operation satisfying formulas (3) to (10). Thus, during the writing operation, the organic EL element OLED is in a light-off status. The pixel driving circuit DC is not limited to the structure shown in FIG. 10 and may alternatively have any structure so long as that structure has elements corresponding to the respective elements shown in FIG. 1 and has a current path of the driving transistor T1 that includes current driving-type light-emitting elements OLED arranged in series. The light-emitting element is not limited to the organic EL element OLED and also may be other current driving-type light-emitting elements such as a light-emitting diode.

The selection driver 12 includes, for example, a shift register and an output circuit section (output buffer). Based on the selection control signal from the controller 15, the shift register sequentially outputs shift signals corresponding to selection lines Ls of the respective rows. The output circuit section converts the level of the shift signals to a predetermined selected level (high level H or low level L). After the conversion, the output circuit section sequentially outputs the converted shift signals to the selection lines Ls of the respective rows as the selection signals Ssel.

Figure 13:
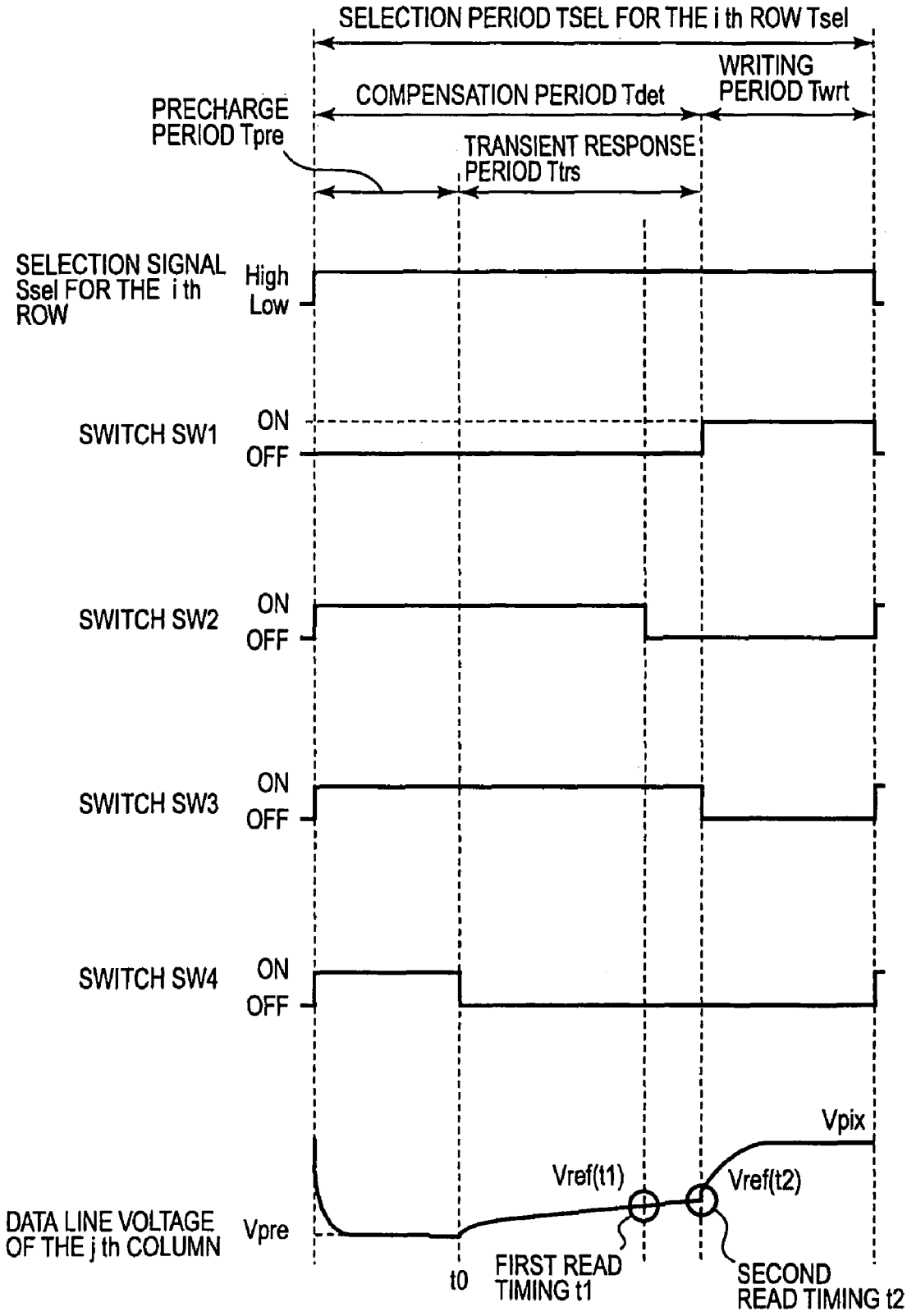
FIG. 13 illustrates a timing diagram in the selection operation of the display apparatus.

For example, during a selection period Tsel shown in FIG. 13 (a period including a precharge period Tpre, a transient response period Ttrs, and a writing period Twrt), the selection driver 12 supplies the selection signal Ssel of a high level to the selection lines Ls of the respective rows connected with the display pixels PIX. The selection driver 12 supplies the selection signal Ssel to the selection line Ls in each row with a predetermined timing to sequentially set the display pixel PIX in each row to a selected status. The selection driver 12 may include a transistor that is the same as those of the respective transistors Tr11, Tr12, Tr13 in the pixel driving circuit DC.

During the selection period Tse, the power source driver 13 applies, based on the power source control signal from the controller 15, the power source voltage Vcc having a low potential (=Vccw) to the respective power source voltage lines Lv. During the light-emitting period, the power source driver 13 applies the power source voltage Vcc having a high potential (=Vcce) to the respective power source voltage lines Lv. In the example of FIG. 9, the power source driver 13 applies, during the operation of the display pixels PIX included in the group at the upper zone, the power source voltage Vcc to these display pixels PIX via the first power source voltage line Lv1. The power source driver 13 also applies, during the operation of the display pixels PIX included in the group at the upper zone, the power source voltage Vcc to these display pixels PIX via the second power source voltage line Lv2.

The lower source driver 13 may include a timing generator and an output circuit section. The timing generator generates, timing signals corresponding to the respective power source voltage lines Lv based on a power source control signal from the controller 15. The timing generator is a shift register that sequentially outputs a shift signal for example. The output circuit section converts a timing signal to a predetermined voltage level (voltage values Vccw and Vccw) to apply the power source voltage Vcc suitable for this voltage level to the respective power source voltage lines Lv. When the number of the power source voltage lines Lv is small, the power source driver 13 may be provided in the controller 15 instead of the display panel 17.

The data driver (display driving apparatus) 14 generates a signal voltage (original gradation level voltage Vorg) corresponding to the display data (gradation level) for each display pixel PIX supplied from the display signal generation circuit 16 for compensation. By compensating for the original gradation level voltage Vorg, the data driver 14 generates a compensated gradation level voltage Vpix corresponding to the element characteristic (threshold voltage) of the driving transistor Tr13 in each display pixel PIX. After generation, the data driver 14 applies the compensated gradation level voltage Vpix to the respective display pixels PIX via the data line Ld.

As shown in FIG. 10, the data driver 14 includes a resistor 141, a gradation level voltage generator 142, a voltage converter 143, a voltage calculator 144, and changing-over switches SW1, SW2, SW3 and SW4. The gradation level voltage generator 142, the voltage calculator 144, and the changing-over switches SW1, SW2, SW3 and SW4 are provided in the data line Ld of each column and are provided in a quantity of "m" in the entire data driver 14.

A voltage reader 145 includes the voltage converter 143 and the changing-over switches SW2 and SW3. The voltage converter 143 and the changing-over switches SW2 and SW3 are connected to the data line Ld. Wiring resistances and capacities from the data line Ld to the respective changing-over switches SW1, SW2, SW3 and SW4 are equal to one another. Thus, a voltage drop due to the data line Ld is substantially equal to any of the respective changing-over switches SW1, SW2, SW3 and SW4.

The resistor 141 has a shift register and a data register. The shift register sequentially outputs a shift signal based on a data control signal from the controller 15. Based on the output shift signal, the data register acquires data for brightness of the gradation level to transfer the data to the gradation level voltage generators 142 in the respective columns in a parallel manner. The data register acquires data for gradation level by acquiring data corresponding to the display pixels PIX in one row on the display zone 11.

The gradation level voltage generator 142 generates and outputs the original gradation level voltage Vorg. This original gradation level voltage Vorg is a voltage that has a value corresponding to display data for each display pixel PIX and that shows brightness of the gradation level of each organic EL element OLED. The original gradation level voltage Vorg is applied between an anode and a cathode of the organic EL element OLED and thus does not depend on the threshold voltage Vth of the transistor Tr13. When the driving transistor Tr13 operates based on the characteristic line SPw shown in FIG. 4A, the gradation level voltage generator 142 outputs, to the data line Ld, an absolute voltage value obtained by adding this original gradation level voltage Vorg to the threshold voltage Vth (|Vorg+Vth|). Then, in view of the potential difference between the power source voltage line Lv and the data line Ld, current for allowing the organic EL element OLED to emit light having a brightness depending on the display data flows in the transistor Tr13.

During the writing operation, when current flows from the power source voltage line Lv to the data line Ld, the gradation level voltage generator 142 calculates a value obtained by multiplying, with −1, a voltage having a sum of the original gradation level voltage Vorg and the threshold voltage Vth to output the value. When current flows from the data line Ld to the power source voltage line Lv, the gradation level voltage generator 142 directly outputs the voltage having the sum of the original gradation level voltage Vorg and the threshold voltage Vth without multiplying the voltage with a coefficient. The original gradation level voltage Vorg is set to have a higher voltage with an increase of gradation level of display data.

The gradation level voltage generator 142 also may include, for example, a Digital to Analog Converter (DAC) and an output circuit. Based on a gradation level reference voltage supplied from a power supply section (not shown), the DAC converts a digital signal voltage of display data to an analog signal voltage. This gradation level reference voltage is a reference voltage based on the values of gradation level. The output circuit outputs, with a predetermined timing, the analog signal voltage converted by the DAC as the original gradation level voltage Vorg.

Figure 12:
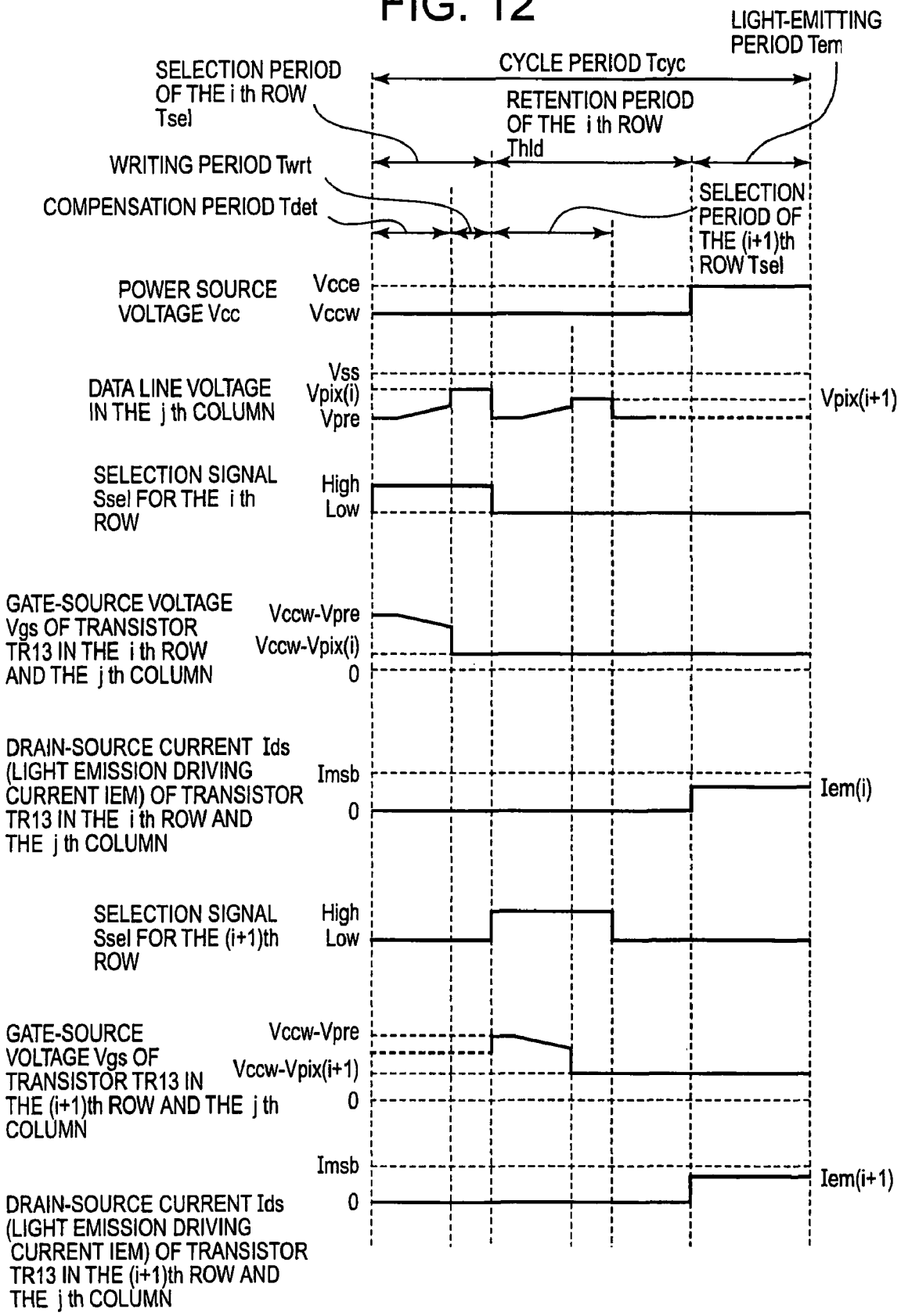
FIG. 12 illustrates a timing diagram in a driving control of the display apparatus.

The voltage converter 143 applies the predetermined precharge voltage to the data line Ld. After the application, during a transient response period (natural relaxation period), the voltage of the capacitor Cs is read via the respective data lines Ld with a plurality of timings. In the example of FIG. 12, the voltage converter 143 reads the first reference voltage Vref(t1) at the first read timing t1 and reads the second reference voltage Vref(t2) at the second read timing t2.

After the readings, the voltage converter 143 determines a coefficient "a" to estimate a threshold voltage of the transistor Tr13 after the characteristic variation. The voltage converter 143 calculates the difference ΔVref between the first reference voltage Vref(t1) and the second reference voltage Vref (t2). Next, the voltage converter 143 multiplies the coefficient "a" with the difference ΔVref to generate the first compensation voltage a·ΔVref to output the first compensation voltage a·ΔVref to the voltage calculator 144.

In the example of FIG. 10, current flowing in the data line Ld during the writing operation is set to flow from the data line Ld to the data driver 14. Thus, the first compensation voltage a·ΔVref is set so that the condition: a·ΔVref<Vccw−Vth1−Vth2, is established. Vth1 represents a threshold voltage of the transistor Tr13 and Vth2 represents a threshold voltage of the transistor Tr12. Current flows from the power source voltage line Lv via the drain and source of the transistor Tr13, the drain and source of the transistor Tr12, and the data line Ld.

The voltage calculator 144 performs addition and subtraction of the original gradation level voltage Vorg from the gradation level voltage generator 142, the first compensation voltage a·ΔVref from the voltage converter 143, and the previously-set second compensation voltage Vofst. When the gradation level voltage generator 142 includes the DAC, the addition and subtraction processes are performed for analog signals. The second compensation voltage Vofst may be determined based on an output variation characteristic of the threshold voltage Vth of the transistor Tr13 for example. Next, the voltage calculator 144 outputs the voltage obtained by addition and subtraction as the compensated gradation level voltage Vpix to the data line Ld. During the writing operation, voltage calculator 144 determines the compensated gradation level voltage Vpix so as to satisfy formula (11).

$$Vpix=a\cdot\Delta Vref-Vorg+Vofst \quad (11)$$

The respective changing-over switches SW1, SW2, SW3 and SW4 switch ON and OFF based on the data control signal from the controller 15, respectively. The changing-over switch SW1 turns ON or OFF the application by the voltage calculator 144 of the compensated gradation level voltage Vpix to the data line Ld. The changing-over switches SW2 and SW3 turn ON or OFF an operation in which the voltage converter 143 reads a voltage of the data line Ld. The changing-over switches SW2 and SW3 operate with different timings, respectively. The changing-over switch SW4 turns ON or OFF the application of the precharge voltage Vpre to the data line Ld.

The controller 15 controls the selection driver 12, the power source driver 13, and the data driver 14 to operate the respective drivers with a predetermined timing. The selection driver 12 sequentially sets the display pixel PIX to the selected status. The power source driver 13 applies the power source voltage Vcc to the respective power source voltage lines Lv. The data driver 14 applies the compensated gradation level voltage Vpix to the respective display pixels PIX.

The pixel driving circuits DC of the respective display pixels PIX performs a series of driving control operations under control provided by the controller 15. This driving control operation includes a compensated gradation level voltage setting operation (precharge operation, transient response, reference voltage reading operation), a writing operation, a retention operation, and a light-emitting operation. In the driving control operation, the pixel driving circuit DC causes the display zone 11 to display image information based on a video signal.

The display signal generation circuit 16 extracts gradation level signals included in the video signal input from the exterior of the display apparatus 1. After the extraction, the display signal generation circuit 16 supplies the gradation data signals to the data driver 14 for every row of the display zone 11. When the video signal includes a timing signal defining the timing at which the image is to be displayed, the display signal generation circuit 16 may extract the timing signal to output the timing signal to the controller 15. Then, the controller 15 outputs the respective control signals to the respective drivers based on the timing defined by the timing signal.

(Method for Driving Display Apparatus)

A method for driving the display apparatus 1 will now be described. The following section refers to the respective display pixels PIX placed at positions (i,j) on the display zone 11 (n rows×m columns) by display pixels PIX (i,j) ($1\leqq i\leqq n$, $1\leqq i\leqq m$).

Figure 11:
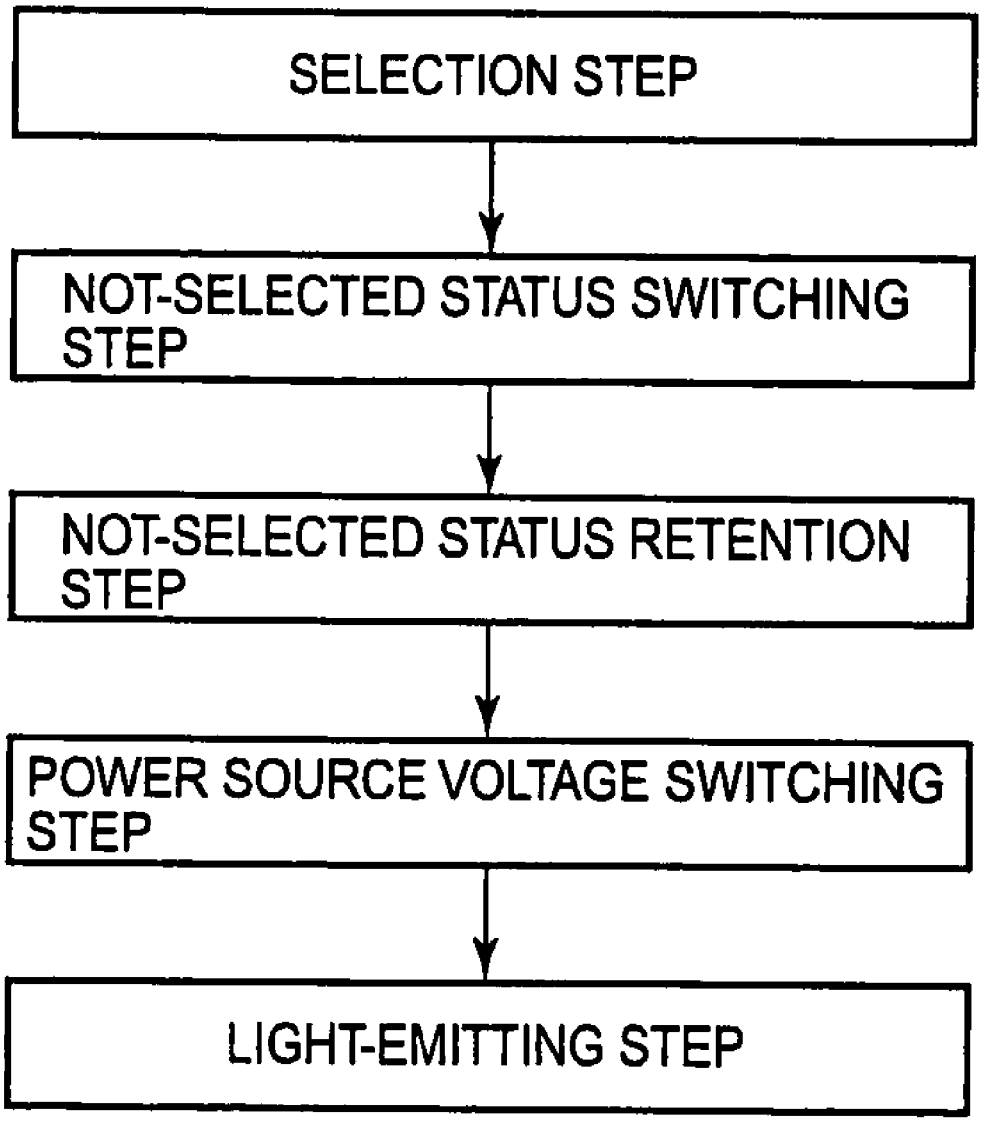
FIG. 11 shows the respective steps from a selection operation to a light-emitting operation.

As shown in FIG. 11, a method for driving the display apparatus 1 of the first embodiment described above includes a selection step, a not-selected status switching step, a not-selected status retention step, a power source voltage switching step, and a light-emitting step. The respective steps are operations carried out in the respective display pixels PIX so that the respective display pixels PIX in the entire display zone 11 independently perform the operations of the respective steps. The selection step is a step for carrying out an operation shown in FIG. 13 (precharge operation, compensated gradation level voltage setting operation, writing operation). The not-selected status retention step is a step for performing the retention operation shown in FIG. 2. The light-emitting step is a step for performing the light-emitting operation shown in FIG. 2.

As shown in FIG. 12, the display apparatus 1 repeats a series of operations with a predetermined cycle period Tcyc. The cycle period Tcyc is a period required for one display pixel PIX to display one pixel of an image of one frame for example. In the embodiment of the invention, the cycle period Tcyc is a period required for the display pixels PIX for one row to display an image of one row of video frames.

First, in the compensation period Tdet in the selection period Tsel, a precharge operation is performed. In the precharge operation, the voltage converter 143 applies the predetermined precharge voltage Vpre to data line Ld of the respective columns. As a result, the precharge current Ipre from the power source voltage line Lv flows in the respective rows to the data line Ld. Thereafter, as shown in FIG. 13, the changing-over switch SW4 is turned OFF and, the application of the precharge voltage Vpre by the voltage converter 143 is stopped. As a result, the precharge operation is completed. A timing at which the application of the precharge voltage Vpre is completed is included in the compensation period Tdet.

When the first read timing t1 shown in FIG. 13 has passed since the stoppage of the application of the precharge voltage Vpre, the voltage converter 143 reads the first reference voltage Vref(t1). Once the second read timing t2 shown in FIG. 13 has passed since the stoppage, the voltage converter 143 reads the second reference voltage Vref(t2).

In the compensated gradation level voltage setting operation, the gradation level voltage generator 142 generates the original gradation level voltage Vorg corresponding to the display data supplied from the display signal generation circuit 16. The voltage calculator 144 compensates the original gradation level voltage Vorg generated by the gradation level voltage generator 142 to generate the compensated gradation level voltage Vpix. When the voltage calculator 144 generates the compensated gradation level voltage Vpix, the compensated gradation level voltage setting operation is completed. Thereafter, the writing operation is performed.

In the writing operation, the voltage calculator 144 applies the compensated gradation level voltage Vpix to the respective data lines Ld. As a result, the writing current (the drain-source current Ids of the transistor Tr13) flows in the capacitor Cs.

In the retention operation, a voltage depending on the written compensated gradation level voltage Vpix (the charge being enough to flow writing current) written by a writing operation between the gate and the source of the transistor Tr13 is charged in the capacitor Cs and is retained. A period during which the retention operation is performed will be referred to as a "retention period Thld".

In the light-emitting operation, as shown in FIG. 12, based on the charging voltage retained by the capacitor Cs, the light emission driving current Iem (e.g., Iem(i), Iem(i+1)) is supplied to the organic EL element OLED. The organic EL element OLED emits light having a gradation level depending on display data. A period during which the light-emitting operation is performed will be referred to as a "light-emitting period Tem". During the light-emitting period Tem, the light emission driving current Iem preferably equals to the drain-source current Ids of the transistor Tr13.

The respective operations during the above-described selection operation will now be described referring to display pixels PIX in the "i"th row. The reference voltage reading operation and the compensated gradation level voltage generation operation are performed during the election period Tsel for the display pixels PIX in the "i"th row now being processed.

As shown in FIG. 13, a period during which the precharge operation is performed during the compensation period Tdet will be referred to as a "precharge period Tpre". During this precharge period Tpre, the power source voltage line Lv is applied with the power source voltage Vccw. The voltage converter 143 applies the predetermined precharge voltage Vpre to the respective data lines Ld. As a result, the drain-source current Ids depending on the precharge voltage Vpre flows in the transistor Tr13 of the respective display pixels PIX arranged in a specific row (e.g., the "i"th row). The capacitor Cs accumulates change depending on the precharge voltage Vpre.

As shown in FIG. 13, when the precharge operation is completed, the display driving apparatus DC turns OFF the changing-over switch SW4 to stop the application of the precharge voltage Vpre. After the completion of the precharge operation, a transient response is started. A timing at which the precharge operation is completed will be hereinafter referred to as "transient response start timing t0". A period from the start of the transient response to the completion will be referred to as a "transient response period Ttrs".

During the transient response period Ttrs, the data driver 14 performs the reference voltage reading operation. Once the transient response start timing t0 has passed and the first read timing t1 is reached, the voltage converter 143 reads, via data line Ld, the charging voltage of the capacitor Cs retained between the gate and the source of the transistor Tr13. The read charging voltage is the first reference voltage Vref(t1) shown in FIG. 13. The voltage converter 143 also reads, at the second read timing t2, the second reference voltage Vref(t2) shown in FIG. 13. Then, the reference voltage reading operation is completed.

Next, during the compensation period Tdet shown in FIG. 13 the pixel driving circuit DC performs the compensated gradation level voltage generation operation. In the compensated gradation level voltage generation operation, the voltage calculator 144 sets the compensated gradation level voltage Vpix based on the first reference voltage Vref(t1) and the second reference voltage Vref(t2).

Figure 14:
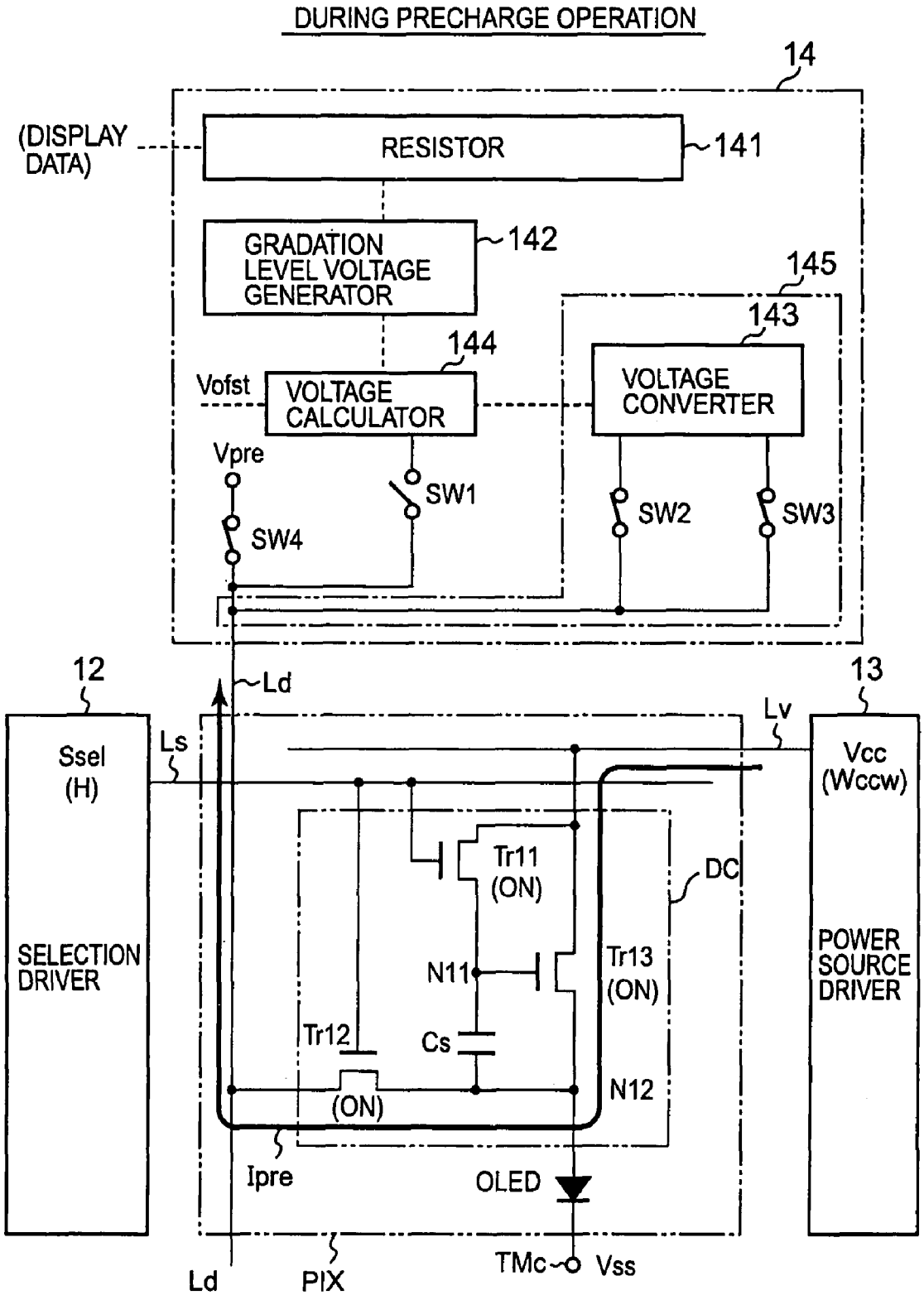
FIG. 14 illustrates the operation status of the data driver and the display pixel in the precharge operation.

As shown in FIG. 14, during the precharge period Tpre, the power source driver 13 applies the power source voltage Vcc of the writing operation level (=the first power source voltage Vccw≦reference voltage Vss) to the power source voltage line Lv connected to the display pixels PIX in the "i"th row. The selection driver 12 applies the selection signal Ssel of the selected level (high level) to the selection line Ls of the "i"th row. The display pixels PIX in the "i"th row are set to the selected status.

Then, in the respective display pixels PIX of the "i"th row, the respective transistors Tr11 are turned ON and the respective driving transistors Tr13 are in a diode-connected status. As a result, the power source voltage Vcc(=Vccw) is applied to the drain terminal and the gate terminal driving transistor Tr13 (contact point N11; one end of the capacitor Cs). The transistor Tr12 is also turned ON and the source terminal of the transistor Tr13 (contact point N12; the other end of the capacitor Cs) is electrically connected to the data lines Ld of the respective columns.

In synchronization with this timing, the controller 15 supplies a data control signal. As shown in FIG. 13, the data driver 14 turns the changing-over switch SW1 to OFF and turns the changing-over switches SW2, SW3 and SW4 to ON as shown in FIG. 13. As a result, the predetermined precharge voltage Vpre is applied to the respective capacitors Cs via the respective data lines Ld.

During the application of the precharge voltage Vpre, the maximum value of the threshold voltage of the driving transistor Tr13 after the variation in the element characteristic is a sum of the initial threshold voltage Vth0 and the maximum value ΔVth_max of the variation value ΔVth of the threshold voltage. The maximum value of the drain-source voltage of the transistor Tr12 is a sum of the initial drain-source voltage Vds12 and the maximum value ΔVds12_max of the variation value ΔVds12 of the drain-source voltage Vds12 due to increased resistance of the transistor Tr12. A voltage drop due to the selection transistor Tr12 shown in FIG. 14 and the wiring resistance from the power source voltage line Lv to the data line Ld, except for the selection transistor Tr12, is Vvd. The precharge voltage Vpre is set to satisfy formula (12). The potential difference (Vccw−Vpre) shown at the left-hand side of formula (12) is a voltage applied to the selection transistor Tr12 and the driving transistor Tr13.

$$Vccw-Vpre \geqq (Vth0+\Delta Vth_\max)+(Vds12+\Delta Vds12_\max)+Vvd \quad (12)$$

The selection signal Ssel output to the selection line Ls is a positive voltage during the compensation period Tdet and is a negative voltage during periods other than the compensation period Tdet. Then, a voltage applied to the gate terminal of the transistor Tr12 is not significantly close to the positive voltage. Thus, the maximum value ΔVds12_max of the variation value ΔVds12 the drain-source voltage is so small that the maximum value ΔVds 12_max can be ignored when compared with the maximum value ΔVth_max of the variation value ΔVth of the threshold voltage of the driving transistor Tr13. Thus, formula (12) can be replaced by formula (12a).

$$Vccw-Vpre \geqq (Vth0+\Delta Vth_\max)+Vds12+Vvd \quad (12a)$$

Specifically, a voltage depending on the value of the precharge voltage Vpre is applied between both ends of the capacitor Cs (the gate and the source of the transistor Tr13). The voltage applied to the capacitor Cs is higher than the threshold voltage Vth after the variation in the element characteristic of the driving transistor Tr13. Thus, as shown in FIG. 14, the driving transistor Tr13 is turned ON to allow flow of the precharge current Ipre depending on this voltage between the drain and the source of the transistor Tr13. Both ends of the capacitor Cs immediately accumulate the charge based on this precharge current Ipre (voltage based on the precharge voltage Vpre).

The pixel driving apparatus DC of display pixel PIX has a structure shown in FIG. 10. In order to allow flow of the precharge current Ipre from the data line Ld in the data driver direction, the precharge voltage Vpre is set to have a negative potential to the power source voltage Vccw of the writing operation level (low level) (Vpre<Vccw≦0).

In the precharge operation, it is assumed that a signal applied to the source terminal of the transistor Tr13 is a current signal. In this case, it may be problematic if the wiring capacity and wiring resistance of the data line Ld and/or the capacity component included in the pixel driving apparatus DC delay a change in a potential (charging voltage) in the capacitor Cs. However, the precharge voltage Vpre applied in the first embodiment is a voltage signal and thus the voltage can quickly charge the capacitor Cs during the initial precharge period Tpre. Then, as shown in FIG. 13, the charging voltage of the capacitor Cs is rapidly close to the precharge voltage Vpre and can subsequently gradually converge to the precharge voltage Vpre within the remaining period of the precharge period Tpre.

During the precharge period Tpre, the voltage of the precharge voltage Vpre applied to the anode terminal of the organic EL element OLED (contact point N12) is set to be lower than the reference voltage Vss applied to the cathode terminal TMc. The power source voltage Vccw is set to be equal to or less than the reference voltage Vss. Thus, the organic EL element OLED is not in a positive bias status and has no current therein. During the precharge period Tpre, the organic EL element OLED does not emit light.

Figure 15:
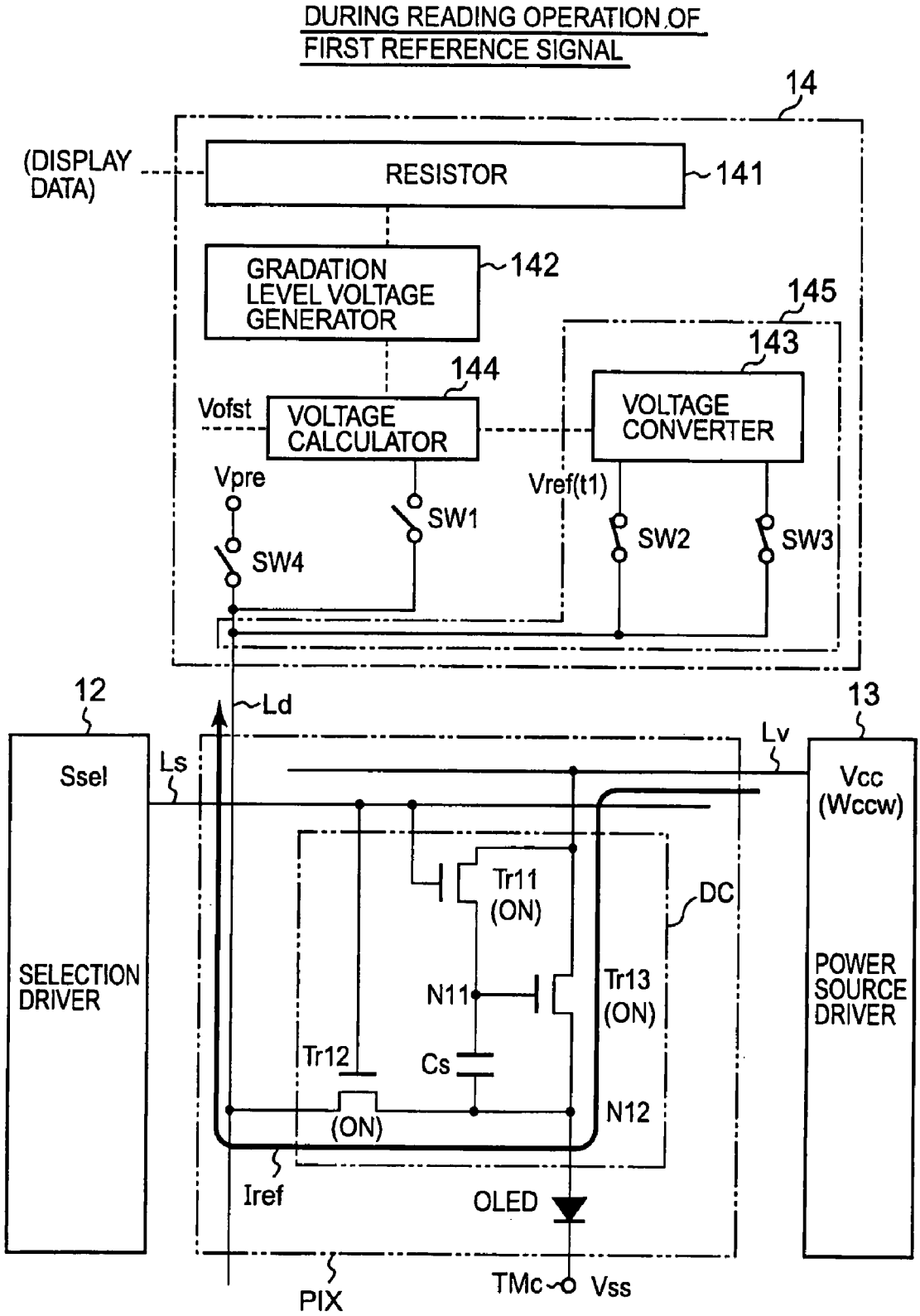
FIG. 15 illustrates the operation status of the data driver and the display pixel in the reading operation of the first reference voltage.

During the transient response period Ttrs after the precharge period Tpre (natural relaxation period), the data driver 14 maintains the changing-over switch SW1 in an OFF status and maintains the changing-over switches SW2 and SW3 in an ON status as shown in FIG. 13. As also shown in FIG. 13, the data driver 14 switches the changing-over switch SW4 from ON to OFF. This blocks the application of the precharge voltage Vpre to the data line Ld and the display pixels PIX in the "i"th row in the selected status (pixel driving circuit DC). Then, as shown in FIG. 15, the transistors Tr11 and Tr12 maintain an ON status. An electric connection between the pixel driving circuit DC and the data line Ld is maintained but an application of the voltage to the data line Ld is blocked. Thus, the other terminal side of the capacitor Cs (contact point N12) has a high impedance.

The gate and the source of the transistor Tr13 (both ends of the capacitor Cs) have therebetween, by the above-described precharge operation, a potential difference that is equal to or higher than the threshold voltage after the variation of the transistor Tr13 (Vth0+ΔVth_max). As shown in FIG. 15, the transistor Tr13 maintains an ON status and a transient current Iref flows from the power source voltage line Lv via the transistor Tr13. As shown in FIG. 13, during the transient response period Ttrs (natural relaxation period), the source terminal side of the transistor Tr13 (contact point N12; the other end of the capacitor Cs) has a gradually-increasing potential toward the potential of the drain terminal side (power source voltage line Lv side). Accordingly, the data line Ld electrically connected via the transistor Tr12 also has a gradually-increasing potential.

During the transient response period Ttrs, a part of the charge accumulated in the capacitor Cs is discharged. As a result, the gate-source voltage Vgs of the transistor Tr13 declines. The potential of the data line Ld changes from the precharge voltage Vpre to converge to the threshold voltage after the variation in the transistor Tr13 (Vth0+ΔVth). If the transient response period Ttrs is too long, the potential difference (Vccw−V(t)) changes to converge to (Vth0+ΔVth). The function "V(t)" represents a potential in the data line Ld changing with the time "t" and equals, as shown in FIG. 13, the precharge voltage Vpre when the precharge period Tpre is completed. When the transient response period Ttrs is too long however, the selection period Tsel increases and thus the display characteristic (a video display characteristic in particular) significantly deteriorates.

To prevent this, in the first embodiment of the invention, the transient response period Ttrs is set so that the gate-source voltage Vgs of the transistor Tr13 is shorter than a period during which the potential converges to the threshold voltage after the variation (Vth+ΔVth). The transient response period Ttrs is suitably set so that the pixel driving circuit DC can perform the precharge operation and the writing operation during the selection period Tsel. Specifically, a timing at which the transient response period Ttrs is completed (the second read timing) is set to a specific timing in a status in which the gate-source voltage Vgs of the transistor Tr13 is changing. The organic EL element OLED does not emit light even during the transient response period Ttrs because a value of a voltage applied to the contact point N12 at the anode terminal side of the organic EL element OLED is lower than the reference voltage Vss applied to the cathode terminal TMc and thus a positive bias status is not provided.

The reference voltage reading operation will now be described. The display apparatus 1 performs this operation a plurality of times during the transient response period Ttrs. This reference voltage reading operation is identical with the operation shown in FIG. 13. Specifically, at the first read timing t1, the voltage converter 143 reads the potential of the data line Ld (the first reference voltage Vref(t1)) connected thereto via the changing-over switch SW2 shown in FIG. 15. The first read timing t1 may be an arbitrary timing during the transient response period Ttrs so long as the timing is other than a timing at which the transient response period Ttrs is completed.

Figure 16:
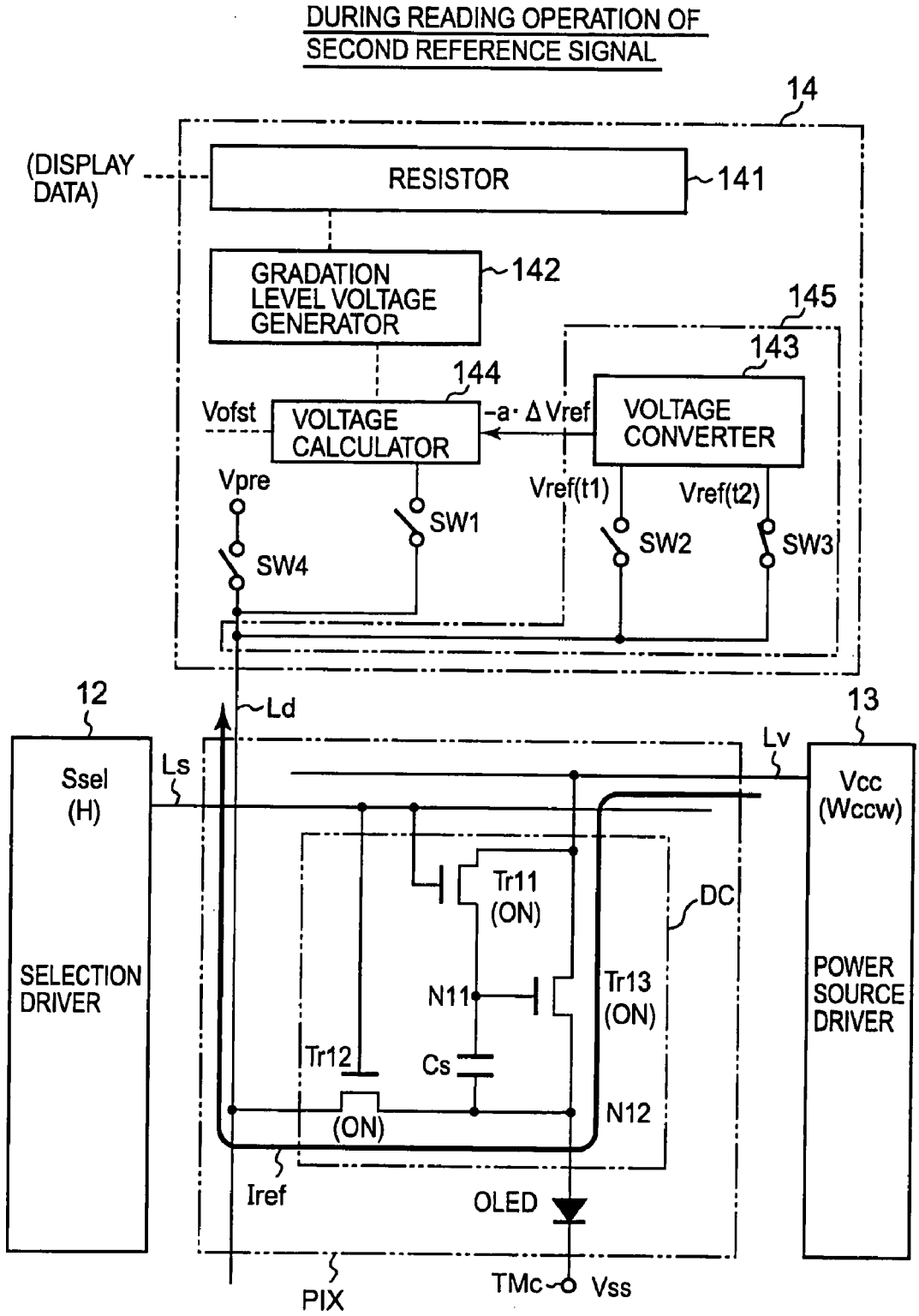
FIG. 16 illustrates the operation status of the data driver and the display pixel in the reading operation of the second reference voltage.

After the reading of the first reference voltage Vref(t1), the voltage reader 145 turns the changing-over switch SW2 to OFF as shown in FIG. 16. Next, the voltage converter 143 turns the changing-over switch SW3 to ON at the second read timing t2 to read, via the data line Ld, the charging voltage of the capacitor (the second reference voltage Vref(t2)). In the first embodiment, the second read timing t2 is a timing at which the transient response period Ttrs is completed. Specifically, the transient response period Ttrs shown in FIG. 13 is equal to (the second read timing t2)−(transient response start timing t0). The second read timing t2 is not limited to a timing at which the transient response period Ttrs is completed and also may be an arbitrary timing during the transient response period Ttrs that is different from the first read timing t1.

As shown in FIGS. 15 and 16, the data line Ld is connected to the source terminal (contact point N12) of the driving transistor Tr13 via the selection transistor Tr12 set to an ON status. The first reference voltage Vref(t1) and the second reference voltage Vref(t2) read by the voltage converter 143 is a function of the time "t" and is determined based on a voltage corresponding to the gate-source voltage Vgs of the transistor Tr13.

During the transient response period Ttrs, this voltage Vgs is different depending on the threshold voltage Vth of the transistor Tr13 or the threshold voltage after the variation (Vth0+ΔVth). Thus, the threshold voltage Vth or the threshold voltage after the variation (Vth0+ΔVth) can be substantially identified based on the change in the gate-source voltage Vgs. With an increase of a variation amount ΔVth of the threshold voltage, a ratio of the change in the gate-source voltage Vgs declines.

In the transistor Tr13, the variation amount ΔVth increases with an increase of the threshold voltage Vth. As a result, a difference voltage value obtained by deducting the first reference voltage Vref(t1) from the second reference voltage Vref(t2) (ΔVref(=Vref(t2)−Vref(t1); hereinafter referred to as "difference voltage") declines. Based on the first reference voltage Vref(t1) and the second reference voltage Vref(t2), the threshold voltage Vth or the threshold voltage after the variation (Vth0+ΔVth) of the transistor Tr13 can be identified.

The first reference voltage Vref(t1) can be represented by the formula (13a) and the second reference voltage Vref(t2) can be represented by the formula (13b). The function Vgs(t1) shown in the formula (13a) represents a gate-source voltage of the transistor Tr13 at the first read timing t1 and the function Vgs(t2) shown in the formula (13b) represents a gate-source voltage at the second read timing t2. Variable "VR" represents a sum of the voltage drop Vds12 due to the source-drain resistance of the transistor Tr12 and a voltage drop due to the wiring resistance Vvd.

$$Vccw-Vref(t1)=Vgs(t1)+VR \quad (13a)$$

$$Vccw-Vref(t2)=Vgs(t2)+VR \quad (13b)$$

Specifically, during a period from an arbitrary timing (t1) during the transient response period Ttrs to a timing (t2) at which the transient response period Ttrs is completed, a potential change in the data line Ld (Vref(t2)−Vref(t1)) depends on a change in the gate-source voltage of transistor Tr13 (Vgs(t2)−Vgs(t1)). The threshold voltage Vth of the transistor Tr13 is identified based on this change amount.

The voltage converter 143 retains the read first reference voltage Vref(t1) and the second reference voltage Vref(t2) via a buffer to subsequently calculate the above-described difference voltage ΔVref. The voltage converter 143 also inversely amplifies the difference voltage ΔVref to convert the voltage level to output the result as "the first compensation voltage a·ΔVref". The reference voltage reading operation is then completed and the pixel driving circuit DC performs an operation for writing display data.

Figure 17:
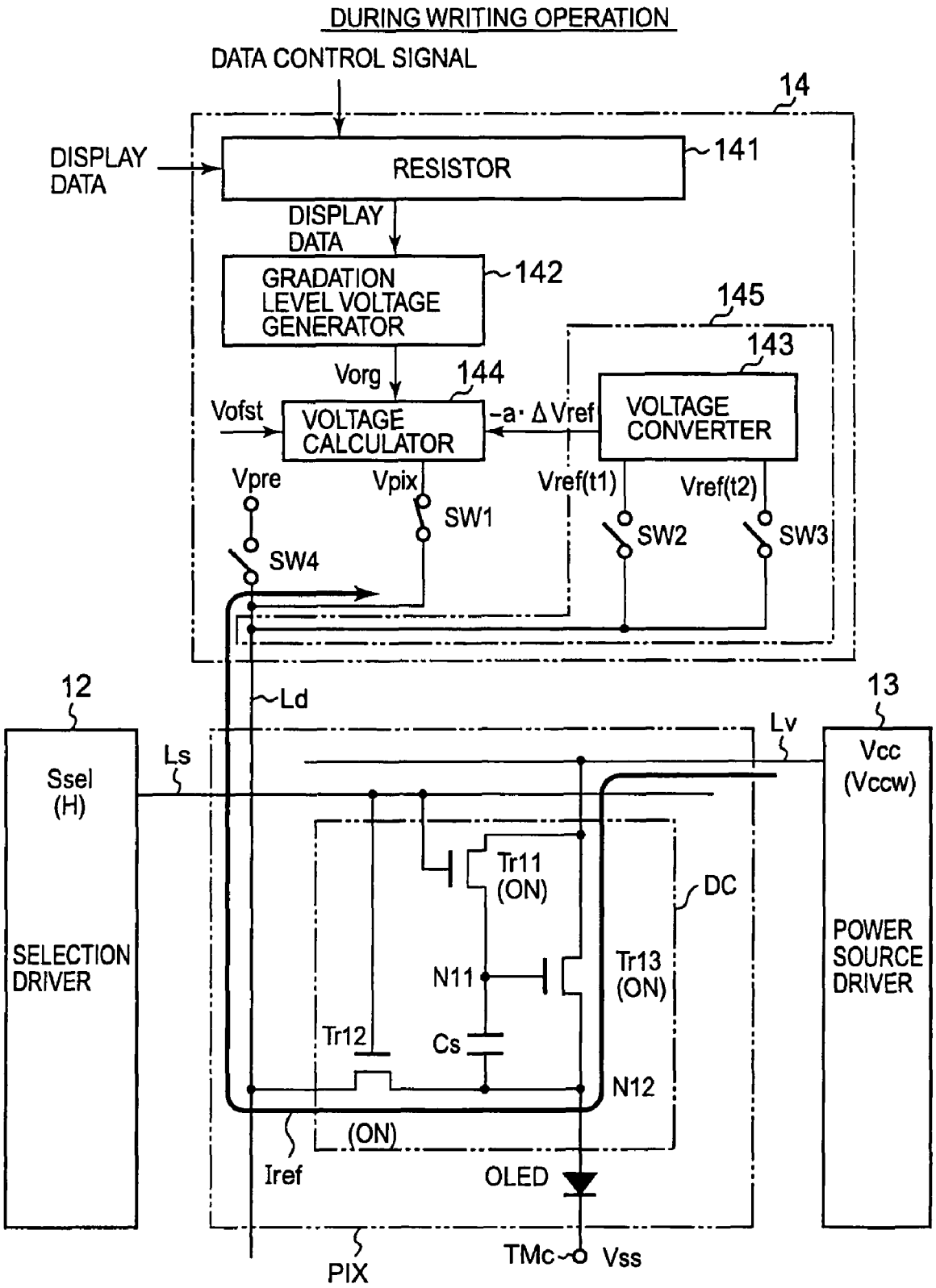
FIG. 17 illustrates the operation status of the data driver and the display pixel in the writing operation of the display apparatus.

This writing operation will now be described. During the writing operation, the controller 15 supplies a data control signal to the changing-over switches SW1, SW2, SW3 and SW4 included in the voltage reader 145 shown in FIG. 10. As a result, as shown in FIG. 17, the changing-over switch SW1 is turned ON and the changing-over switches SW2, SW3 and SW4 are turned OFF. This provides an electric connection between the data line Ld and the voltage calculator 144. The power source driver 13 outputs the first power source voltage Vccw for a writing operation.

Next, display data from the display signal generation circuit 16 shown in FIG. 9 is transferred, via the resistor 141, to the gradation level voltage generators 142 provided in the respective columns (the respective data lines Ld). The gradation level voltage generator 142 acquires, from the transferred display data, gradation level values of the display pixel PIX (display pixel PIX set to a selected status) to be subjected to the writing operation. Then, the gradation level voltage generator 142 determines whether the gradation level values have the 0th gradation level.

When the gradation level values have the 0th gradation level, the gradation level voltage generator 142 outputs to the voltage calculator 144, a predetermined gradation level voltage (a gradation level voltage) Vzero for causing the organic EL element OLED to perform a no-light-emitting operation (or a black display operation). This black gradation level voltage Vzero is applied to the data line Ld via the changing-over switch SW1 shown in FIG. 17 Then, the voltage calculator 144 does not perform a compensation processing based on the difference voltage ΔVref (compensation processing for compensating the variation of the threshold voltage Vth of the transistor Tr13). The black gradation level voltage Vzero is set to (−Vzero<Vth−Vccw). Then, the diode-connected transistor Tr13 has the gate-source voltage Vgs(≈Vccw−Vzero) lower than the threshold voltage Vth or the threshold voltage after the variation (Vth0+ΔVth) to result in Vgs<Vth. The black gradation level voltage Vzero suppresses the variation of the respective threshold voltages of the transistors Tr12 and Tr13 and thus Vzero=Vccw is preferably established.

On the other hand, when the gradation level values does not have the 0th gradation level, the gradation level voltage generator 142 generates the original gradation level voltage Vorg having a voltage value suitable for the gradation level values to output the original gradation level voltage Vorg to the voltage calculator 144. The voltage calculator 144 uses the first compensation voltage a·ΔVref shown in FIG. 17 output from the voltage converter 143 to compensate this original gradation level voltage Vorg so as to have a voltage value suitable for the variation of the threshold voltage Vth of the transistor Tr13.

Then, the voltage calculator 144 calculates the compensated gradation level voltage Vpix so that the original gradation level voltage Vorg, the first compensation voltage a·ΔVref, and the second compensation voltage Vofst satisfy the formula (11). The second compensation voltage Vofst is calculated based on a variation characteristic of the threshold voltage Vth of the transistor Tr13 (a relationship between the threshold voltage Vth and the difference voltage ΔVref to the reference voltage) for example. The original gradation level voltage Vorg is a positive voltage having an increasing potential with an increase of the gradation level of the display data.

The voltage calculator 144 applies the generated compensated gradation level voltage Vpix to the data line Ld via the changing-over switch SW1. The coefficient "a" of the first compensation voltage a·ΔVref is a positive value while the second compensation voltage Vofst is a positive value depending on the design of the transistor Tr13 (−Vofst<0). The compensated gradation level voltage Vpix is set to have a relatively negative potential based on the power source voltage Vcc of a writing operation level (=Vccw≦reference voltage Vss) as reference. Thus, the compensated gradation level voltage Vpix decreases toward a negative potential with an increase of a gradation level (and the voltage signal has an increasing amplitude).

The source terminal (contact point N12) of the transistor Tr13 included in the display pixel PIX set to the selected status is applied, based on the compensation voltage (a·ΔVref+Vofst) depending on the threshold voltage Vth or the threshold voltage after the variation (Vth0+ΔVth) of the transistor Tr13, with the compensated gradation level voltage Vpix for which the original gradation level voltage Vorg is compensated. Thus, the voltage Vgs depending on the compensated gradation level voltage Vpix is applied between the gate and the source of the transistor Tr13 (both ends of the capacitor Cs). In the writing operation as described above, instead of flowing current suitable for display data in the gate terminal and the source terminal of the transistor Tr13 to set a voltage, a desired voltage is directly applied to the gate terminal and the source terminal. Potentials of the respective terminals and contact points can therefore be quickly set to a desired status.

During the writing period Twrt, the compensated gradation level voltage Vpix applied to the anode terminal of the organic EL element OLED is set to be lower than the reference voltage Vss applied to the cathode terminal TMc. Thus, the organic EL element OLED is in a reverse bias status and does not emit light. Then, the writing operation is completed and the display apparatus 1 performs a retention operation.

Figure 18:
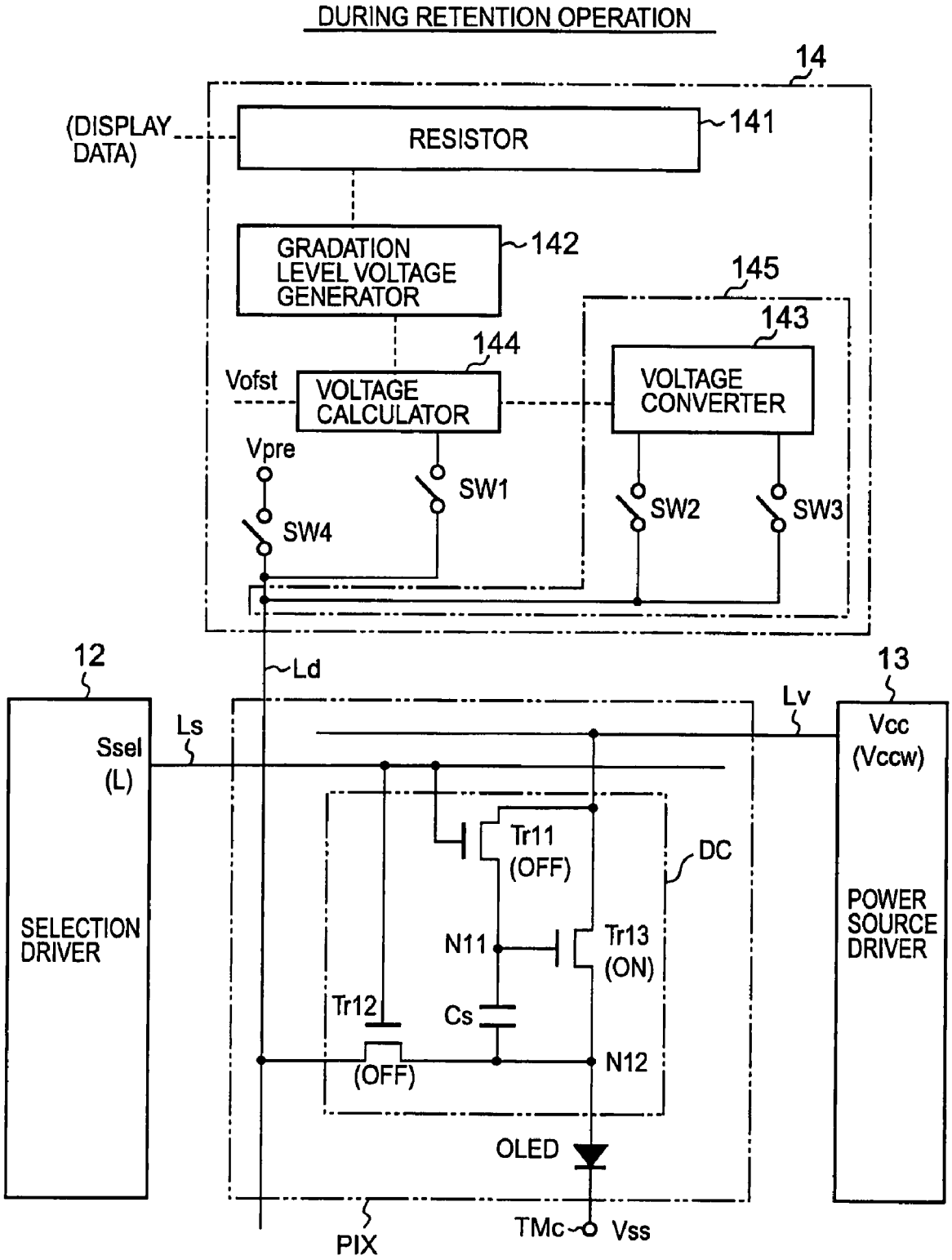
FIG. 18 illustrates the operation status of the data driver and the display pixel in the retention operation of the display apparatus.

The retention operation will now be described. As shown in FIG. 12, during the retention period Thld, the selection driver 12 applies the selection signal Ssel of a not-selected level (low level) to the selection line Ls of the "i"th row. As a result, the retention transistor Tr11 is turned OFF as shown in FIG. 18 to cancel the diode-connected status of the driving transistor Tr13. The selection signal Ssel of the not-selected level also turns OFF the selection transistor Tr12 shown in FIG. 18 to block an electric connection between the source terminal of the transistor Tr13 (contact point N12) and the data line Ld. Then, a voltage for which the threshold voltage Vth or the threshold voltage after the variation (Vth0+ΔVth) is compensated is retained between the gate and the source of the transistor Tr13 of the "i"th row (both ends of the capacitor Cs).

Figure 25:
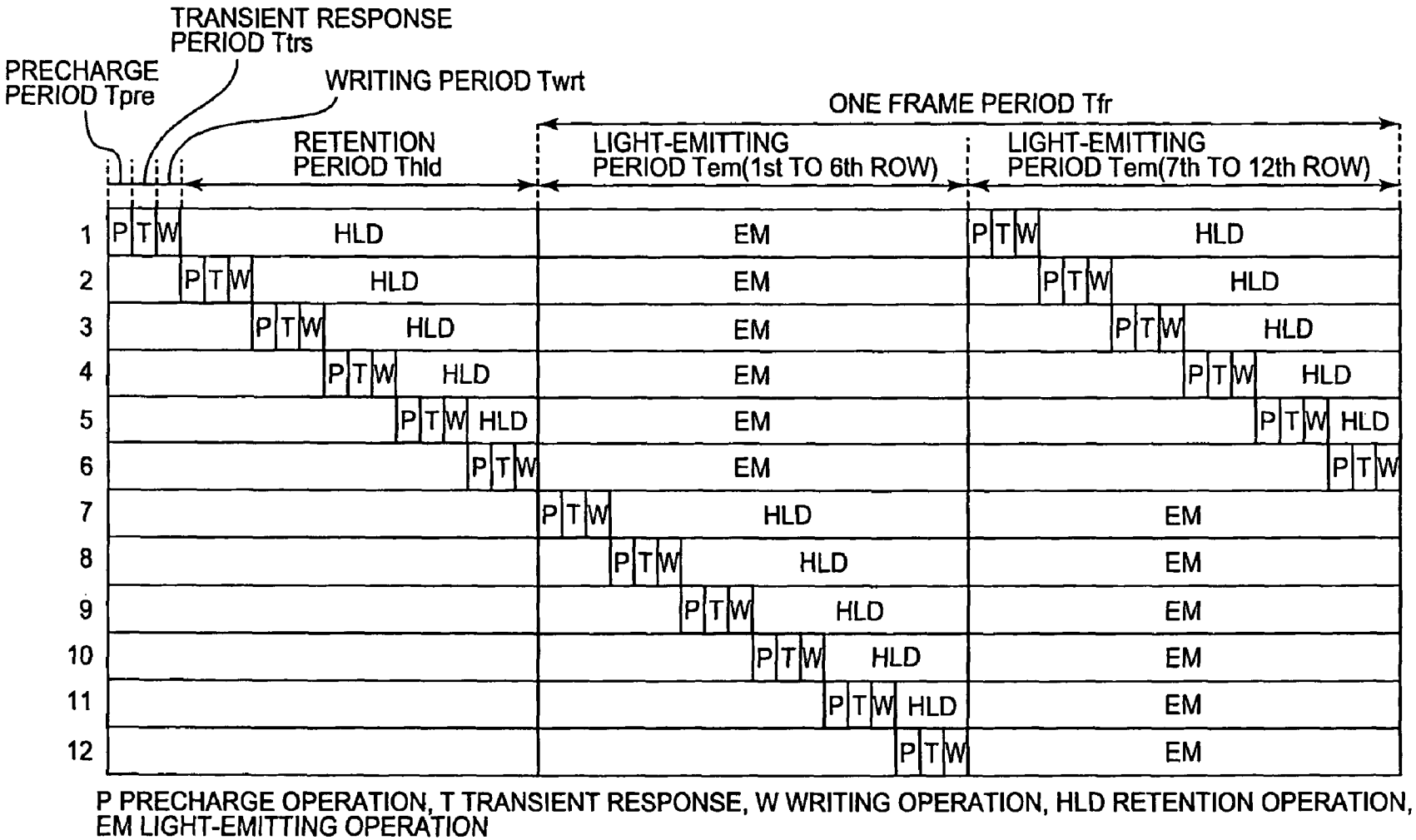
FIG. 25 illustrates operation timing in a method for driving a display apparatus including a display zone of the first embodiment.

As shown in FIG. 12, during the retention period Thld, the selection driver 12 applies the selection signal Ssel of the selected level (high level) to the selection line Ls of the (i+1)th row. As a result, the display pixel PIX of the (i+1)th row is set to the selected status. Thereafter, until the selection period Tsel of the final row for a single group is completed, the respective rows are subjected to the above-described compensated gradation level voltage setting operation and writing operation. Then, the selection driver 12 applies, with different timings, the selection signal Ssel of the selected level to the selection lines Ls of the respective rows. As shown in FIG. 25, the display pixels PIX of the respective rows for which the compensated gradation level voltage setting operation and the writing operation are already completed, continuously perform the retention operation until the display pixels PIX of all rows are written with the compensated gradation level voltage Vpix (a voltage depending on the display data).

This retention operation is performed between the writing operation and the light-emitting operation when all display pixels PIX in the respective groups are driven and controlled to emit light simultaneously for example. In this case, as shown in FIG. 25, the retention periods Thld are different for the respective rows. In the example of FIG. 18, the changing-over switches SW1, SW2, SW3 and SW4 are all OFF. However, as shown in FIG. 12, when the display pixels PIX in the "i"th row perform a retention operation (the retention period Thld of the "i"th row), the display pixels PIX after the (i+1)th row simultaneously perform the compensated gradation level voltage setting operation and the writing operation. Thus, switching of the respective changing-over switches SW1, SW2, SW3 and SW4 is individually controlled at a predetermined timing during every selection period Tsel of the display pixels PIX of the respective rows. Then, the retention operation is completed and the display pixels PIX perform the light-emitting operation.

Figure 19:
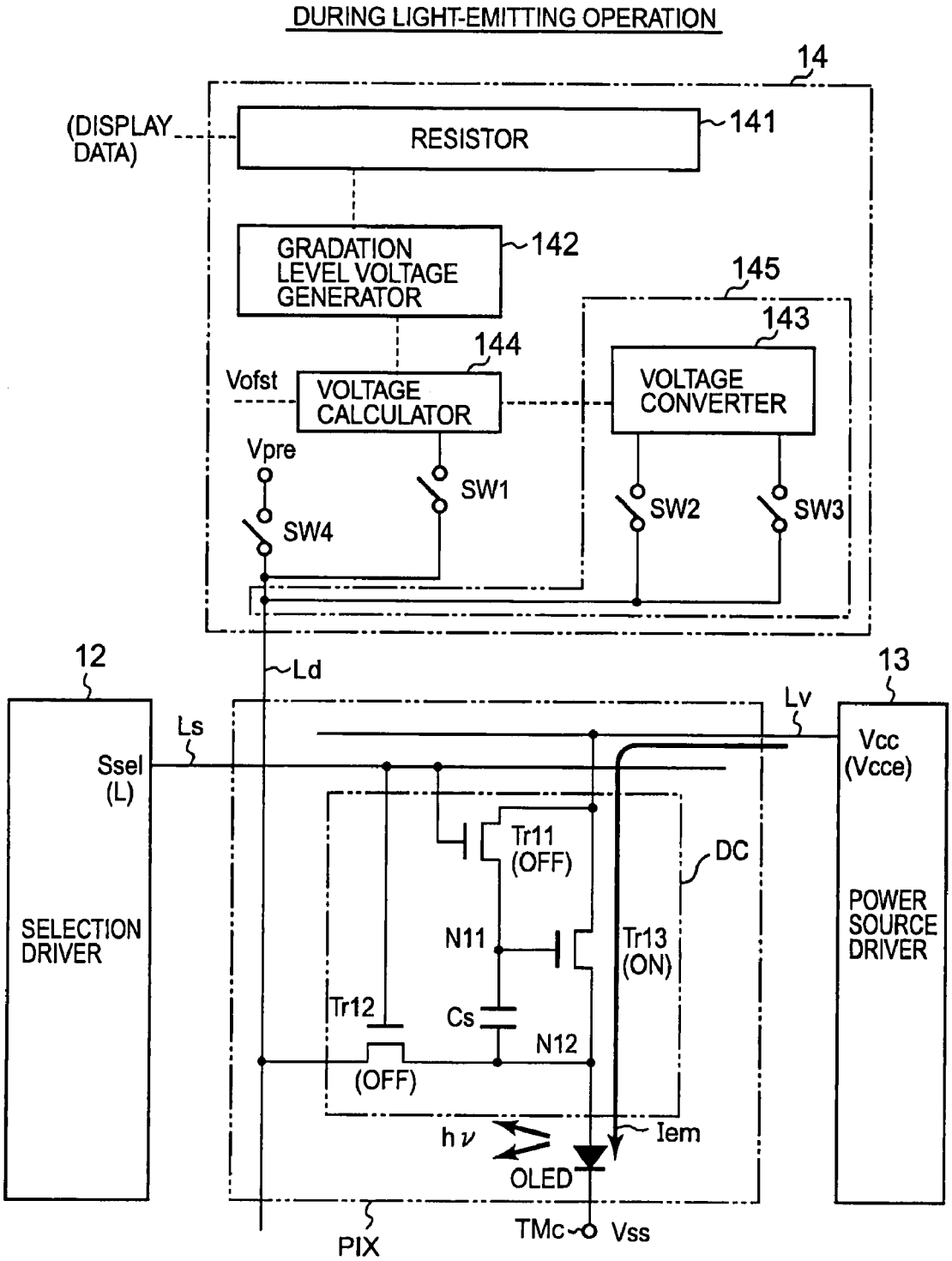
FIG. 19 illustrates the operation status of the data driver and the display pixel in the light-emitting operation of the display apparatus.

The light-emitting operation will now be described. As shown in FIG. 12, during the light-emitting operation (light-emitting period Tem), the selection driver 12 applies the selection signal Ssel of the not-selected level (low level) to the selection lines Ls of the respective rows (e.g., the "i"th row and the (i+1)th row). As shown in FIG. 19, the power source driver 13 applies, to the power source voltage line Lv, the power source voltage Vcc of the light-emitting operation level (the second power source voltage Vcce). This second power source voltage Vcce is a positive voltage having a higher potential than that of the reference voltage Vss (Vcce>Vss).

The second power source voltage Vcce is set so that the potential difference (Vcce−Vss) is higher than a sum of the saturated voltage of the transistor Tr13 (pinch-off voltage Vpo) and the driving voltage Voled of the organic EL element OLED. Thus, as shown in FIGS. 7 and 8, the transistor Tr13 operates in a saturated zone. The anode of the organic EL element OLED (contact point N12) is applied with a positive voltage depending on the voltage written by the writing operation between the gate and the source of the transistor Tr13 (Vccw−Vpix). On the other hand, the cathode terminal TMc is applied with the reference voltage Vss (e.g., ground potential) and thus the organic EL element OLED is in a reverse bias status.

As shown in FIG. 19, the power source voltage line Lv flows the light emission driving current Iem via the transistor Tr13 into the organic EL element OLED. This light emission driving current Iem has a current value depending on the compensated gradation level voltage Vpix. Thus, the organic EL element emits light having a desired brightness of the gradation level. The organic EL element OLED continues a light-emitting operation in the next cycle period Tcyc until the power source driver 13 starts the application of the power source voltage Vcc of the writing operation level (=Vccw).

(Method for Driving Display Apparatus)

Figure 20:
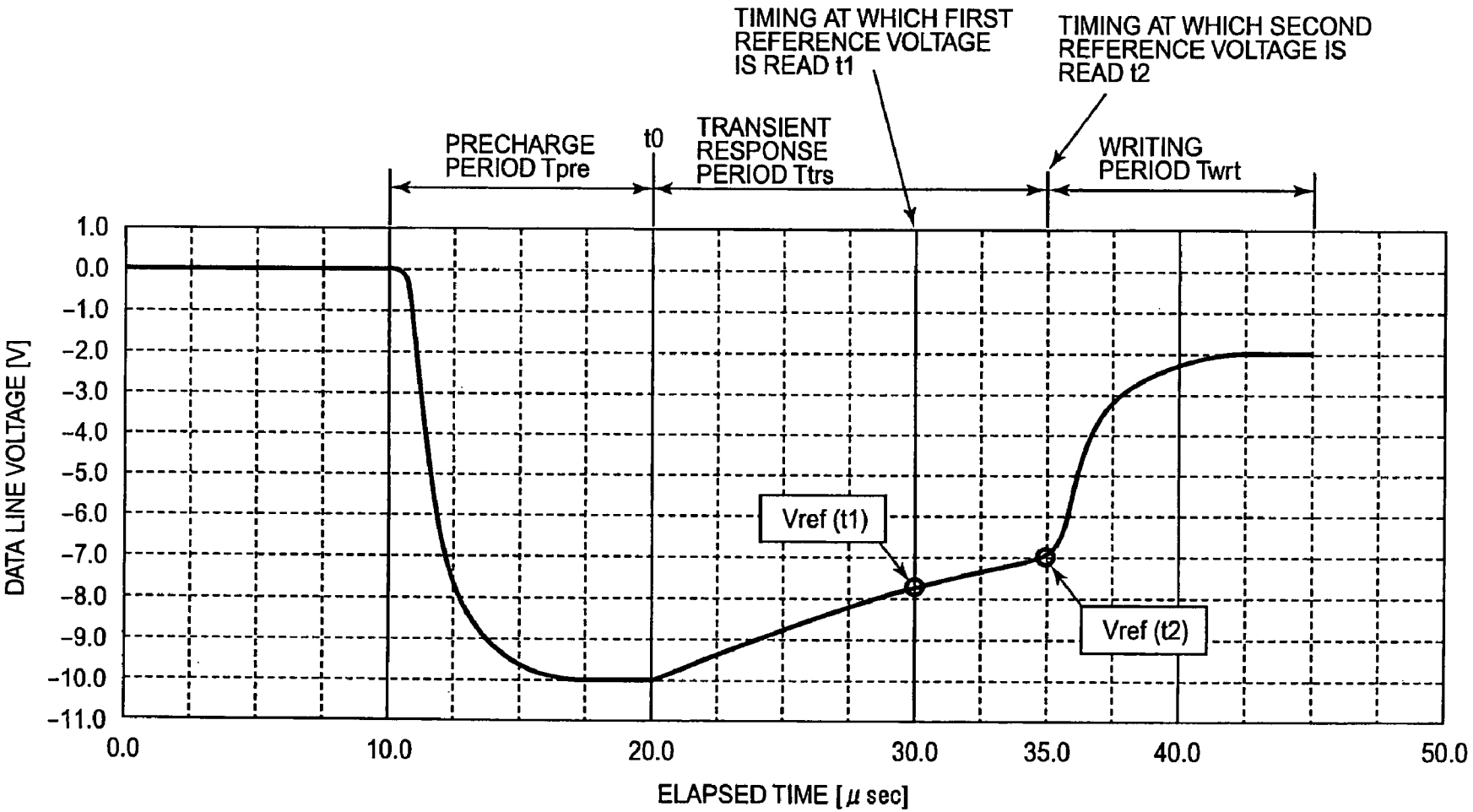
FIG. 20 shows an example of a voltage applied to the data line in the selection period.

A method for driving the above-described display apparatus 1 will now be described. FIG. 20 shows a voltage change in the data line Ld. In this case, the respective transistors of the pixel driving circuit DC are an amorphous silicon transistor. The voltage and the power source voltage Vcc of the data line Ld are set so that current flowing in the pixel driving circuit DC is drawn into the data driver 14. The precharge voltage Vpre is set to −10 V. The selection period Ttrs is set to 35 μsec, the precharge period Tpre is set to 10 μsec, the transient response period Ttrs is set to 15 μsec, and the writing period Twrt is set to 10 μsec, respectively. This selection period Ttrs=35 μsec corresponds to a selection period allocated to the respective scanning lines when the display zone 11 has 480 scanning lines (selection lines) and the frame rate is 60 fps.

In the driving control operation of the display apparatus 1, the precharge operation, the reference voltage reading operation, and the writing operation are sequentially performed during the selection period Tsel.

In the precharge operation, the data driver 14 turns the changing-over switch SW4 to ON. As a result, the data line Ld is applied with the precharge voltage Vpre of a negative voltage (−10 V). Then, the data line voltage sharply declines as shown in FIG. 20. Thereafter, the data line voltage gradually converges to the precharge voltage Vpre in accordance with the wiring capacity of the data line Ld and a time constant due to the wiring resistance. In view of this change in the data line voltage, the gate-source voltage Vgs corresponding to the precharge voltage Vpre is applied between the gate and the source of the transistor Tr13 in a row set to the selected status.

Thereafter, at the transient response start timing t0, the data driver 14 turns the changing-over switch SW4 to OFF. This blocks the application of the precharge voltage Vpre to the data line Ld and the impedance is increased. However, the gate-source voltage Vgs is retained between the gate and the source of the transistor Tr13 due to the charging voltage of the capacitor Cs. Thus, the transistor Tr13 maintains the ON status and the transient current Ids flows between the drain and the source of the transistor Tr13.

While the transient current Ids flowing therebetween, the potential of the drain-source voltage Vds declines and the potential of the gate-source voltage Vgs equal to that of the voltage Vds also declines. Then, the voltage Vgs changes toward the threshold voltage Vth or the threshold voltage after the variation (Vth0+ΔVth) of the transistor Tr13. The potential of the source terminal of the transistor Tr13 (contact point N12) gradually increases as time passes.

In the driving control operation of the first embodiment, current flowing in the display pixel (pixel driving circuit) is drawn from the data line Ld into the data driver 14. The data line Ld is thus set to have a negative voltage lower than that of the power source voltage Vcc. In this case, the higher gate-source voltage Vgs the transistor Tr13 has, the higher threshold voltage Vth or threshold voltage after the variation (Vth0+ΔVth) the transistor Tr13 has, as shown in FIG. 20.

In the transient response status, the gate-source voltage Vgs of the transistor Tr13 increases, as time passes, toward the threshold voltage Vth or the threshold voltage after the variation (Vth0+ΔVth). Thereafter, this voltage Vgs changes to converge to the threshold voltage Vth as represented by the characteristic lines ST1 and ST2 shown in FIG. 21. The transient response period Ttrs is set to be shorter than a period during which the voltage Vgs converges to the threshold voltage Vth.

Figure 21:
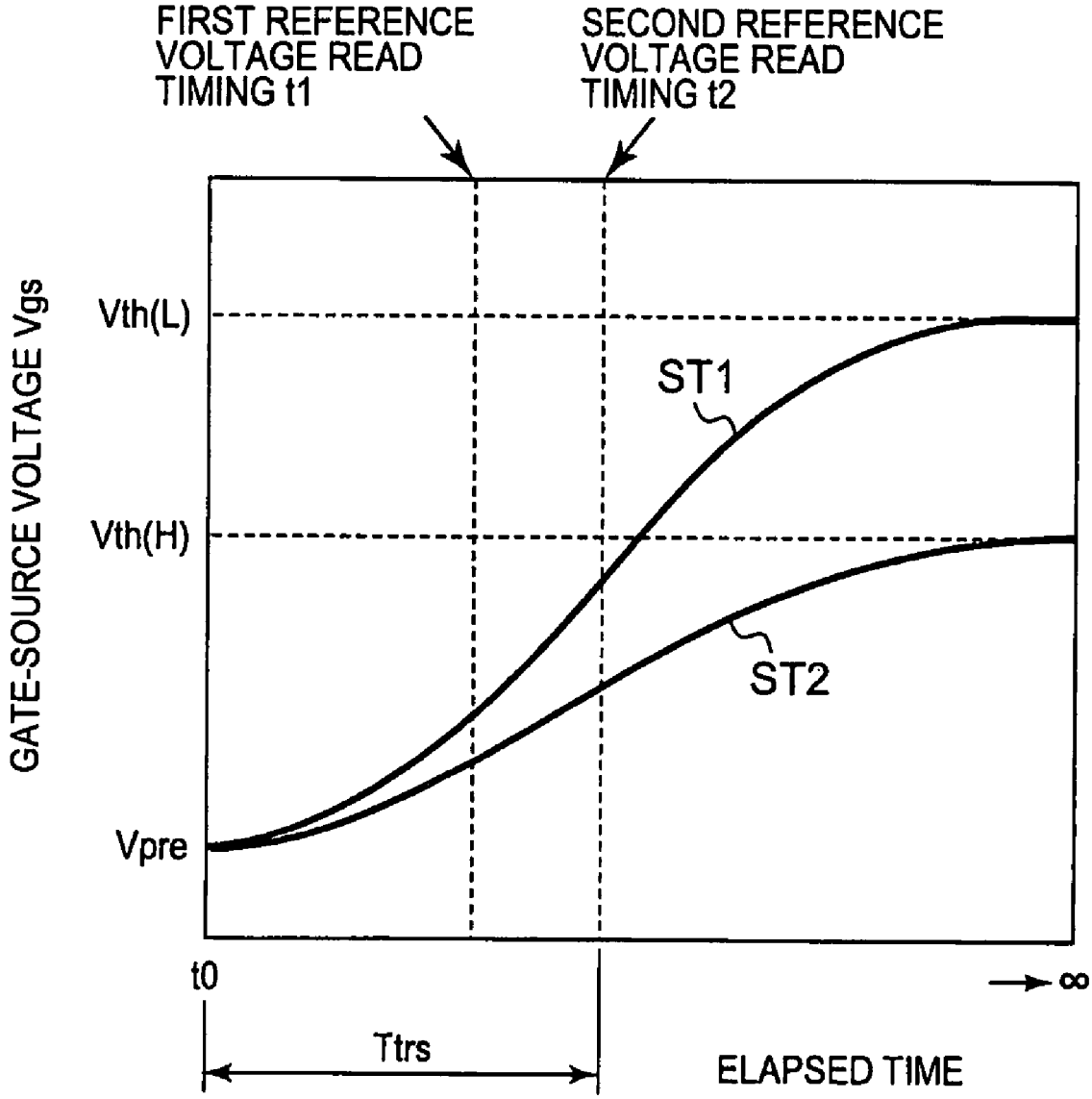
FIG. 21 illustrates a relationship between an elapsed time and a potential change of a source terminal of a driving transistor during a transient response period.

With regard to a change in the data line voltage per hour, an increase in the gate-source voltage Vgs is higher as the threshold voltage Vth has a lower absolute value. As the threshold voltage Vth has a higher absolute value, an increase in the gate-source voltage Vgs is lower. In the case of the threshold voltage Vth(L) close to the initial status, the variation ΔVth is small and thus an increase in the voltage Vgs significantly changes. When the variation ΔVth is large on the other hand, an increase in the voltage Vgs gently changes. In the example of FIG. 21, the characteristic lines ST1 and ST2 are used to detect the first reference voltage Vref(t1) and the second reference voltage Vref(t2). After the detection, changes in the respective characteristic lines ST1 and ST2 can be identified to estimate, based on the changes thereof, the threshold voltages Vth(L) and Vth(H) as a converge voltage. As described above, the first reference voltage Vref(t1) and the second reference voltage Vref(t2) are a function of the transient response period Ttrs and the threshold voltage Vth of the transistor Tr13.

The following section describes a relationship between the threshold voltage of the driving transistor Tr13 and a difference voltage ΔVref between the first reference voltage and the second reference voltage. The following example will assume, as in the example shown in FIG. 20, that the precharge voltage Vpre is −10 V. The transient response period Ttrs is set to 15 μsec, a time from the transient response start timing t0 (a point at which the transient response period Ttrs is started) to the first read timing t1 is set to 10 μsec, and a time from the transient response start timing t0 to the second read timing t2 is set to 15 μsec.

The transistor Tr13 is set to have, as a driving capability, a constant K for calculating the saturated current Ids between the drain and the source (=K×(W/L)×(Vgs−Vth)2) of 7.5×10−9 and a ratio between the channel width W and the length L of 80/6.5. The resistance between the source and the drain of the selection transistor Tr12 is set to 13 MΩ and a pixel content Cs+Cpix as a sum of the capacitor Cs and the pixel parasitic capacitance Cpix is set to 1 pF. The parasitic capacitance Cpara of the data line Ld is set to 10 pF and the wiring resistance Rdata of the data line Ld is set to 10 kΩ.

Figure 22:
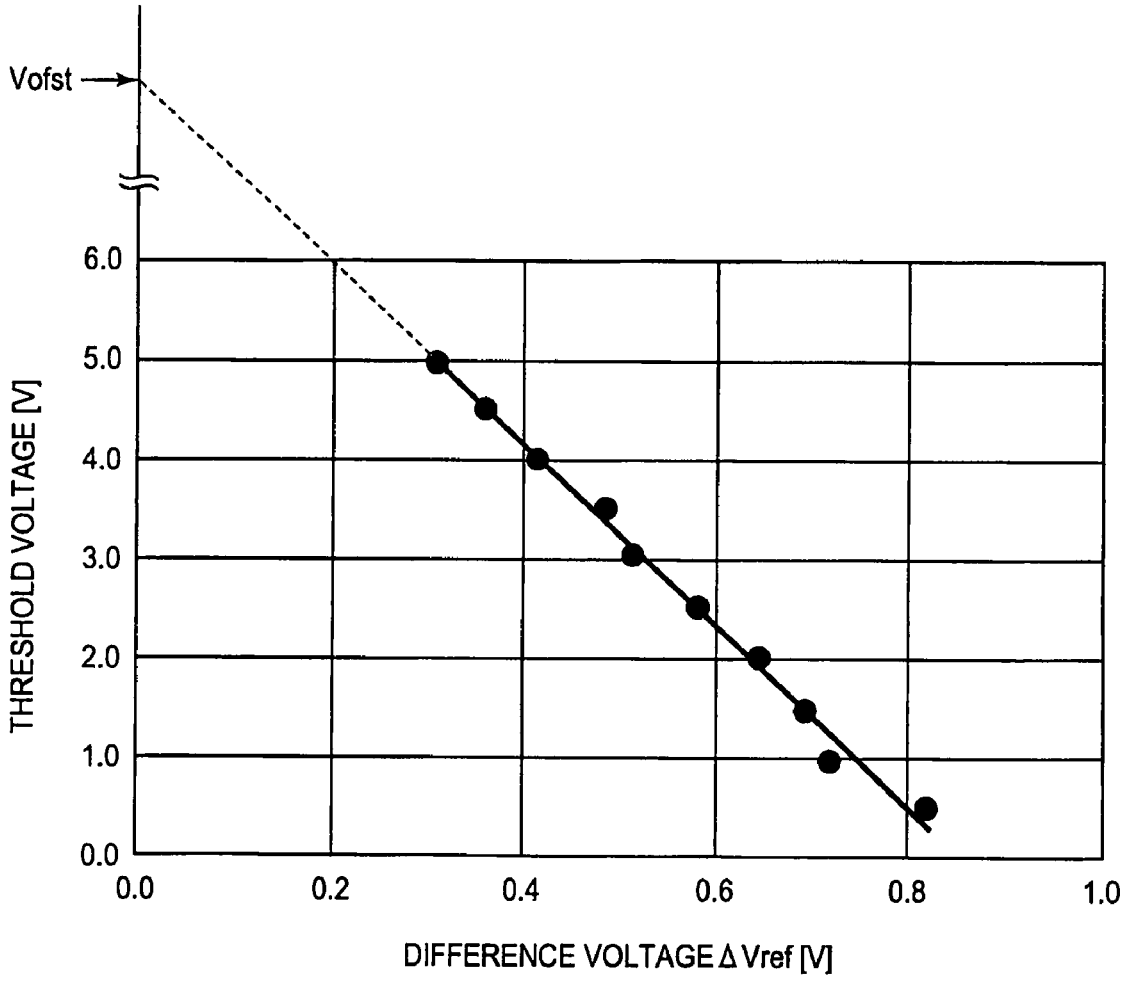
FIG. 22 illustrates a relationship between a threshold voltage of a driving transistor and a difference to a reference voltage.

In this case, the transistor Tr13 has a relationship between the threshold voltage Vth (initial threshold voltage Vth0+threshold voltage change amount ΔVth) and the difference voltage ΔVref of the reference voltage having a characteristic shown in FIG. 22. Specifically, the lower the threshold voltage Vth is, the higher the difference voltage ΔVref is. The higher the threshold voltage Vth is, the lower the difference voltage ΔVref is. This characteristic is substantially linear and thus a relationship between the difference voltage ΔVref and the threshold voltage Vth can be represented by a linear function y=a·x+b as shown by formula (14). This slope "a" is substantially equal to "a" shown in formula (11). In the example of FIG. 22, the value of "a" is approximately 2. Vofst represents the threshold voltage Vth (theoretical value) when the difference voltage ΔVref is 0 that is a unique voltage value set based on verify conditions.

$$Vth=-a\cdot\Delta Vref-Vofst \tag{14}$$

In the writing operation, the data line Ld is applied with the compensated gradation level voltage Vpix. As shown in FIG. 20, the data line voltage sharply increases to subsequently converge toward the compensated gradation level voltage Vpix. Thus, in a row set to the selected status, the gate-source voltage Vgs depending on the compensated gradation level voltage Vpix is retained between the gate and the source of the transistor Tr13 (both ends of the capacitor Cs). The voltage calculator 144 adds and subtracts the original gradation level voltage Vorg, the first compensation voltage a·ΔVref, and the second compensation voltage Vofst to generate this compensated gradation level voltage Vpix. The original gradation level voltage Vorg is set to a voltage value depending on the display data (data for brightness and color) in an initial status. In the initial status, the threshold voltage Vth does not vary. Thus, the compensated gradation level voltage Vpix can be represented by formula (15).

$$Vpix=-|Vorg+Vth| \tag{15}$$

When the formula (15) is substituted into the formula (14), formula (11) is obtained. The voltage calculator 144 can add and subtract the respective voltages based on formula (11) to generate the compensated gradation level voltage Vpix having a value subjected to a compensation processing in accordance with the variation ΔVth of the threshold voltage. When the organic EL element OLED does not emit light, it is preferred that formula (15) is not used and the compensated gradation level voltage Vpix can be set to the power source voltage Vcc (=the second power source voltage Vcce of the light-emitting operation level).

Figure 23:
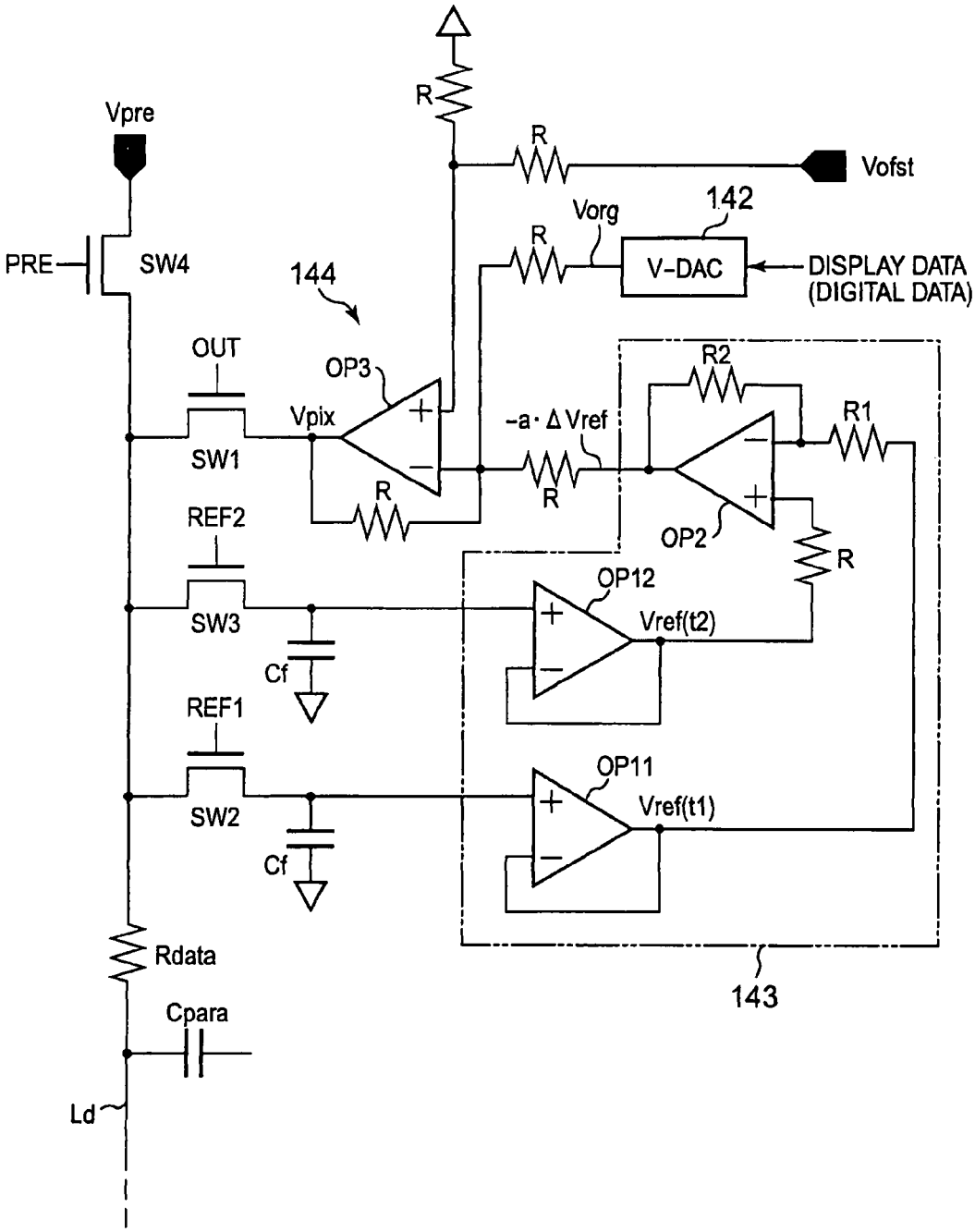
FIG. 23 shows an example of a circuit structure of a data driver.

A specific structure of the data driver 14 for realizing the above-described method for driving a display apparatus will now be described. As shown in FIG. 23, the data driver 14 mainly includes the gradation level voltage generator 142, the voltage converter 143, the voltage calculator 144, and the changing-over switches SW1, SW2, SW3 and SW4. The data line Ld has parasitic capacitance Cpara and wiring resistance Rdata.

The gradation level voltage generator 142 includes a digital-analog voltage converter V-DAC (hereinafter referred to as "DA converter"). In this embodiment, the DA converter V-DAC has a voltage conversion characteristic shown in FIG. 24. The DA converter V-DAC converts data for gradation level (digital signal) supplied from the display signal generation circuit 16 to an analog signal voltage. The converted analog signal voltage is the original gradation level voltage Vorg. The DA converter V-DAC outputs this original gradation level voltage Vorg to the voltage converter 143.

Figure 24:
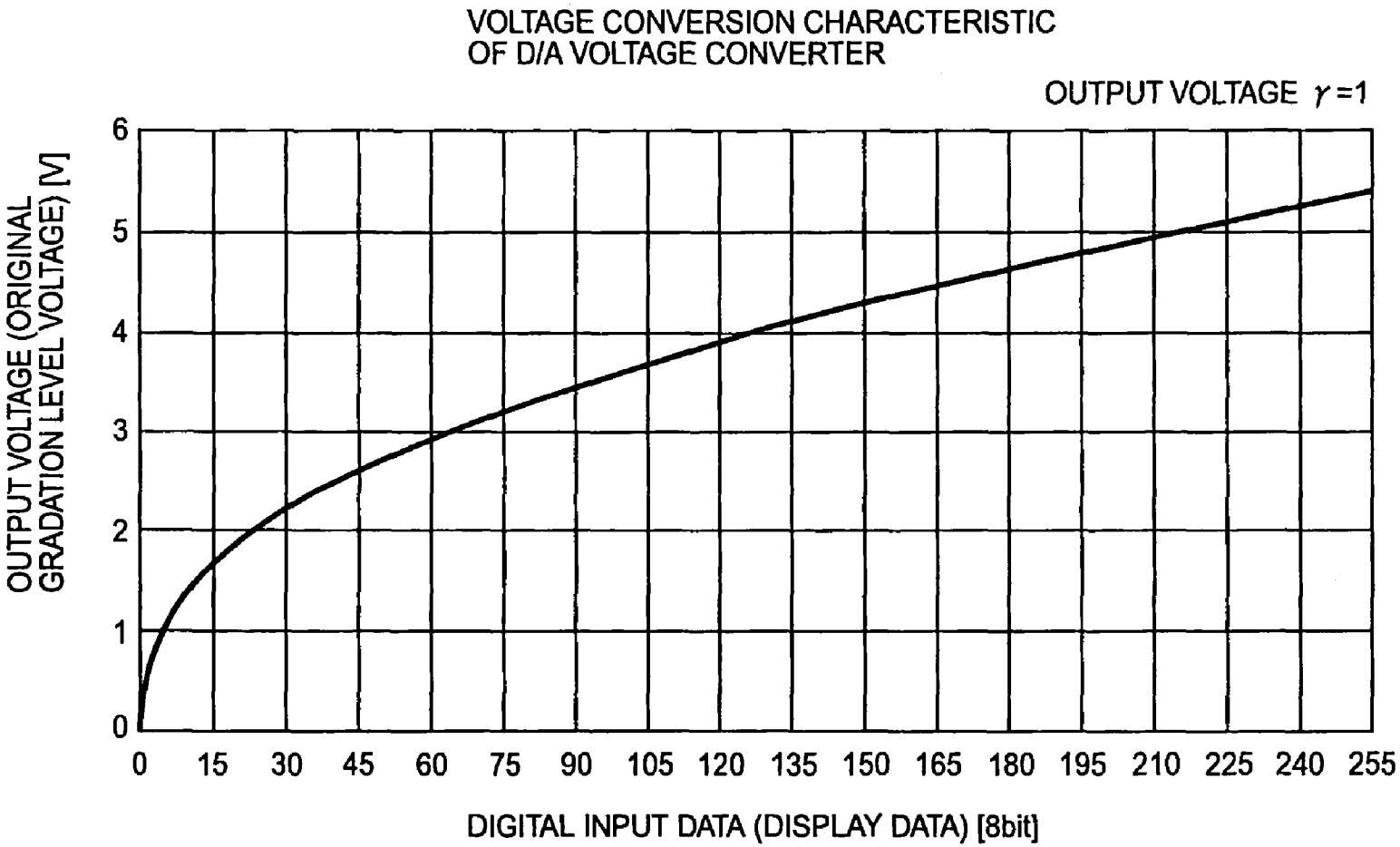
FIG. 24 shows a characteristic when a digital voltage of a digital-analog converter used as a data driver is converted to an analog voltage.

In the example of FIG. 24, the drain-source current Ids of the transistor Tr13 is substantially proportional to a digital input gradation level. Thus, the organic EL element OLED has the light-emitting brightness substantially proportional to the value of flowing current (or current density) and is displayed with gradation level linear with regard to the digital input.

The voltage converter 143 shown in FIG. 23 includes a plurality of voltage follower-type amplification circuits and a plurality of inverted amplification circuits. In the amplification circuit, a + side input terminal of an operational amplifier OP11 is connected to the data line Ld via the changing-over switch SW2. An output terminal of the operational amplifier OP11 is connected to a − side input terminal of the operational amplifier OP11. In other amplification circuits, a + side input terminal of an operational amplifier OP12 is connected to a data line Ld via the changing-over switch SW3. An output terminal of the operational amplifier OP12 is connected to the − side input terminal of operational amplifier OP12.

In the inverted amplification circuit, the + side input terminal of the operational amplifier OP2 is connected to the output terminal of the operational amplifier OP12 via the resistance R. The − side input terminal of the operational amplifier OP2 is connected, via the resistance R1, the output terminal of the operational amplifier OP11 and is connected, via the resistance R2, the output terminal of the operational amplifier OP2.

The amplification circuit having the operational amplifier OP11 retains the voltage level of the first reference voltage Vref(t1). The amplification circuit having the operational amplifier OP12 retains the voltage level of the second reference voltage Vref(t2). The retention capacity Cf is a capacity to retain the voltage levels of the first reference voltage Vref (t1) and the second reference voltage Vref(t2).

The inverted amplification circuit calculates the difference voltage ΔVref between the first reference voltage Vref(t1) and the second reference voltage Vref(t2) to invert the voltage polarity of the difference voltage ΔVref. The inverted amplification circuit also amplifies, in accordance with a voltage amplification rate determined based on a ratio between the resistances R2 and R1 (R2/R1), the voltage (−ΔVref) having an inverted polarity. The voltage [−(R2/R1)·ΔVref] obtained after the amplification is the above-described first compensation voltage. The ratio R2/R1 corresponds to the slope "a" shown in formula (14). The inverted amplification circuit also outputs the first compensation voltage [−(R2/R1)·ΔVref] to the voltage calculator 144.

The voltage calculator 144 includes an adder circuit. This adder circuit has the operational amplifier OP3 shown in FIG. 23. The + side input terminal of the operational amplifier OP3 is applied with the reference voltage via the resistance R. This + side input terminal is connected to an external input terminal of the second compensation voltage Vofst via another resistance. On the other hand, the − side input terminal is connected to the output terminal of the operational amplifier OP2 via the resistance R. This side input terminal is connected to the DA converter V-DAC via another resistance and is connected to the output terminal of the operational amplifier OP3 via another resistance.

The voltage calculator 144 adds and subtracts the original gradation level voltage Vorg, the first compensation voltage [−(R2/R1)·ΔVref] and the second compensation voltage Vofst to generate the compensated gradation level voltage Vpix. The voltage calculator 144 outputs this compensated gradation level voltage Vpix to the data line Ld via the changing-over switch SW1.

The respective changing-over switches SW1, SW2, SW3 and SW4 include a transistor switch. The respective changing-over switches SW1, SW2, SW3 and SW4 are turned ON or OFF based on the data control signal supplied from the controller 15 (any of switching control signals OUT, REF1, REF2, PRE). This turns ON or OFF the connection between the data driver 14 (the voltage calculator 144, the voltage converter 143, an external input terminal of the precharge voltage Vpre) and the data line Ld.

(Method for Driving Display Apparatus)

A driving method for use in connection with the display apparatus 1 will now be described. As shown in FIG. 9, the respective display pixels PIX of the first embodiment 1 are divided to a group arranged at the upper zone of the display zone 11 and a group arranged at the lower zone of the display zone 11. The display pixels PIX include in the respective groups are applied with independent power source voltages Vcc via different power source voltage lines Lv1 and Lv2, respectively. Thus, the display pixels PIX in a plurality of rows included in the respective groups simultaneously perform a light-emitting operation.

The following section describes a timing at which the display pixels PIX operate in the driving method as described above. The display zone 11 shown in FIG. 9 includes display pixels in 12 rows and the respective display pixels are divided into a group of the first to sixth rows (a group arranged at the upper zone of the display zone 11) and a group of the seventh to twelfth rows (a group arranged at the upper zone of the display zone 11). As shown in FIG. 25, the display pixels PIX of the respective rows are caused to sequentially perform the compensated gradation level voltage setting operation (precharge operation, transient response, reference voltage reading operation) and the writing operation. When the writing operation is completed, all display pixels PIX in the group are caused to simultaneously emit light having a gradation level depending on the display data. This light-emitting operation is sequentially repeated for the respective groups. As a result, data for one screen is displayed in the display zone 11.

For example, the respective display pixels PIX of the group of the first to sixth rows are applied, via the first power source voltage line Lv1, with the power source voltage Vcc having a low potential (=Vccw). Then, the compensated gradation level voltage setting operation, the writing operation, and the retention operation are repeatedly performed for the respective rows starting from the first row to the sixth row. With regards to the display pixels PIX of the respective rows, the voltage calculator 144 acquires, from the voltage converter 143, the first compensation voltage a·ΔVref corresponding the threshold voltage Vth of to the driving transistor Tr13. The display pixels PIX are written with the compensated gradation level voltage Vpix. The display pixels PIX in a row for which the writing operation is completed are then subjected to the retention operation.

At a timing at which the writing operation to the display pixels PIX in the sixth row is completed, the power source driver 13 applies a high potential power source voltage Vcc (=Vcce) to the respective display pixels PIX via the first power source voltage line Lv1. As a result, based on gradation level depending on the display data (compensated gradation level voltage Vpix) written to the respective display pixels PIX, all display pixels PIX included in this group (the first to sixth rows) are caused to simultaneously emit light. The display pixels of this group continuously emit light until the display pixels PIX in the first row are set to the next compensated gradation level voltage Vpix. A period during which the display pixels of this group continuously emit light until the display pixels PIX in the first row are set to the next compensated gradation level voltage Vpix is the light-emitting period Tem of the first to sixth rows. This driving method causes the display pixels PIX in the sixth row (the final row of the group of the upper zone) to emit light without performing the retention operation after the writing operation.

At a timing at which the writing operation to the respective display pixels PIX of the group of the first to sixth rows is completed, the power source driver 13 applies the power source voltage Vcc(=Vccw) for the writing operation to the respective display pixels PIX in the group of the seventh to twelfth rows via the second power source voltage line Lv2. Then, operations substantially the same as the above-described operations for the group of the first to sixth rows (the compensated gradation level voltage setting operation, the writing operation, and the retention operation) are repeated for the respective rows starting from the seventh row to the twelfth row. During these operations, display pixels in the group of the first to sixth rows continuously emit light.

At a timing at which the writing operation to the display pixels PIX in the twelfth row is completed, the power source driver 13 applies the power source voltage Vcc(=Vcce) for the light-emitting operation to the respective display pixels PIX. As a result, the display pixels PIX in six rows of this group (the seventh to twelfth rows) are caused to emit light simultaneously. Then, at a timing at which the writing operation to the display pixels PIX in all rows of each group is completed, all display pixels PIX in the group will emit light simultaneously. During display pixels in the respective rows in each group are set with a compensated gradation level voltage and during the writing current Ids is flowing therein, the respective display pixels in the group can be controlled not to emit light. In the example of FIG. 25, the display pixels PIX in twelve rows are divided to two groups and a control process is performed such that the data driver 14 causes the respective groups to emit light with different timings. Thus, a ratio between one frame period Tfr and a period during which a black display is caused by a no-light-emitting operation (hereinafter referred to as "black insertion rate") can be set to 50%. Generally, in order to allow a person to clearly visually recognize video without feeling indistinctiveness or blur, this black insertion rate should be at least 30%. Thus, this driving method can display data with a relatively favorable display picture quality.

Display pixels in the respective rows may be also divided to three or more groups instead of two groups. Rows included in the respective groups are not limited to continuous rows and also may be divided to a group of odd-numbered rows and a group of even-numbered rows. The power source voltage line Lv also may be connected to the respective rows instead of being connected to divided groups. In this case, the respective power source voltage lines can be independently applied with the power source voltage Vcc so that the display pixels PIX in the respective rows can individually emit light.

As described above, according to the first embodiment of the present invention, during the writing period Twrt of display data, the compensated gradation level voltage Vpix is directly applied between the gate and the source of the driving transistor Tr13 and a desired voltage is retained in the capacitor Cs. This compensated gradation level voltage Vpix has a voltage value for which the display data and the variation of the element characteristic of the driving transistor are compensated. As a result, the light emission driving current Iem flowing in the light-emitting element (organic EL element OLED) can be controlled based on the compensated gradation level voltage Vpix and the light-emitting element can emit light having a desired brightness of the gradation level. Specifically, voltage specification (voltage application) can be used to control the display gradation level of the light-emitting element.

Thus, the gradation data signal depending on the display data (compensated gradation level voltage) can be written, within the predetermined selection period Tsel, to the respective display pixels in a quick and secure manner. In this manner, the display apparatus 1 of the present invention can suppress insufficient writing of display data and can allow display pixels to emit light having a preferred gradation level depending on the display data.

This embodiment can use the voltage specification (voltage application) to control the display gradation level of the light-emitting element for various situations where the display zone has a larger size, where the display zone has a smaller size, where data of a low gradation level is displayed, and where current flowing in display pixels in a small display zone is small. In this regard, the gradation level control method of the present invention is advantageous over a method for using current specification for flowing current depending on display data to perform a writing operation (or to retain a voltage depending on display data) to control a gradation level.

In this embodiment, prior to writing display data to the pixel driving circuit DC of the display pixel PIX, the first compensation voltage is acquired for which the original gradation level voltage Vorg is compensated in accordance with the variation in the threshold voltage Vth of the driving transistor Tr13. Thereafter, the writing operation is used to generate a gradation data signal (compensated gradation level voltage Vpix) compensated based on this compensation voltage and a unique voltage value (the second compensation voltage) may be set based on the verify conditions to apply the gradation data signal to the light-emitting EL element OLED. As a result, the variation in the threshold voltage is compensated and the respective display pixels (light-emitting elements) emit light having an appropriate brightness of the gradation level depending on the display data. This can suppress the dispersion of the light-emitting characteristics of the respective display pixels PIX.

Further, in this embodiment, the data line voltage (the first reference voltage and the second reference voltage) are read at different read timings to generate a compensation voltage based on the difference voltage ΔVref between the respective read data line voltages, i.e., the compensation voltage. This can suppress an influence on the compensation voltage even when the reference voltage varies. Thus, gradation data signal (compensated gradation level voltage) favorably compensated relative to the variation in the threshold voltage of the driving transistor can be generated.

Also in this embodiment, a gradation data signal (compensated gradation data signal) output from the data driver 14 is a voltage signal. Thus, even when the transistor Tr13 has the drain-source current Ids having a small value during the writing operation, the gate-source voltage Vgs depending on this current Ids can be quickly set. This is different from a method for directly controlling the current value of the drain-source current Ids of the transistor Tr13 to control the gradation level of the pixel. Thus, during the selection period Tsel, the compensated gradation level voltage Vpix can be written between the gate and the source of the transistor Tr13 and the capacitor Cs. This eliminates the need in the structure of the pixel driving circuit DC structure for a memorization means (e.g., frame memory) for storing compensation data for generating the compensated gradation level voltage Vpix.

Moreover, in this embodiment, even when a plurality of display pixels have different threshold voltages Vth, the respective threshold voltages Vth are estimated based on the first reference voltage and the second reference voltage to compensate the respective threshold voltages Vth. As a result, a plurality of pixels can be operated with an identical light-emitting characteristic (e.g., identical brightness). For example, it is assumed that the display pixel A has the transistor Tr13 having a threshold voltage Vth_A and the display pixel B has the transistor Tr13 having a threshold voltage Vth_B. Based on formula (14), the threshold voltage of the driving transistor Tr13 is compensated. It is also assumed that current flowing between the drain and source of the respective display pixels is IA and IB. In the saturated zone, IA and IB are represented by formulas (16) and (17), respectively. Reference character "K" in formulas (16) and (17) represents a coefficient.

$$IA=K\{(Vorg+Vth_A)-Vth_A\}^2=K\cdot\{Vorg\}^2 \quad (16)$$

$$IB=K\{(Vorg+Vth_B)-Vth_B\}^2=K\cdot\{Vorg\}^2 \quad (17)$$

As described above, this method can compensate not only an influence of the threshold voltage change amount ΔVth on the driving transistor Tr13 but also an influence of the dispersion of threshold value characteristics among the respective transistors. Thus, according to first embodiment, even when the threshold voltage of the display pixel A is different from the threshold voltage of the display pixel B in an initial status in which there is substantially no variation ΔVth in the threshold voltage Vth, variation in the threshold voltages of the respective driving transistors Tr13 of the respective display pixels is compensated to provide an uniform display characteristic.

Second Embodiment

In the voltage specification-type gradation level control method according to the first embodiment, the original gradation level voltage Vorg is compensated based on the difference voltage ΔVref between the respective reference voltages Vref(t1) and Vref(t2) to generate the compensated gradation level voltage Vpix. This compensated gradation level voltage Vpix is applied to the respective display pixels PIX. The gradation level control method shown in the first embodiment is based on an assumption that the effect of the capacity component parasitic on the display pixel PIX can be sufficiently suppressed by the capacitor Cs connected between the gate and the source of the driving transistor Tr13. This method is also based on an assumption that, even when the power source voltage Vcc is switched from the writing level to the light-emitting level, there is no variation in the writing voltage retained in the capacitor Cs.

However, a mobile electronic apparatus such as a mobile phone frequently requires a smaller panel size and a fine picture quality. Such a requirement may prevent the storage capacitor of the capacitor Cs from being set higher than the parasitic capacitance of the display pixel PIX. In this case, when variation is caused in a writing voltage charged in the capacitor Cs at the start of the light-emitting operation, this causes variation in the gate-source voltage Vgs of the driving transistor Tr13. This causes variation in the light emission driving current Iem to prevent the respective display pixels from emitting light having a brightness depending on display data.

In order to avoid this problem, instead of using the compensated gradation level voltage Vpix to compensate the variation in the threshold voltage Vth of the driving transistor Tr13, a value of the light emission driving current Iem may be compensated. The following section describes the display apparatus 1 of the second embodiment for performing the operation as described above.

Figure 26:
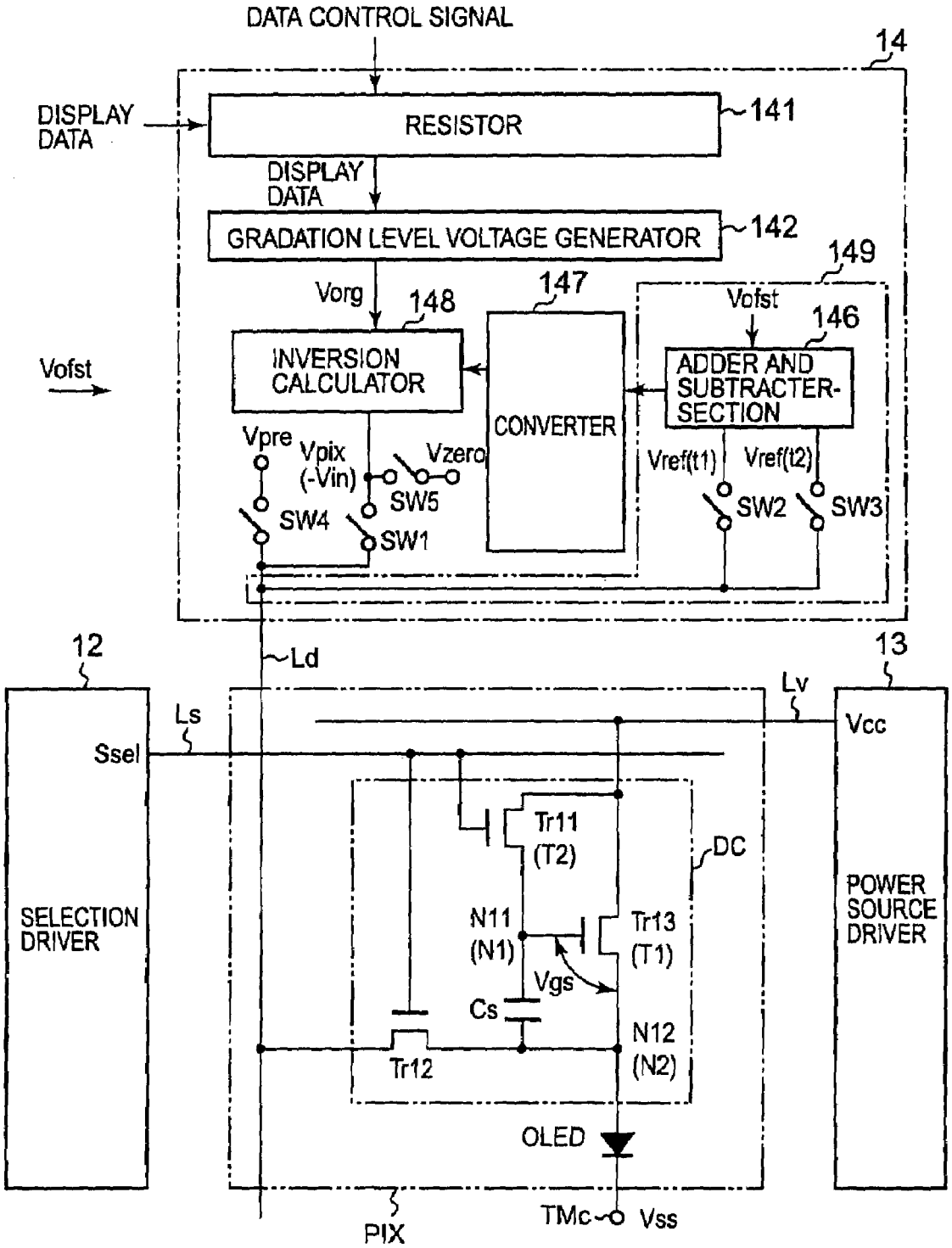
FIG. 26 illustrates the structure of the main part of a data driver and a display pixel of a second embodiment.

First, the structure of the display apparatus 1 of the second embodiment will be described. This display apparatus 1 has the same basic structure as those shown in FIGS. 9 and 10. Specifically, as shown in FIG. 26, the display pixel PIX of the second embodiment is substantially the same as that of the first embodiment. The pixel driving circuit DC of the display pixel PIX includes the driving transistor Tr13 connected to the light-emitting element OLED in series, the selection transistor Tr12, and the retention transistor Tr11 for diode connection of the driving transistor Tr13. The data driver (display driving apparatus) 14 has the structure shown in FIG. 26 instead of the structure shown in FIG. 10.

The gradation level voltage generator 142 of the second embodiment generates the original gradation level voltage Vorg to output the original gradation level voltage Vorg (as in the first embodiment). With regard to this original gradation level voltage Vorg, the unique voltage characteristic of the pixel driving circuit (driving transistor Tr13) is compensated in order to allow a light-emitting element to emit light having a desired brightness of the gradation level.

The data driver 14 (display driving apparatus) includes, instead of the voltage converter 143 shown in FIG. 10, an adder and subtracter-section (voltage reader) 146 and a converter 147. The data driver 14 also includes, instead of the voltage calculator 144 shown in FIG. 10, an inversion calculator (compensated gradation data signal generator) 148. The data driver 14 also includes a changing-over switch SW5. The adder and subtracter-section 146 and the changing-over switches SW2 and SW3 will be collectively called a "voltage reader 149". The combination of the adder and subtracter-section 146, the converter 147, the inversion calculator 148, and the changing-over switch SW5 is provided in an amount of "m" in the data line Ld of each column, respectively.

The adder and subtracter-section (voltage reader) 146 applies the predetermined precharge voltage Vpre to the data line Ld. During the predetermined transient response period Ttrs (natural relaxation period), the adder and subtracter-section 146 reads the first reference voltage Vref(t1) and the second reference voltage Vref(t2) at different timings. The adder and subtracter-section 146 calculates the difference voltage ΔVref(=Vref(t2)−Vref(t1)) by subtracting the first reference voltage Vref(t1) from the second reference voltage Vref(t2). The adder and subtracter-section 146 also outputs, to the converter 147, a voltage (ΔVref−Vofst) obtained by subtracting a previously set OFFSET voltage Vofst from the difference voltage ΔVref.

The converter 147 multiplies the voltage (ΔVref−Vofst) output from the adder and subtracter-section 146 with the predetermined coefficient α. This coefficient α is used to estimate the threshold voltage Vth after the variation of the characteristic of the transistor Tr13. After the multiplication, the converter 147 outputs the resultant voltage α (ΔVref−Vofst) to the inversion calculator 148. The voltage α(ΔVref−Vofst) generated by the converter 147 can be represented, as shown in formula (21), by a predetermined multiple β of the threshold voltage Vth. The reference character "βVth" will be called as "compensation voltage" hereinafter.

$$\beta Vth=\alpha\cdot(\Delta Vref-Vofst)=\alpha\cdot(Vref(t2)-Vref(t1)-Vofst) \quad (21)$$

The inversion calculator 148 adds the original gradation level voltage Vorg obtained from the gradation level voltage generator 142 to the compensation voltage βVth obtained from the converter 147 to generate the compensated gradation level voltage (compensated gradation data signal) Vpix. When the gradation level voltage generator 142 includes a DA converter at this stage, the inversion calculator 148 adds the original gradation level voltage Vorg to the compensation voltage βVth in the form of an analog signal. Then, the inversion calculator 148 charges the generated compensated gradation level voltage Vpix in the capacitor Cs via the data line Ld (writing operation). This embodiment also allows the inversion calculator 148 to set the compensated gradation level voltage Vpix to a negative polarity in order to flow writing current from the data line Ld into the data driver 14 during the writing operation to the display pixel PIX. Then, the compensated gradation level voltage Vpix is set to satisfy formula (22). In the formula (22), β>1, original gradation level voltage Vorg>0, and Vin<0 are established.

$$Vpix=-Vin=-Vorg-\beta Vth \quad (22)$$

The changing-over switch SW5 is connected between the output terminal of the inversion calculator 148 and a power source terminal for applying the black gradation level voltage Vzero. The changing-over switch SW5 preferably has a resistance and capacity equal to those of the respective changing-over switches SW1, SW2, SW3 and SW4.

The changing-over switch SW5 is turned ON or OFF based on a data control signal from the controller 15. Based on the data control signal, the changing-over switch SW5 controls the application of the black gradation level voltage Vzero to the data line Ld.

When the gradation level is the 0th gradation level (or when the organic EL element OLED does not emit light), the gradation level voltage generator 142 does not output the original gradation level voltage Vorg. Then, the black gradation level voltage Vzero is applied to the output terminal of the inversion calculator 148 via the changing-over switch SW5. The formula (22) can then be replaced by formula (23). Specifically, the display driving apparatus 14 has the above-described structure to compensate the unique voltage characteristic of the pixel driving circuit (driving transistor Tr13) and to generate the compensated gradation level voltage Vpix for causing the light-emitting element OLED to emit light having a desired brightness of the gradation level voltage Vpix to the capacitor Cs.

$$Vpix=-Vin=V\text{zero}\leqq Vth \tag{23}$$

(Method for Driving Display Apparatus)

A method for driving the display apparatus 1 of the second embodiment of the invention will now be described. As in the first embodiment, the second embodiment also initially performs an operation for setting a compensated gradation level voltage. The adder and subtracter-section 146 applies the predetermined precharge voltage Vpre to the data lines Ld on the respective columns. As a result, the adder and subtracter-section 146 allows the flow of the precharge current Ipre from the power source voltage line Lv into the data lines Ld of the respective rows. Thereafter, the adder and subtracter-section 146 stops the application of the precharge voltage Vpre. After the stoppage, when the first read timing t1 is reached during the transient response period Ttrs, the adder and subtracter-section 146 reads the first reference voltage Vpre(t1). The adder and subtracter-section 146 also reads the second reference voltage Vpre(t2) when the second read timing t2 is reached. This transient response period Ttrs is set to be shorter than a period during which the gate-source voltage Vgs of the transistor Tr13 converges to the threshold voltage after the variation (Vth+ΔVth).

Next, the inversion calculator 148 compensates the original gradation level voltage Vorg based on the compensation voltage βVth set based on the difference voltage ΔVref(=Vpre(t2)−Vpre(t1)). The inversion calculator 148 generates the compensated gradation level voltage Vpix shown in formula (22) to apply the compensated gradation level voltage Vpix to the respective data lines Ld. Then, the writing current Iwrt based on this compensated gradation level voltage Vpix flows in the respective display pixels PIX. This writing current Iwrt corresponds to the drain-source current Ids of the transistor Tr13.

Thus, in the second embodiment, in order to compensate the writing current Iwrt, the voltage Vgs is set so that gate-source voltage Vgs of the driving transistor Tr13 satisfies formula (24). In formula (24), Vd0 represents a voltage among the voltages Vgs applied to the gate and the source of the transistor Tr13 during the writing operation that changes in accordance with the specified gradation level (digital bit). Also, in formula (24), γVth represents a voltage depending on the threshold voltage Vth. Thus, Vd0 corresponds to the first compensation voltage and γVth corresponds to the second compensation voltage. The constant γ in formula (24) is defined by formula (25).

$$Vgs=0-(-Vd)=Vd0+\gamma Vth \tag{24}$$

$$\gamma=1+(Cgs11+Cgd13)/Cs \tag{25}$$

Figure 27A:
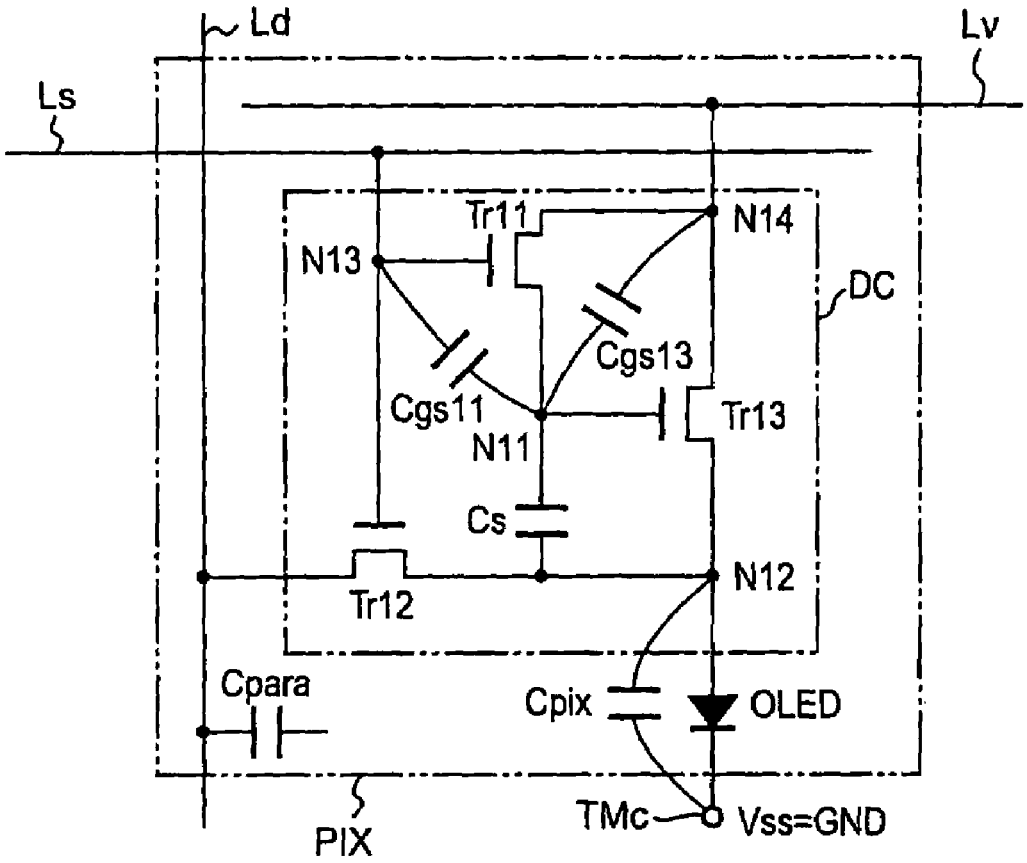
FIG. 27A illustrates an equivalent circuit including a capacity component parasitic on the pixel driving circuit.

By satisfying formula (24), this embodiment of the invention can use the compensated gradation level voltage Vpix to compensate the light emission driving current Iem flowing from the transistor Tr13 into the organic EL element OLED during the light-emitting operation. The first embodiment is different from the second embodiment in that the compensated gradation level voltage Vpix compensated the variation in the threshold voltage Vth of the transistor Tr13. Cgs11 in formula (25) is a parasitic capacitance between the contact point N11 and the contact point N13 as shown in FIG. 27A. Cgd13 represents a parasitic capacitance between the contact point N11 and the contact point N14, Cpara represents a parasitic capacitance of the data line Ld, and Cpix represents a parasitic capacitance of the organic EL element OLED.

In the above-described method for driving a display apparatus, the shift from a writing operation to a light-emitting operation causes the selection signal Ssel applied to the selection line Ls to be switched from a high level to a low level and also causes the power source voltage Vcc applied to the power source voltage line Lv to be switched from a low level to a high level. This causes a risk of variation in the gate-source voltage (a voltage retained in the capacitor Cs) Vgs of the driving transistor Tr13. In this embodiment, the voltage Vgs is set to satisfy formula (24) to compensate the writing current Iwrt.

Figure 28A:
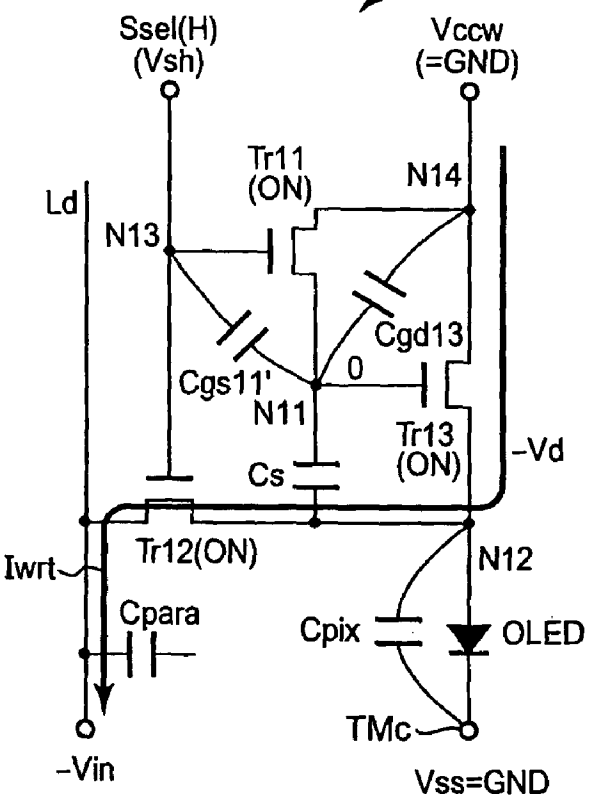
FIG. 28A illustrates an equivalent circuit in a writing operation of a display pixel in the second embodiment of the invention.

Then, the gate-source voltage Vgs for specifying the light emission driving current Iem flowing in the organic EL element OLED during a light-emitting operation is introduced. The following section assumes that the power source voltage Vcc(=Vccw) during the writing operation is a ground potential GND. As shown in FIG. 28A, during the writing operation, the display pixel PIX is applied with the selection signal Ssel of the selected level (high level) (=Vsh) and the power source voltage Vcc(=Vccw=GND) for a writing operation. The inversion calculator 148 applies the compensated gradation level voltage Vpix(=−Vin) having a negative polarity lower than that of the power source voltage Vccw(=GND) to the display pixel PIX.

As a result, the transistor Tr11 and selection transistor Tr12 are turned ON and the gate of the driving transistor Tr13 (contact point N11) is applied with the power source voltage Vccw(=GND) and the source (contact point N12) of the transistor Tr13 is applied with the compensated gradation level voltage Vpix having a negative polarity. A potential difference is thereby created between the gate and the source of the transistor Tr13 to turn ON the transistor Tr13. Then, the writing current Iwrt flows from the power source voltage line Lv applied with the power source voltage Vccw into the data line Ld. The Vgs(writing voltage Vd) depending on the value of this writing current Iwrt is retained in the capacitor Cs formed between the gate and the source of the transistor Tr13.

Reference Cgs11' shown in FIG. 28A is an effective parasitic capacitance created between the gate and the source of the transistor Tr11 when the gate voltage (selection signal Ssel) of the transistor Tr11 changes from a high level to a low level. Cgd13 is a parasitic capacitance created between the gate and the drain of the transistor Tr13 when a source-drain voltage of the driving transistor Tr13 is in a saturated zone.

Figure 28B:
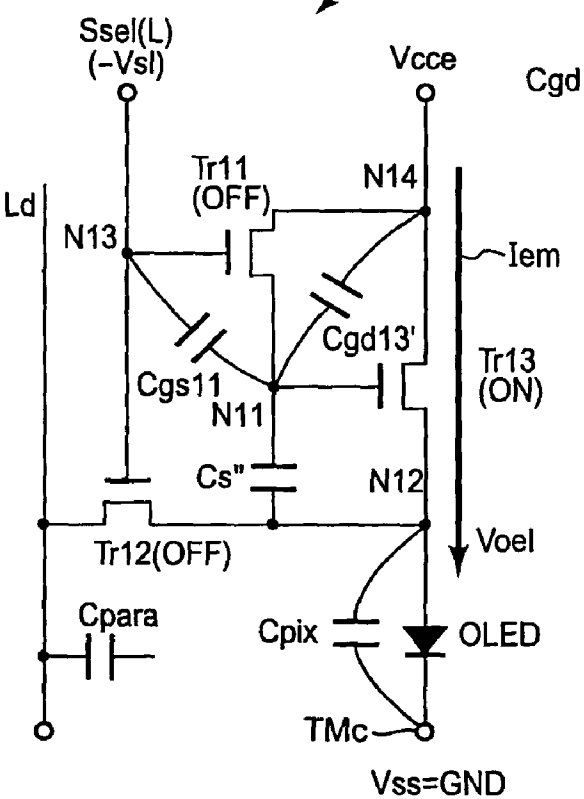
FIG. 28B illustrates an equivalent circuit in a light-emitting operation of a display pixel in the second embodiment of the invention.
Figure 28C:
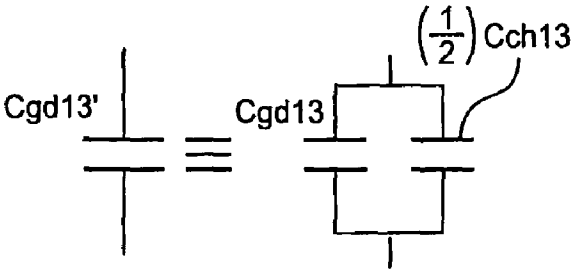
FIG. 28C illustrates an equivalent circuit corresponding to the capacity component Cgd13' shown in FIG. 28B.
Figure 28D:
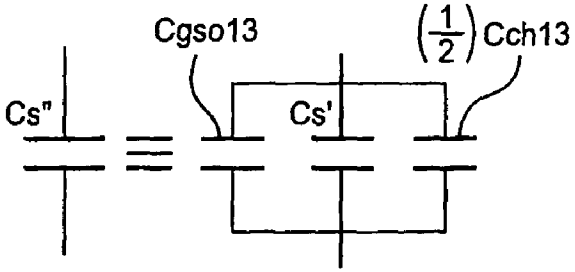
FIG. 28D illustrates an equivalent circuit corresponding the capacity component Cs" shown in FIG. 28B.

As shown in FIG. 28B, during the light-emitting operation, the selection line Ls is applied with the selection signal Ssel of the voltage (−Vsl<0) of the not-selected level (low level) and is applied with the power source voltage Vcc for light emission having a high potential (=Vcce; 12-15V for example). The selection transistor Tr12 is turned OFF to block the application by the inversion calculator 148 of the compensated gradation level voltage Vpix(=−Vin) to the data line Ld.

By applying the election signal Ssel having the voltage Vsel to the selection line Ls, the transistor Tr11 is turned OFF to block the application of the power source voltage Vcc to the gate of the transistor Tr13 (contact point N11) and to block the application of the compensated gradation level voltage Vpix to the source of the transistor Tr13 (contact point N12). Then, a potential difference (0−(−Vd)=Vd) created between the gate and the source of the transistor Tr13 during a writing operation is retained in the capacitor Cs. Thus, the gate-source potential difference Vd is maintained and the transistor Tr13 maintains an ON status. As a result, the light emission driving current Iem in accordance with the gate-source voltage Vgs(=Vd) flows from the power source voltage line Lv to the organic EL element OLED and the organic EL element OLED emits light having a brightness depending on a value of the current Iem.

A voltage Voel at the contact point N12 shown in FIG. 28B represents a voltage of the organic EL element OLED during the light-emitting operation (hereinafter referred to as "light-emitting voltage"). Cgs11 is a parasitic capacitance created between the gate and the source when the gate voltage of the transistor Tr11 (selection signal Ssel) has a low level (−Vsl). A relationship between Cgs11' of FIG. 28A and Cgs11 of FIG. 28B is represented by formula (26). The voltage Vshl in formula (26) represents a potential difference (Vsh−(−Vsl)) between the high level (Vsh) and the low level (−Vsl) of the selection signal Ssel.

$$Cgs11'=Cgs11+(1/2)\times Cch11\times Vsh/Vsh1 \quad (26)$$

At the shift from the writing operation to the light-emitting operation, the voltage levels of the selection signal Ssel and the power source voltage Vcc are switched. During the writing operation, the voltage Vgs(=Vd) retained between the gate and the source of the transistor Tr13 varies in accordance with formula (27). In formula (27), cgd, cgs, and cgs' represent values obtained by normalizing the respective parasitic capacitances Cgd, Cgs, and Cgs' by the capacity of the capacitor and cgd=Cgd/Cs, cgs=Cgs/Cs, and cgs'=Cgs'/Cs are established. A characteristic according to which the voltage Vgs varies in accordance with a change in the voltage applied to the pixel driving circuit DC is called "a voltage characteristic unique to the pixel driving circuit DC".

$$Vgs=\{Vd-(cgs+cgd)\cdot Voel\}/(1+cgs+cgd)+(cgd\cdot Vcce-cgs'\cdot Vsh1)/(1+cgs+cgd) \quad (27)$$

Figure 29A:
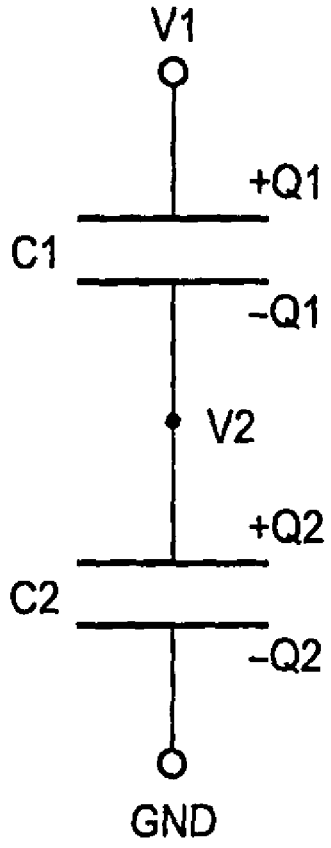
FIG. 29A illustrates the first model for describing law of conservation of charge amount.
Figure 29B:
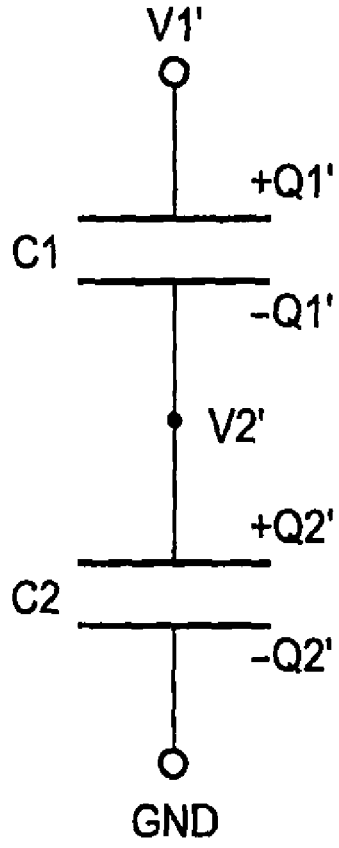
FIG. 29B illustrates the second model for describing law of conservation of charge amount.

The formula (27) is introduced by applying "law of conservation of charge amount" before and after the switching of a control voltage (selection signal Ssel, power source voltage Vcc) applied to the pixel driving circuit DC. As shown in FIGS. 29A and 29B, a voltage applied to one end of the capacity components (capacities C1 and C2) connected in series is changed from V1 to V1'. The charge amounts Q1 and Q2 of the respective capacity components before the change and the charge amounts Q1' and Q2' of the respective capacity components after the change can be represented by formulas (28a)-(28d).

$$Q1=C1(V1-V2) \quad (28a)$$

$$Q2=C2V2 \quad (28b)$$

$$Q1'=C1(V1'-V2') \quad (28c)$$

$$Q2'=C2V2' \quad (28d)$$

Based on formulas (28a)-(28d), −Q1+Q2=−Q1'+Q2' is calculated, the potentials V2 and V2' at a connection point of the capacity components C1 and C2 is represented by formula (29).

$$V2'=V2-\{C1/(C1+C2)\}\cdot(V1-V1') \quad (29)$$

The following section describes the potential Vn11 at the gate (contact point N11) of the transistor Tr13 when the relationships shown in the above-described formulas (28a)-(28d) and (29) are applied to the display pixel PIX (the pixel driving circuit DC and the organic EL element OLED) and the selection signal Ssel is switched.

Figure 27B:
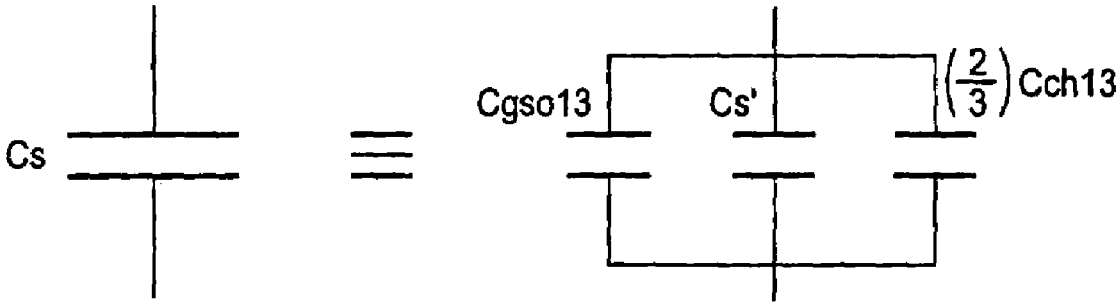
FIG. 27B illustrates an equivalent circuit corresponding to the capacity component Cs shown in FIG. 27A.
Figure 30B:
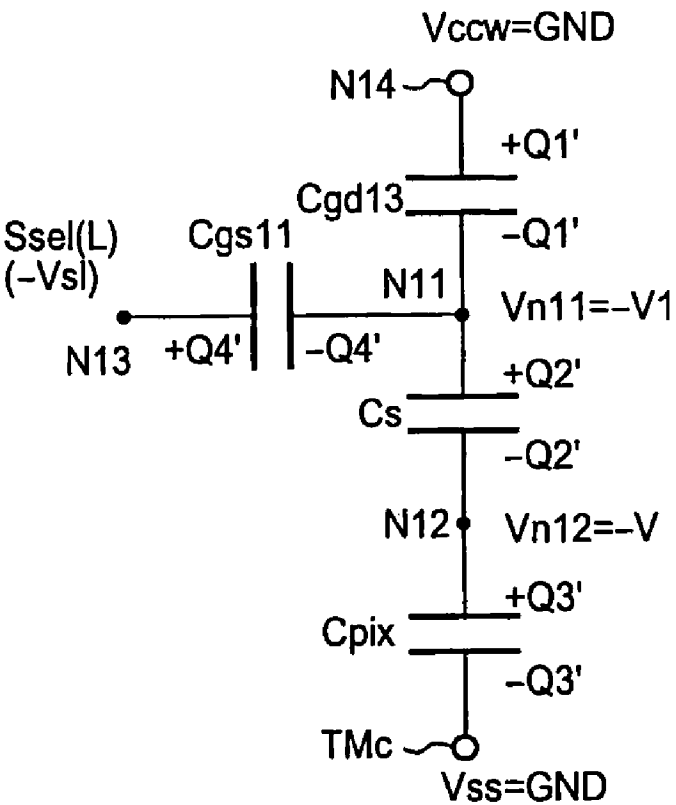
FIG. 30B illustrates a model for describing a status in which charge is retained in a display pixel when a low level selection signal is applied thereto.
Figure 30A:
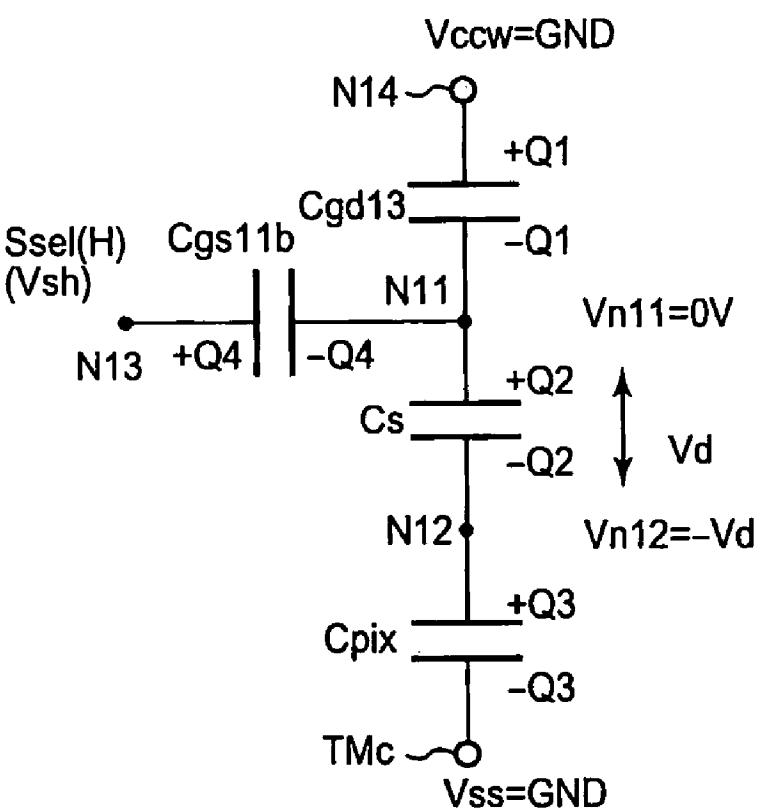
FIG. 30A illustrates a model for describing a status in which charge is retained in a display pixel when a high level selection signal is applied thereto.

In this case, the equivalent circuits shown in FIGS. 27, 28A, and 28B can be substituted to the equivalent circuits shown in FIGS. 30A and 30B. In the example of FIG. 30A, the selection line Ls is applied with the selection signal Ssel of the selected level (high level voltage Vsh) and the power source voltage line Lv is applied with the power source voltage Vcc(=Vccw) having a low potential. In the example of FIG. 30B, the selection line Ls is applied with the selection signal Ssel of the not-selected level (low level voltage Vsl). The power source voltage line Lv is applied with the power source voltage Vcc(=Vccw) having a low potential.

During application of the selection signal Ssel of the selected level (Vsh), charge amounts retained in the respective capacity components Cgs11, Cgs11*b*, Cds13, and Cpix and the capacitor Cs shown in FIG. 30A are represented by formulas (30a)-(30d). When the selection signal Ssel of the not-selected level (Vsl) is applied, charge amounts retained in the respective capacity components Cgs11, Cgs11*b*, Cds13, and Cpix and capacitor Cs shown in FIG. 30B are represented by formulas (30e)-(30h). The capacity component Cgs11*b* shown between the contact points N11 and N13 shown in FIG. 30B is the gate-source parasitic capacitance Cgso11 other than the in-channel capacity of the transistor Tr11. The capacity component Cgs11*b* between the contact points N11 and N13 shown in FIG. 30A is a sum of a value of (Cgs11=Cch11/2+Cgs11) obtained by multiplying the channel capacity Cch11 of the transistor Tr11 with ½ and Cgs11 (=Cgso11).

$$Q1=0 \quad (30a)$$

$$Q2=Cs\cdot Vd \quad (30b)$$

$$Q3=-Cpix\cdot Vd \quad (30c)$$

$$Q4=Cgs11b\cdot Vsh \quad (30d)$$

$$Q1'=Cgd13\cdot V1 \quad (30e)$$

$$Q2'=Cs\cdot(V-V1) \quad (30f)$$

$$Q3'=-Cpix\cdot V \quad (30g)$$

$$Q4'=Cgs11\cdot Vsh\cdot(V1-Vsl) \quad (30h)$$

When the law of conservation of charge amount is applied in the examples of FIGS. 30A and 30B, a relationship of the respective charges at the contact point N11 and at the contact point N12 is represented by formulas (31a) and (31b).

$$-Q1+Q2-Q4=-Q1'+Q2'-Q4' \quad (31a)$$

$$-Q2+Q3=-Q2'+Q3' \quad (31b)$$

When formulas (31a) and (31b) are applied to formulas (30a)-(30d), the potential Vn11 at the contact point N11 and the potential Vn12 at the contact point N12 are represented by formulas (32a) and (32b). Cgs11' and D shown in formulas (32a) and (32b) are defined by formulas (33a) and (33b), respectively.

$$Vn11=-V1=-(Cgs11'\cdot Cpix+Cgs11'\cdot Cs)\cdot Vshl/D \quad (32a)$$

$$Vn12=-V=-Vd-(Cgs11'\cdot Cs)\cdot Vshl/D \quad (32b)$$

$$Cgs11'=Cgs11+(Cch11'\cdot Cs)/(2\cdot Vshl) \quad (33a)$$

$$D=Cgd13\cdot Cpix+Cgd13\cdot Cs+Cgs11\cdot Cpix+Cgs11\cdot Cs+Cs\cdot Cpix \quad (33b)$$

The following section describes an embodiment wherein the method for introducing the potential as described above is applied to the respective steps from the writing operation to the light-emitting operation according to the second embodiment and the method for driving the display apparatus 1 in the second embodiment. The method for driving the display apparatus 1 of the second embodiment is identical as that shown in the example of FIG. 11 and includes a selection step, a not-selected status switching step, a not-selected status retention step, a power source voltage switching step, and a light-emitting step.

Specifically, in the second embodiment, the selection step sending the selection signal Ssel of the selected level to the display pixel PIX to select the display pixel PIX to write a voltage in accordance with the display data to the capacitor Cs owned by the display pixel PIX. The not-selected status switching step causes the respective display pixels PIX selected in the selection step to be in a not-selected status. In the not-selected status retention step, a capacitor Cs is retained in the capacitors Cs of the display pixels PIX caused to be in a not-selected status by the switching step. In the power source voltage switching step, the power source voltage Vcc applied to the driving transistor Tr13. connected to the capacitor that has retained the charging voltage in the not-selected status. is switched from the writing operation level (low potential) to the light-emitting operation level (high potential). In the light-emitting step, a light-emitting element is caused to emit light having a brightness depending on display data.

Figure 31A:
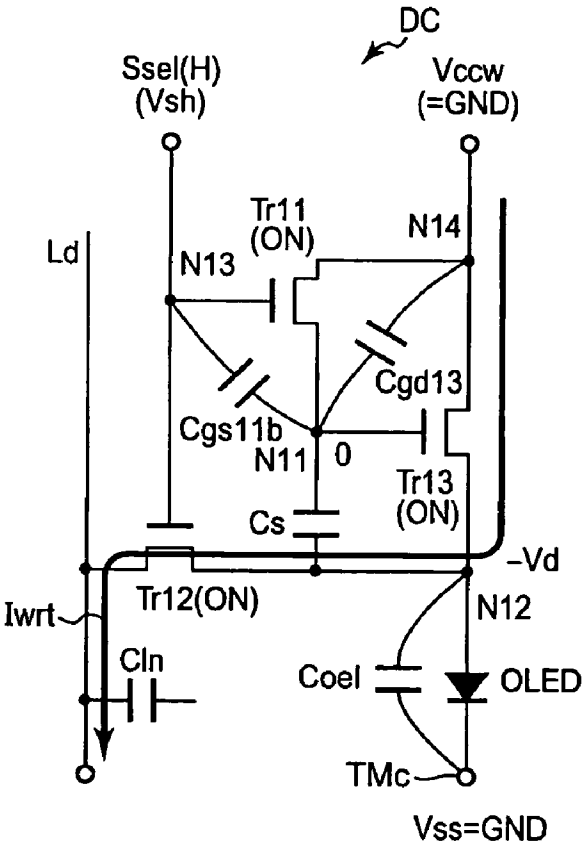
FIG. 31A illustrates a voltage in the equivalent circuit in a selection step.

Initially, the following section describes a voltage change at each point when the selection step shifts to the not-selected status switching step. Before the shift, as shown in FIG. 31A, the transistor Tr11 and the transistor Tr12 are ON by the application of the selection signal (Vsh) having a high potential and the writing current Iwrt flows between the drain and the source of the transistor Tr13. The contact point N11 has a potential of Vccw (ground potential) and the contact point N12 has a potential of −Vd.

Figure 31B:
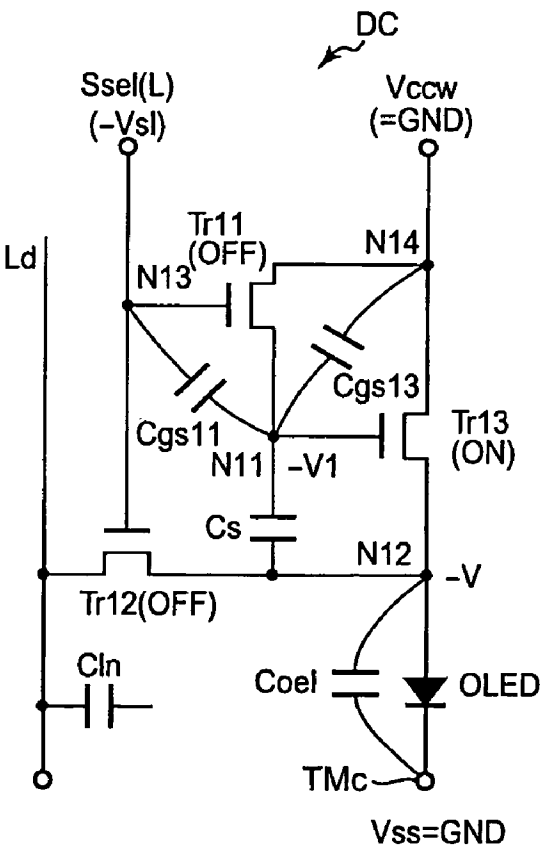
FIG. 31B illustrates a voltage in the equivalent circuit in a not-selected status switching step.

When the selection signal Ssel of the not-selected level is applied to the transistor Tr11 and is applied to the transistor Tr12 in this status, the transistor Tr11 and the transistor Tr12 are switched from ON to OFF as shown in FIG. 31B. The contact point N11 after the switching has a potential of −V1 and the contact point N12 after the switching has a potential of −V. When the selection signal Ssel is switched from a positive potential of high level (Vsh) to a negative potential of a low level (−Vsl), the gate-source voltage Vgs' of the driving transistor Tr13 changes by −ΔVgs from Vd. Then, the voltage Vgs' after the switching (writing voltage (i.e., a potential difference between the potential Vn11 of the contact point N11 and the potential Vn12 of the contact point N12)) is represented by formula (34).

$$Vgs'=Vn11-Vn12=-V1-(-V)=V-V1=Vd-(Cgs11'\cdot Cpix/D)\cdot Vshl=Vd-\Delta Vgs \quad (34)$$

This voltage shift ΔVgs is represented by Cgs11'·Cpix·Vshl/D. The capacity component Cs' between the contact points N11 and N12 at the not-selected switching step is a parasitic capacitance component formed at a part other than the gate-source capacity of the transistor Tr13. In formulas (32a), (32b), (33a), and (33b), reference "Cs" is a sum of the capacity component Cs', the gate-source voltage parasitic capacitance Cgso13 other than the in-channel capacity of the transistor Tr13, and the in-channel gate-source capacity of the transistor Tr13 in the saturated zone. This in-channel gate-source capacity is ⅔ of the channel capacity Cch1 of the transistor Tr13. Thus, Cs shown in formulas (32a), (32b), (33a), (33b) can be calculated as shown below.

$$Cs=Cs'+Cgso13+(2/3)\cdot Cch13$$

In the saturated zone, the in-channel gate-drain capacity can be assumed as 0. Thus, only Cgd13 is a gate-drain capacity Csgo13 other than the in-channel capacity of the transistor Tr13. In formula (34), Cgs11' is a sum of the gate-source parasitic capacitance Cgso11 other than the in-channel capacity of the transistor Tr11 and the in-channel gate-source capacity of the transistor Tr11 when Vds=0. This in-channel gate-source capacity is an integration value of ½ of the channel capacity Cch11 of the transistor Tr11 and a voltage ratio (Vsh/Vshl) of the selection signal Ssel. Specifically, Cgs11' shown in formula (34) can be represented as shown below.

$$Cgs11'=Cgso11+Cch11\cdot Vsh/2Vshl$$

Figure 32A:
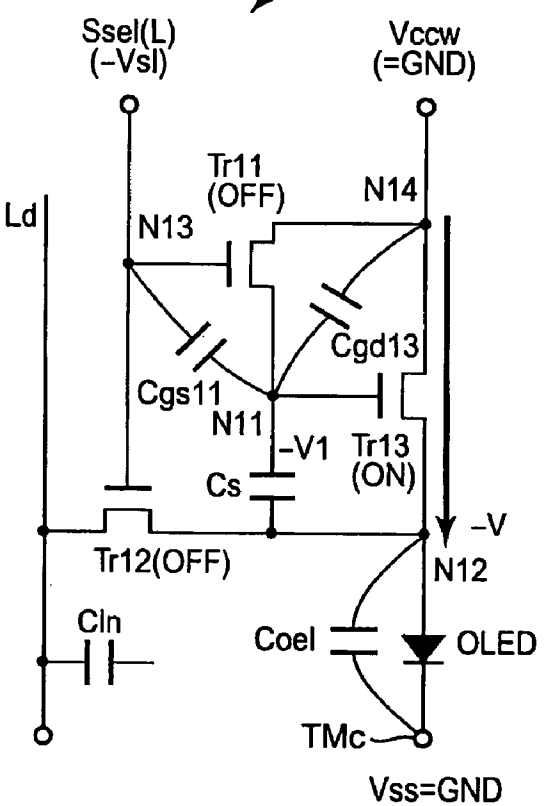
FIG. 32A illustrates a voltage change when the selection step (writing operation) shifts to the not-selected status.
Figure 32B:
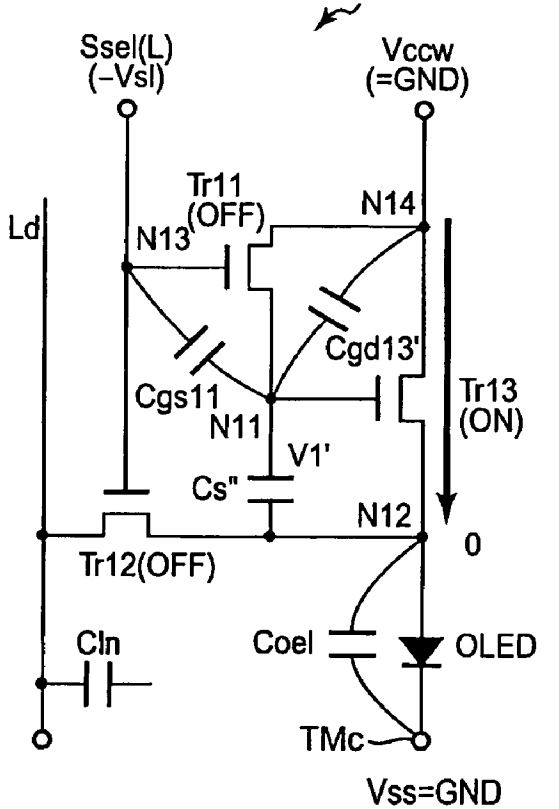
FIG. 32B illustrates a voltage change in the not-selected status retention step.

Next, a voltage change in the step for retaining the not-selected status of the display pixel PIX (not-selected status retention step) will be described. As shown in FIG. 32A, when the selection step (writing operation) shifts to the not-selected status, the transistor Tr13 maintains an ON status based on the voltage Vgs' retained between the gate and the source (capacity component Cs'). Then, the contact point N12 has a potential lower than that of the power source voltage Vcc(=Vccw) and the drain-source current Ids flows in the transistor Tr13. As shown in FIG. 32B, the current Ids flowing in the transistor Tr13 causes the potential at the contact point N12 to increase to 0.

The drain voltage and the source voltage change until there is no difference between the drain voltage of the transistor Tr13 (the potential of the contact point N14) and the source voltage (the potential of the contact point N12). A time required for this change is in the order of twelve microseconds. The change in the source potential causes the gate potential V1' of the transistor Tr13 to change from formulas (32a), (32b), (33a), and (33b) to a relationship shown in formula (35).

$$V1'=\{Cs/(Cgs11+Cgd13'+Cs'')\}\cdot V-\{(Cgs11+Cgd13+Cs)/(Cgs11+Cgd13'+Cs'')\}\cdot V1 \quad (35)$$

Reference CS" shown in formula (35) represents a capacity obtained by adding the above-described Cs' and Cgso13 to ½ of the in-channel gate-source capacity Csh13 of the transistor Tr13 when Vds=0, as shown in formula (36a). In formula (35), Cgd13' is a sum of the above-described Cgd13 and ½ of the in-channel gate-source capacity Cch13 of the transistor Tr13 when Vds=0. Specifically, Cgd13' is represented by formula (36b).

$$Cs''=Cs'+Cgso13+Cch13/2=Cs-Cch13/6 \quad (36a)$$

$$Cgd13'=Cgd13+Cch13/2 \quad (36b)$$

In formula (35), −V1 and V1' are not −V1 and V1' shown in FIG. 29 and are the potential (−V1) of the contact point N11 in FIG. 32A and the potential (V1') of the contact point N11 in FIG. 32B, respectively. In the not-selected status retention step, the capacity component Cgd13' between the contact points N11 and N14 shown in FIG. 32B is a sum of the gate-drain capacity Csgo13 other than the in-channel capacity of the transistor Tr13 and ½ of the channel capacity Cch13 of the transistor Tr13. Specifically, capacity component Cgd13' can be represented as shown below.

$$Cgd13'=Cgdo13+Cch13/2=Cgd13+Cch13/2$$

Figure 33A:
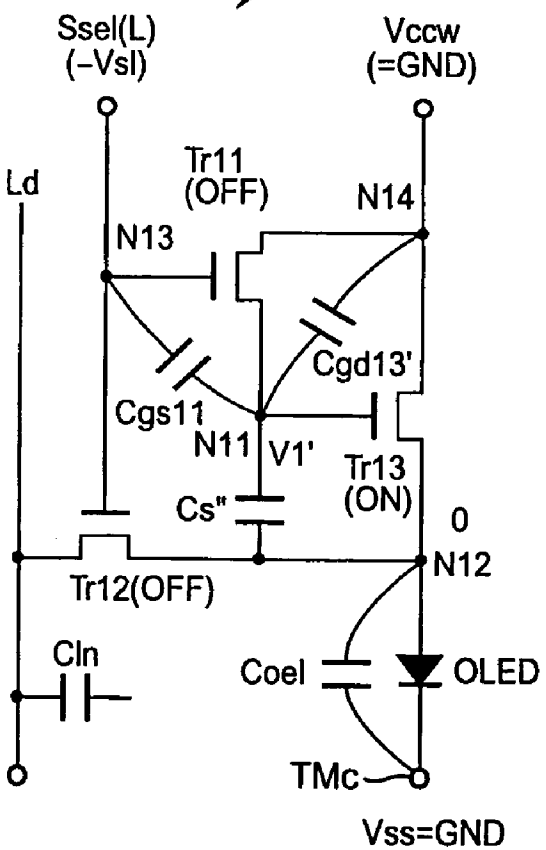
FIG. 33A illustrates a voltage in the equivalent circuit of the not-selected status retention step.
Figure 33B:
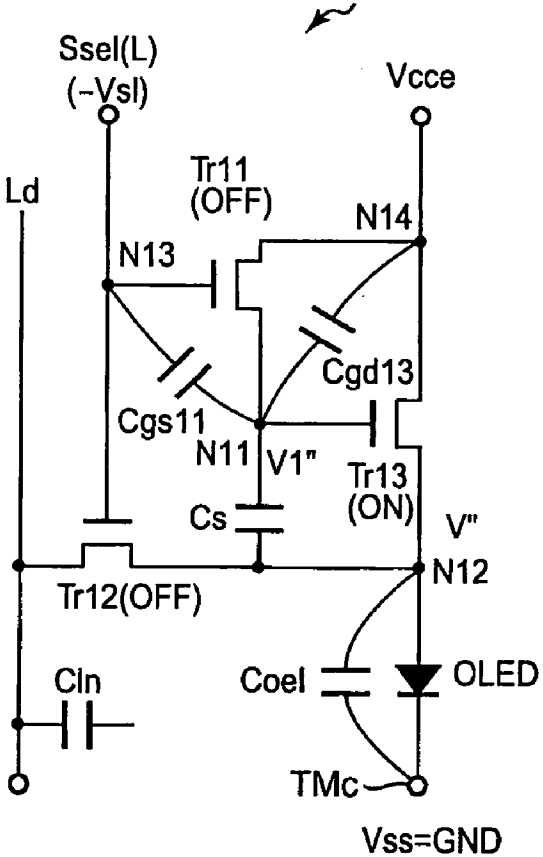
FIG. 33B illustrates a voltage in the equivalent circuit of the power source voltage switching step.
Figure 33C:
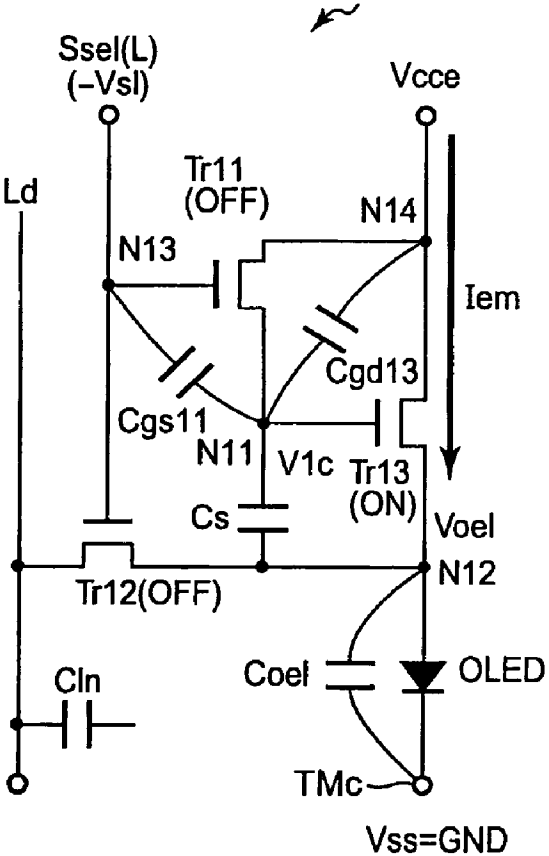
FIG. 33C illustrates a voltage in the equivalent circuit of the light-emitting step.

The following section describes a voltage change at each point when the not-selected status retention step shifts to the power source voltage switching step and the power source voltage switching step shifts to the light-emitting step. As shown in FIG. 33A, the drain-source potential difference of the transistor Tr13 is 0 in the not-selected status retention step to prevent the drain-source current Ids from flowing. As shown in FIG. 33B, when the not-selected status retention step shifts to the power source voltage switching step, the power source voltage Vcc is switched from the low potential (Vccw) to the high potential (Vcce). When the power source voltage switching step shifts to the light-emitting step, the light emission driving current Iem flows in the organic EL element OLED via the transistor Tr13 as shown in FIG. 33C.

First, the situation will be described where the not-selected status retention step shifts to the power source voltage switching step. During the shift, the drain-source voltage of the transistor Tr13 shown in FIG. 33A is closer to the potential 0. Thereafter, the power source voltage Vcc in the power source voltage switching step is switched from the low potential (Vccw) to the high potential (Vcce). Thus, the potential Vn11 of the gate (contact point N11) of the transistor Tr13 and the potential Vn12 of the source (contact point N12) increase. The potential Vn11 is thus represented by formula (37a) and potential Vn12 is thus represented by formula (37b). References V1" and V" are the potential Vn11 of the contact point N11 and the potential Vn12 of the contact point N12 shown in FIG. 33B, respectively.

$$Vn11=V1''=\{1+Cch13\cdot(3Cs+2Cpix)/6D\}V''+(Cgd13\cdot Cpix+Cgd13\cdot Cs)\cdot Vcce/D \quad (37a)$$

$$Vn12=V''=Cgd13\cdot Cs\cdot Vcce/D+Cch13\cdot(Cgs11+Cgd13+3Cs)/ \quad (37b)$$

Furthermore, the light-emitting step switches the power source voltage. Thus, the potential V1*c* (the potential Vn11 of the contact point N11 in the example of FIG. 33C) caused in the gate of the transistor Tr13 (contact point N11) is represented by formula (38).

$$Vn11=V1c=V1''+Cs\cdot(Vpix-V'')/(Cgd13+Cgs11+Cs) \quad (38)$$

The respective voltages shown in formulas (34), (35), (37a), (37b), and (38) are all rewritten to voltage signs in the not-selected status switching step. Thus, the gate-source voltage Vgs of the driving transistor Tr13 can be represented by formula (39).

$$Vgs=Vn11-Vn12=V1c-Voel=(Vd-\Delta Vgs)+\{(Cgs11+Cgd13)/(Cs+Cgs11+Cgd13)\}\times\{Cgd13\cdot Vcce/(Cgs11+Cgd13)-Voel-V\} \quad (39)$$

In formula (39), "V" is the same as that shown in formula (32b) for which V=Vd+(Cgs11'·Cs/D)·Vshl is established and "Vd" is a voltage generated between the gate and the source of the transistor Tr13 during the writing operation for which (Vd+(Cgs11'·Cs)·Vshl/D) is established as shown in formula (32b). The voltage shift ΔVgs in formula (39) is a potential difference between the contact point N11 and the contact point N12 when FIG. 31A is switched to FIG. 31B and is represented by Cgs11'·Cpix·Vshl/D as shown in formula (34).

The following section describes, based on formula (39), an influence by the threshold voltage Vth on the gate-source voltage Vgs of the transistor Tr13 for light-emission driving. In formula (39), values of ΔVgs, V, and D are substituted to obtain formula (40).

$$Vgs=\{Cs/(Cs+Cgs11+Cgd13)\}\cdot Vd+\{(Cgs11+Cgd13)/(Cs+Cgs11+Cgd13)\}\times\{Cgd13\cdot Vcce/(Cgs11+Cgd13)-Voel-Cgs11'\cdot Vshl/(Cgs11+Cgd13)\} \quad (40)$$

In formula (40), the respective capacity components Cgs11, Cgs11', and Cgd13 are normalized by the capacity component Cs to provide formula (41).

$$Vgs=\{Vd-(cgs+cgd)\cdot Voel\}/(1+cgs+cgd)+\{cgd\cdot Vcce-cgs'\cdot Vshl\}/(1+cgs+cgd) \quad (41)$$

In formula (41), cgs, cgs', and cgd are the same as those shown in formula (27). In formula (41), the first term of the right-hand side depends only on the specified gradation level based on the display data and the threshold voltage Vth of the transistor Tr13. In formula (41), the second term of the right-hand side is a constant added to the gate-source voltage Vgs of the transistor Tr13.

In order to compensate the threshold voltage Vth by specifying a voltage, the source potential during a writing operation (potential of contact point N12)−Vd may be set so that a value (Vgs−Vth) during light emission (a value determining the driving current Ioel during light emission) does not depend on the threshold voltage Vth. For example, when gate-source voltage Vgs=0−(−Vd)=Vd is maintained during light emission, (Vgs−Vth) can be prevented from depending on Vth by establishing the relationship of Vgs=Vd=Vd0+Vth. Then, the driving current Ioel during light emission is represented only by Vd0, and thus not depending on Vth. When the gate-source voltage during light emission varies from Vgs during a writing operation, a relationship of Vd=Vd0+εVth may be used.

In formula (41), the dependence of the organic EL element OLED on the light-emitting voltage Voel in the first term of the right-hand side is determined so as to establish the relationships of formulas (42a)-(42c). The functions f(x), g(x), and h(x) in formulas (42a) to (42c) are functions of a variable "x" in the parentheses, respectively. Specifically, the gate-source voltage Vgs of the transistor Tr13 is determined to be a function of the light-emitting voltage Voel as shown in formula (42a). The light emission driving current Iem is determined to be a function of a difference between this voltage Vgs and the threshold voltage Vth (Vgs−Vth) as shown in formula (42b). The light-emitting voltage Voel is also determined to be a function of the light emission driving current Iem as shown in formula (42c).

$$Vgs=f(Voel) \quad (42a)$$

$$Iem=g(Vgs-Vth) \quad (42b)$$

$$Voel=h(Iem) \quad (42c)$$

During the writing operation, a data voltage for giving a voltage based on display data (gradation level voltage) to the source of the driving transistor Tr13 (contact point N12) is Vd0. This data voltage Vd0 is a term that does not depend on the threshold voltage Vth as described above. The threshold voltage of the transistor Tr13 at a time Tx is Vth(Tx) and the threshold voltage at a time Ty after the time Tx is Vth(Ty). A voltage Voelx is applied at the time Tx between the anode and the cathode of the organic EL element OLED during the light-emitting operation and a voltage Voely is applied between the anode and the cathode at the time Ty.

Voltages satisfying a condition of Vth(Ty)>Vth(Tx) and a difference between the voltages applied to the organic EL element OLED at the time Ty and the time Ty are represented by ΔVoel=Voely−Voelx. In order to compensate the variation ΔVth in the threshold voltage, Vth may be compensated to cause the ΔVoel to be as close to 0 as possible. Thus, the voltage Vd of the first term of the right-hand side in formula (41) may be determined from formula (43).

$$Vd=Vd0+(1+cgs+cgd)\cdot\Delta Vth \tag{43}$$

In formula (43), when assuming that the variation ΔVth is a difference from the threshold voltage Vth=0V, ΔVth=Vth can be represented. Since (cgs+cgd) is a design value, when the constant ϵ is defined as ϵ=1+cgs+cgd, the voltage Vd shown in the formula (43) is replaced by formula (44). Based on formula (44), the above-described formulas (24) and (25) are introduced.

$$Vd\equiv Vd0+(1+cgs+cgd)\cdot\Delta Vth=Vd0+\epsilon\cdot\Delta Vth \tag{44}$$

The formulas (41) and (44) can be used to derive formula (45) showing a voltage relationship not depending on the threshold voltage Vth of the transistor Tr13. Voel0 in formula (45) is the light-emitting voltage Voel of the organic EL element OLED when the threshold voltage Vth=0V.

$$Vgs-Vth=\{Vd0-(cgs+cgd)\cdot Voel0\}/(1+cgs+cgd)+(cgd\cdot Vcce-cgs'\cdot Vshl)/(1+cgs+cgd) \tag{45}$$

In the black display status as the 0th gradation level, conditions for preventing a voltage equal to or greater than the threshold voltage Vth from being applied between the gate and the source of the transistor Tr13 (i.e., voltage conditions for preventing the light emission driving current Iem from flowing in the organic EL element OLED) are calculated. The conditions are represented by formula (46) when the data voltage at the time 0 is Vd0(0). Thus, in the data driver 14 shown in FIG. 26, the black gradation level voltage Vzero applied to an output end of the inversion calculator 148 via the changing-over switch SW5 can be determined.

$$-Vd0(0)=Vzero\geqq cgd\cdot Vcce-cgs'\cdot Vshl \tag{46}$$

Conditions for setting or determining the compensated gradation level voltage Vpix(=−Vin) so as to compensate the gate-source voltage Vgs of the driving transistor Tr13 due to parasitic capacitance will now be described. By performing the respective steps shown in FIG. 11, the gate-source voltage Vgs of the driving transistor Tr13 varies due to other parasitic capacitances. In order to compensate the variation amount of this voltage Vgs, the compensated gradation level voltage Vpix in the writing period Twrt (a period during which the compensated gradation level voltage Vpix is applied) may be set or determined by formula (47). Vds12 in formula (47) is a drain-source voltage of the transistor Tr12.

$$Vpix=-(Vd+Vds12)=-Vorg-\beta Vth \tag{47}$$

Figure 34:
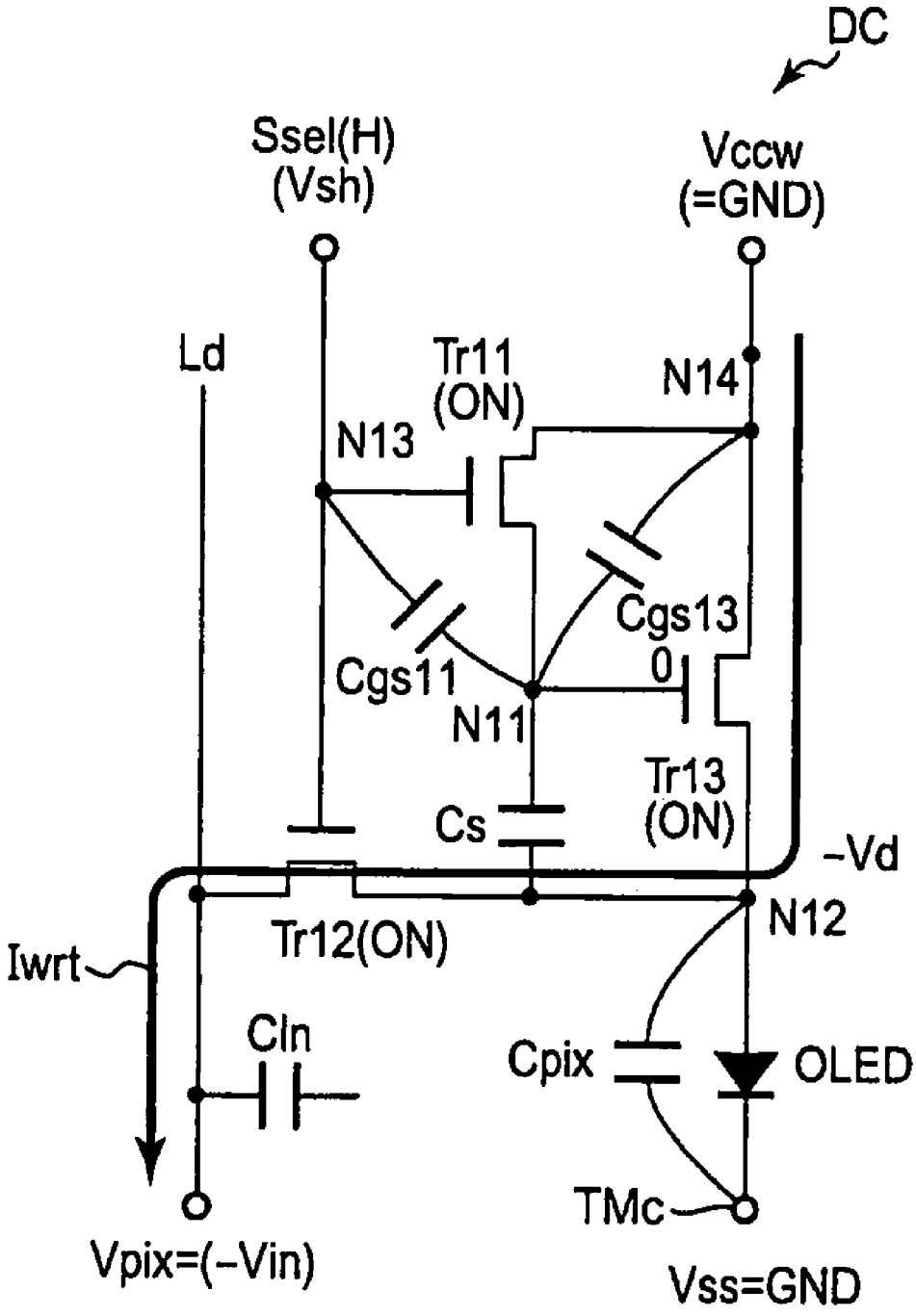
FIG. 34 illustrates a voltage in the equivalent circuit during a writing operation.

During the writing operation shown in FIG. 34, the writing current Iwrt flowing between the drain and the source of the transistor Tr13 can be represented by formula (48). Variable μFET in formula (48) represents a transistor mobility, Ci represents a transistor gate capacity per a unit area, W13 represents a channel width of the transistor Tr13, and L13 represents a channel length of the transistor Tr13. Variable Vdse13 is an effective drain-source voltage of the transistor Tr13 during a writing operation and Vth13 is a threshold voltage of the transistor Tr13. The variable "p" represents a unique parameter (fitting parameter) suitable for the characteristic of the thin film transistor.

$$Iwrt=\mu FET\cdot Ci\cdot(Vd-Vth13)\cdot Vdse13\cdot(W13/L13)\equiv p\cdot\mu FET\cdot Ci\cdot(Vd-Vth13)\cdot(W13/L13) \tag{48}$$

During a writing operation, the writing current Iwrt flowing between the drain and the source of the transistor Tr12 can be represented by t formula (49). In formula (49), variable Vth12 is a threshold voltage of the transistor Tr12 and a Vds12 is a drain-source voltage of the transistor Tr13. Variable W12 is a channel width of the transistor Tr12 and L12 is a channel length of the transistor Tr12.

$$Iwrt=\mu FET\cdot Ci\cdot(Vsh+Vd+Vds12-Vth12)\cdot(W12/L12)\cdot Vdse12 \tag{49}$$

The drain-source voltage Vdse12 of the transistor Tr12 can be represented by formula (50a) derived from formulas (48) and (49). In formula (50a), Vsat12 is an effective drain-source voltage of the transistor Tr12 during a writing operation and is represented by formula (50b). Variable "q" is a unique parameter (fitting parameter) suitable for the characteristic of the thin film transistor.

$$Vdse12=Vds12/\{1+(Vds12/Vsat12)q\}(1/q) \tag{50a}$$

$$Vsat12=p\cdot(Vsh+Vd+Vds12-Vth12) \tag{50b}$$

Generally, in an n-channel amorphous silicon transistor, the longer the time during which the transistor is in an ON status (a time during which the gate-source voltage is a positive voltage), the larger the shift of the threshold voltage to a higher voltage. The driving transistor Tr13 is ON during the light-emitting period Tem. This light-emitting period Tem occupies a large part of the cycle period Tcyc. Thus, the threshold voltage of the transistor Tr13 shifts to the positive voltage as time passes and thus the transistor Tr13 has higher resistance.

On the other hand, the selection transistor Tr12 is ON only during the selection period Tsel. This selection period Tsel occupies a small part of the cycle period Tcyc. Thus, when compared with the driving transistor Tr13, the selection transistor Tr12 has a smaller temporal shift. When the compensated gradation level voltage Vpix is introduced, the variation in the threshold voltage Vth12 of the transistor Tr12 can be ignored with regards to the variation in the threshold voltage Vth13 of the transistor Tr13.

From formulas (48) and (49), it can be seen that the writing current Iwrt is determined based on a Thin Film Transistor (TFT) characteristic fitting parameter (e.g., p, q), a parameter determined by a transistor size, a process parameter (e.g., transistor gate thickness, amorphous silicon mobility), and a set value owned by the selection signal (e.g., voltage Vsh). Thus, an equation when Iwrt shown in formula (48) is equal to Iwrt shown in formula (49) is subjected to numerical analysis to calculate the drain-source voltage Vds12 of the transistor Tr12. This voltage Vds12 has a relationship shown in formula (47) (Vpix=−Vd−Vds12) with the compensated gradation level voltage Vpix. Thus, Vds12 can be determined to calculate the compensated gradation level voltage Vpix.

When the inversion calculator 148 outputs this compensated gradation level voltage Vpix during the writing period Twrt, −Vd is written to the source of the transistor Tr13 (contact point N12). Thus, the transistor Tr13 during the writing period Twrt has a gate-source voltage of Vgs to establish the drain-source voltage Vds=0−(−Vd)=Vd0+ϵ·ΔVth. By allowing the flow of the writing current Iwrt as described above, the driving current Ioled for which the shift of the threshold voltage Vth due to an influence by parasitic capacitance for example is compensated can flow in the organic EL element OLED during the writing period Twrt.

The following section describes the display apparatus 1 according to the second embodiment and an effect by the driving method of the display apparatus 1 with reference to a specific test result. The potential (−Vd) at the source (contact point N12) of the driving transistor Tr13 during a writing operation is set based on the data voltage Vd0 and a multiple of the threshold voltage Vth by a fixed number (multiple of y) as shown in formula (24) (−Vd=−Vd0−γVth). This potential is set based on the voltage Vgs retained between the gate and the source. On the other hand, the compensated gradation level voltage Vpix(=−Vin) generated by the data driver 14 (inversion calculator 148) is set based on the original gradation level voltage Vorg and a multiple of the threshold voltage Vth by a fixed number (multiple of β) (−Vin=−Vorg−βVth) as shown in formula (22).

Figure 35:
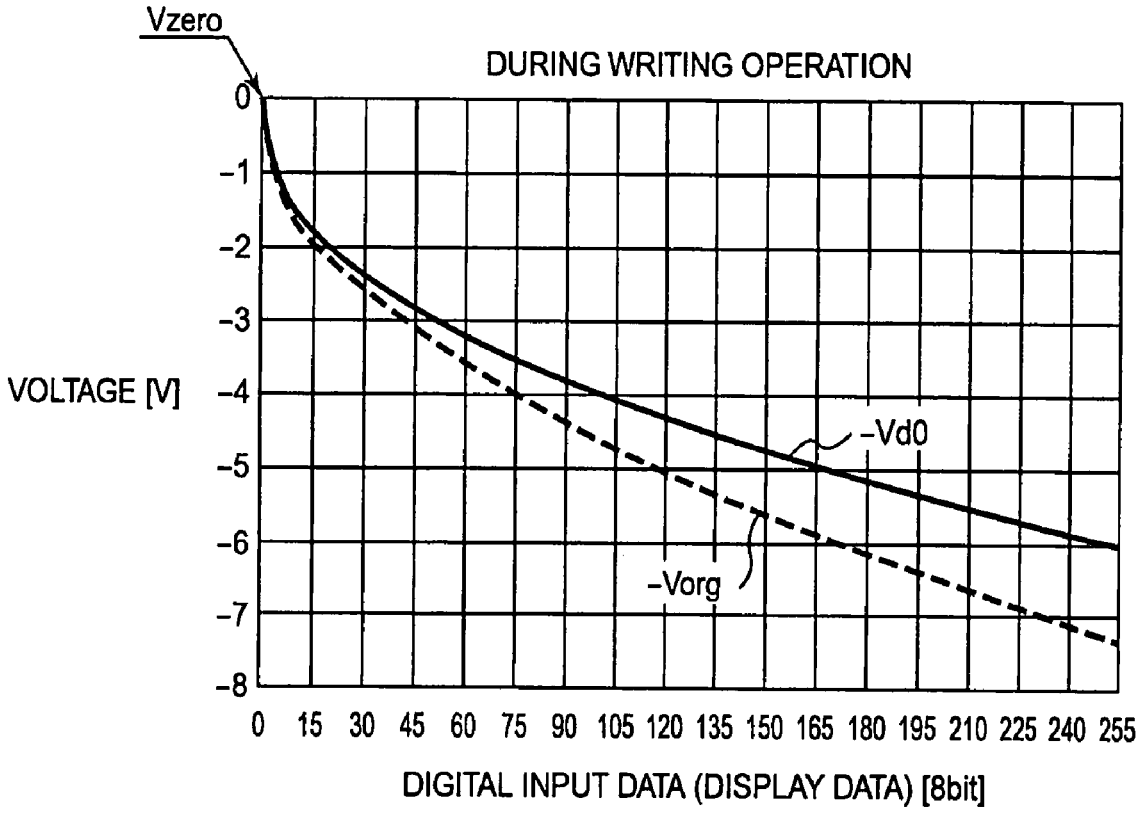
FIG. 35 illustrates a relationship between input data and a data voltage and an original gradation level voltage in a writing operation.

The following section examines conditions required for the relationship between the data voltage Vd0 and the original gradation level voltage Vorg to not depend on the constants γ or β and the threshold voltage Vth. As shown in FIG. 35, during the writing operation, the higher input data (specified gradation level) of the original gradation level voltage Vorg is, the wider the difference between the data voltage Vd0 for giving a voltage depending on display data (gradation level voltage) to the source of the driving transistor Tr13 and the original gradation level voltage Vorg (Vd0−Vorg). For example, in the 0th gradation level (black display status), the data voltage Vd0 and the original gradation level voltage Vorg are both Vzero(=0 V). On the other hand, at the $255^{th}$ gradation level (the highest gradation level), a difference between the data voltage Vd0 and the original gradation level voltage Vorg (Vd0−Vorg) is about 1.3 V. This is due to a fact that, the higher the applied compensated gradation level voltage Vpix is, the higher the writing current Iwrt is and a transistor Tr13 also has a higher source drain voltage.

The example of FIG. 35 shows the power source voltage Vcc(=Vccw) during the writing operation of the ground potential GND(=0 V) and the power source voltage Vcc (=Vcce) during the light-emitting operation of 12 V. A potential difference (voltage range) Vshl between the high level (Vsh) and the low level (−Vsl) of the selection signal Ssel is 27 V. The transistor Tr13 for light emission driving has a channel width W13 of 100 μm and the transistor Tr11 and transistor Tr12 have channel widths W11 and W12, respectively, of 40 μm. The display pixel PIX has a size of 129 μm×129 μm, the pixel has an aperture ratio of 60%, and the capacitor Cs has capacitance of 600 fF (=0.6 pF).

Figure 36:
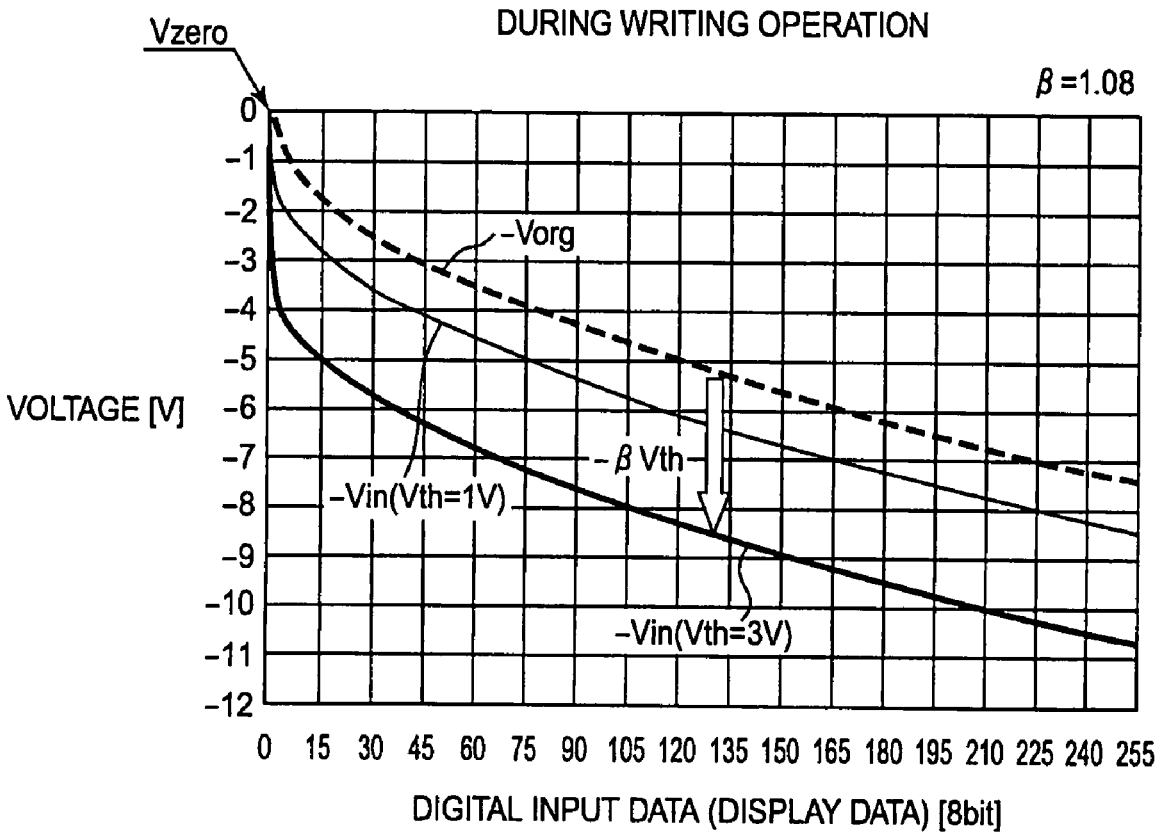
FIG. 36 illustrates a relationship between input data and a compensated gradation level voltage and a threshold voltage in a writing operation.

The following section describes a relationship between the compensated gradation level voltage to input data and the threshold voltage during a writing operation. As shown in formula (22), the compensated gradation level voltage Vpix (=−Vin) depends on the constant β and the threshold voltage Vth. When this constant β is fixed, the higher the threshold voltage Vth, the lower the compensated gradation level voltage Vpix by this threshold voltage Vth as shown in FIG. 36. This tendency is found in substantially all gradation level zones of the input data (specified gradation level).

In the example of FIG. 36, when the constant β=1.08 is set and the threshold voltage Vth is changed in an order of 0 V, 1 V, and 3 V, the characteristic line of the compensated gradation level voltage Vpix to the respective threshold voltages Vth substantially translates in the low voltage direction. At the 0th gradation level (black display status), the compensated gradation level voltage Vpix is Vzero (=0 V) regardless of the value of the threshold voltage Vth. The test conditions of FIG. 36 are the same as those shown in FIG. 35.

Figure 37A:
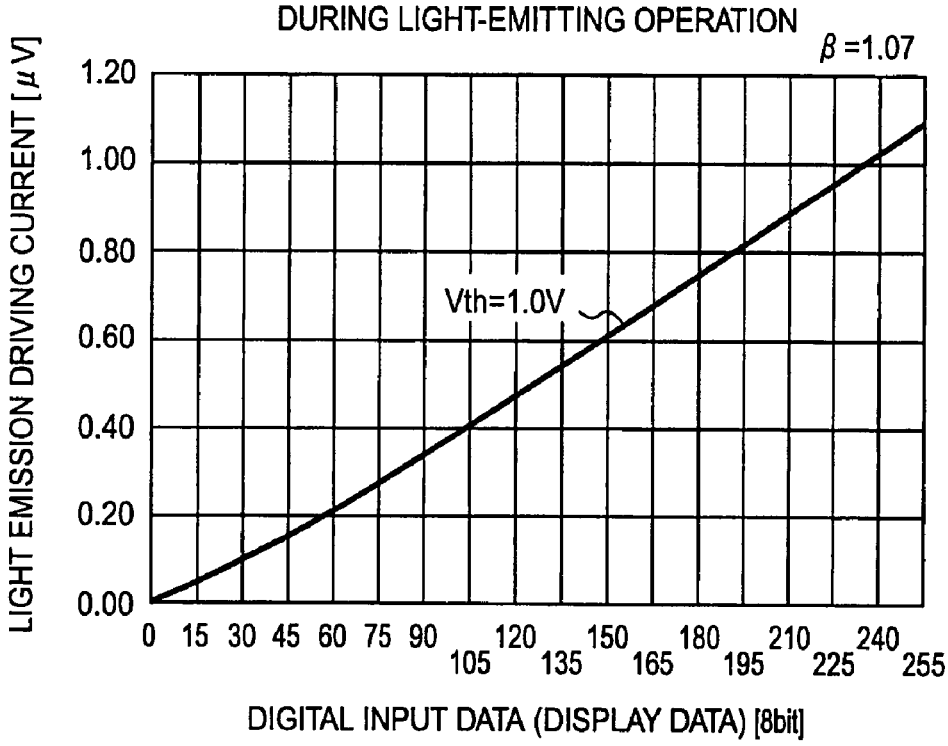
FIG. 37A illustrates a first example of a relationship between input data and a light emission driving current and a threshold voltage in a light-emitting operation.
Figure 37B:
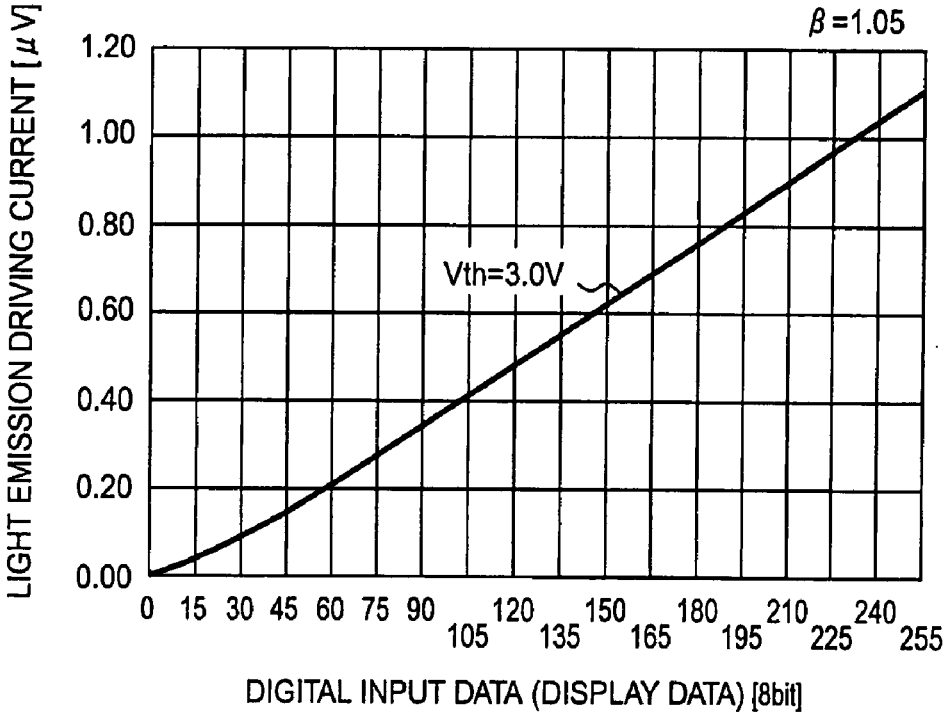
FIG. 37B illustrates a second example of a relationship between input data and a light emission driving current and a threshold voltage in a light-emitting operation.

The following section describes a relationship between the light emission driving current Iem of the organic EL element OLED and the threshold voltage Vth with regard to input data in a light-emitting operation. Input data has 256 gradation levels among which the lowest gradation level are the 0th gradation level and the highest gradation level are the 255th gradation level. The compensated gradation level voltage Vpix shown in formula (22) is applied from the data driver 14 to the respective display pixels PIX. As a result, the writing voltage Vgs(=0−(−Vd)=Vd0+γVth) shown in formula (24) is applied between the gate and the source of the driving transistor Tr13. When the constant γ is substantially fixed, the light emission driving current Iem having a substantially fixed current value flows in the organic EL element OLED regardless of the value of the threshold voltage Vth as shown in FIGS. 37A and 37B. This tendency is found in substantially all gradation level zones of input data (specified gradation level). The test conditions of FIGS. 37A and 37B are the same as those shown in FIG. 35.

FIG. 37A shows a test result when the constant γ=1.07 and the threshold voltage Vth=1.0 V. FIG. 37B shows a test result when the constant γ=1.05 and the threshold voltage Vth=3.0 V are set. When FIG. 37A is compared with FIG. 37B, the light emission driving current Iem shows substantially the same characteristic line regardless of different values of the threshold voltages Vth.

These test results also show that a brightness change (difference in brightness) to theoretical value is suppressed to 1.3% or less in substantially all gradation levels (hereinafter this suppression effect is called as "γ effect"). When γ=1.07 was established as shown in FIG. 37A for example and when the respective specified gradation levels (8 bit) were 63, 127, and 255, the respective brightness changes were 0.27%, 0.62%, and 1.29%. When γ=1.05 was established as shown in FIG. 37B and when the respective specified gradation levels (8 bit) were 63, 127, and 255, the respective brightness changes were 0.27%, 0.61%, and 1.27%.

The following section describes a relationship between light emission driving current to input data and variation in the threshold voltage (shift) in a light-emitting operation. It was found that, with regard to the dependency of "γ effect" on the variation amount of the threshold voltage Vth (Vth shift width), when the constant γ was constant, the higher variation width the threshold voltage Vth has, the smaller difference in current to the light emission driving current Iem in the initial threshold voltage Vth.

Figure 38A:
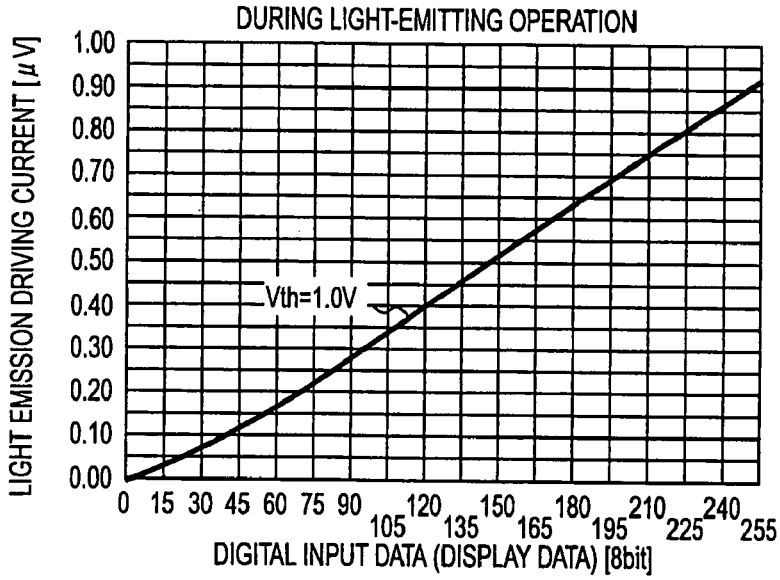
FIG. 38A illustrates a first example of a relationship between the input data and the light emission driving current and variation in the threshold voltage in a light-emitting operation.
Figure 38B:
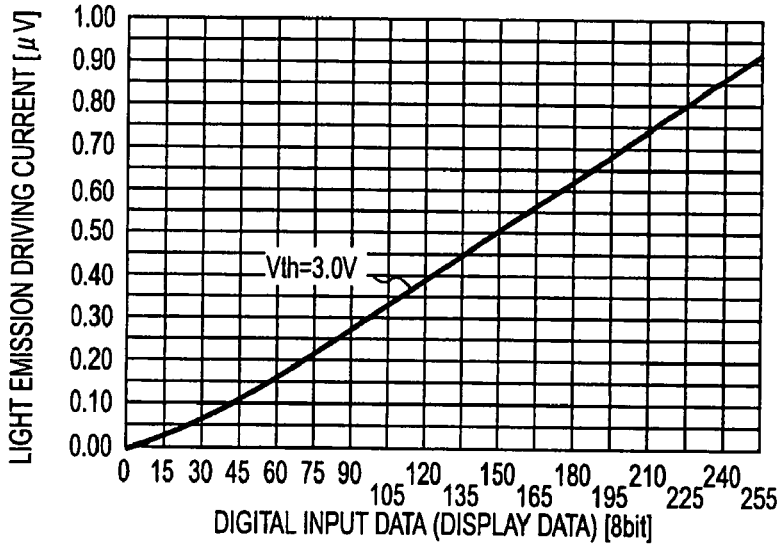
FIG. 38B illustrates a second example of a relationship between the input data and the light emission driving current and variation in the threshold voltage in a light-emitting operation.
Figure 38C:
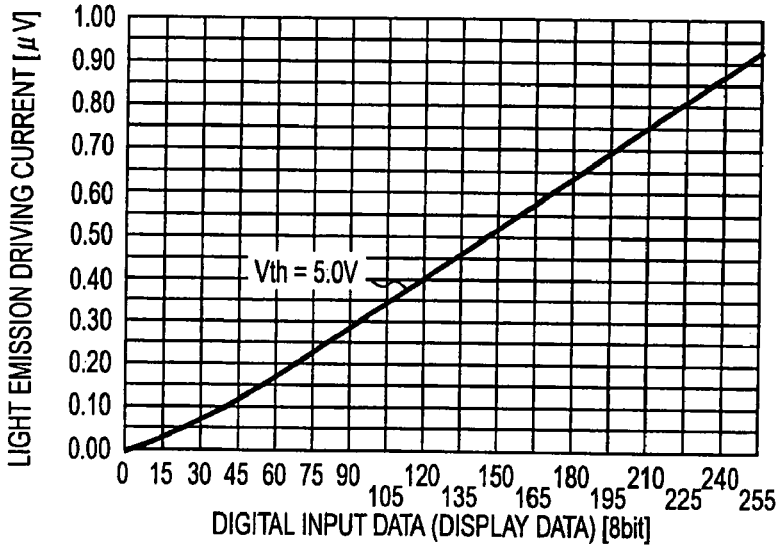
FIG. 38C illustrates a third example of a relationship between the input data and the light emission driving current and variation in the threshold voltage in a light-emitting operation.

As shown in FIGS. 38A and 38B, when γ=1.1 and Vth was changed from 1 V to 3 V (Vths shift width was 2 V) and when the respective specified gradation levels (8 bit) were 63, 127, ad 255, the respective brightness changes were 0.24%, 0.59%, and 129%. As shown in FIGS. 38A and 38C, when γ=1.1 and Vth was changed from 1V to 5V(Vth shift width was 4 V) and when the specified gradation levels (8 bit) were 63, 127, and 255, the respective brightness changes were 0.04%, 0.12%, and 0.27%.

By analyzing the above result, it was found that the higher variation amount (Vth shift width) the threshold voltage Vth has, the characteristic line is closer to a theoretical value. Specifically, it was found that a brightness change (difference in brightness) to the theoretical value could be reduced (or suppressed to about 0.3% or less).

Figure 39A:
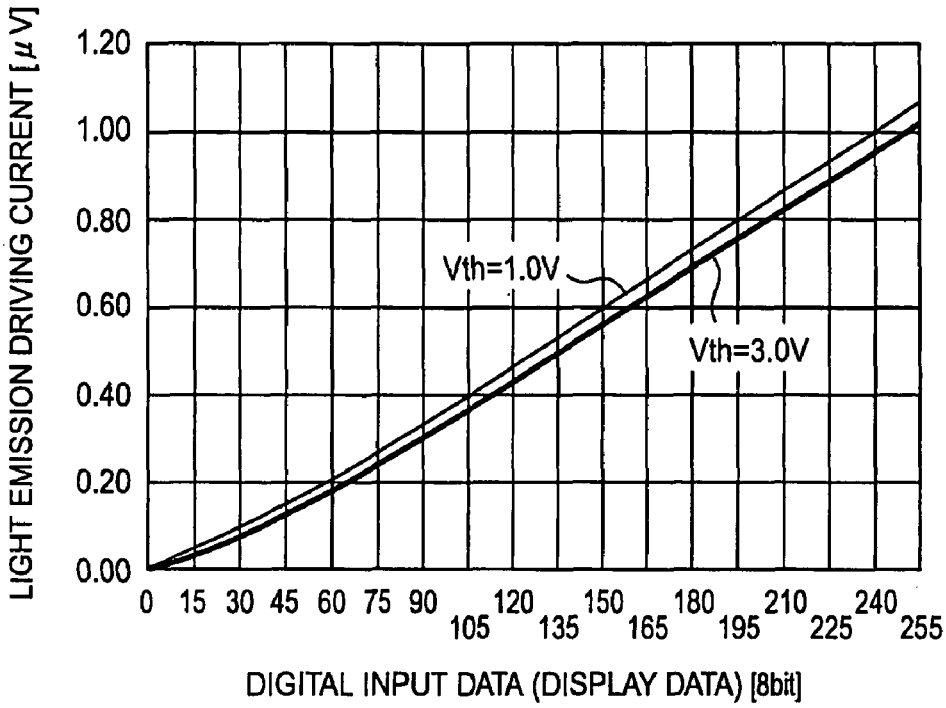
FIG. 39A illustrates a first example of the relationship between the input data and the light emission driving current and the threshold voltage when a "γ effect" is not provided.
Figure 39B:
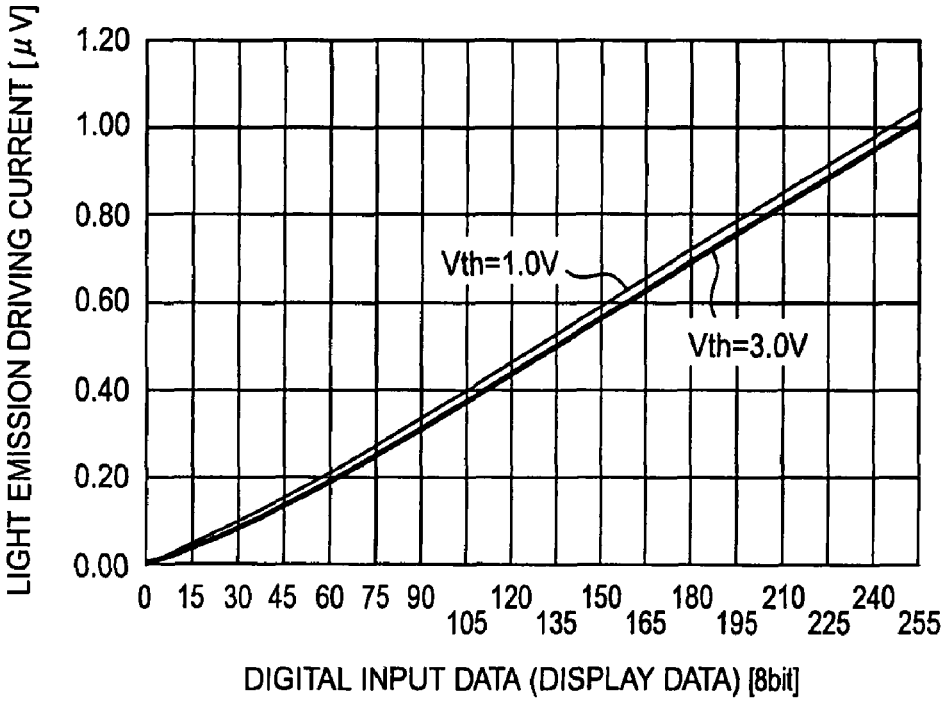
FIG. 39B illustrates a second example of the relationship between the input data and the light emission driving current and the threshold voltage when a "γ effect" is not provided.

In order to show the advantage of the effect obtained in this embodiment, the above-described test result having the "γ effect" was compared with a test result not having the "γ effect". The test result not having the "γ effect" is obtained by driving applying such a voltage Vth between the gate and the source of the transistor Tr13 that does not depend on the constant γ in formula (24) (Vgs=0−(−Vd)=Vd0+γVth). As shown in FIGS. 39A and 39B, in the case of the test result not having the "γ effect", a relationship between input data and the light emission driving current and the threshold voltage showed a characteristic line according to which, regardless of the constant γ, the higher threshold voltage Vth the transistor Tr13 had, the light emission driving current Iem was smaller. FIG. 39A shows the characteristic line of the light emission driving current Iem when the constant γ=1.07 is set and the threshold voltage Vth=1.0 V and 3.0 V is set. FIG. 39B shows the characteristic line of the light emission driving current Iem when the constant γ=1.05 is set and the threshold voltage Vth=1.0 V and 3.0 V is set.

In substantially all gradation level zones, a brightness change to theoretical value (difference in brightness) was at least 1.0% and a brightness change to theoretical value was at least 2% in an intermediate gradation level (the $127^{th}$ gradation level in the examples of FIGS. 39A and 39B) in particular. When γ=1.07 and when the respective specified gradation levels (8 bit) were 63, 127, and 255, the respective brightness changes were 1.93%, 2.87%, and 4.13%. When γ=1.05 and when the respective specified gradation levels (8 bit) were 63, 127, and 255, the respective brightness changes were 1.46%, 2.09%, and 2.89%.

This brightness change reaches about 2% in the intermediate gradation level, a user recognizes the change as a printed image. Thus, when a voltage Vgs not depending on the constant γ (writing voltage; −Vd=−Vd0−Vth) is retained in the capacitor Cs, the display picture has a deteriorated, inferior quality. On the other hand, in the second embodiment, a voltage retained in the capacitor Cs is a writing voltage for which the constant γ is compensated (=0−(−Vd)=Vd0+γVth). Thus, as shown in FIGS. 37A, 37B, 38A, 38B and 38C, a brightness change to theoretical value (difference in brightness) at the respective gradation levels can be significantly suppressed. The display apparatus 1 of this embodiment can therefore prevent an image from being printed to display the image with preferred display picture quality.

The following section describes a relationship between the compensated gradation level voltage Vpix and the gate-source voltage Vgs of the transistor Tr13. The source of the transistor Tr13 (contact point N12) and the data line Ld have therebetween a potential difference due to resistance when the transistor Tr12 is ON. Thus, the contact point N12 retains a voltage obtained by adding the data voltage Vd0 to a voltage obtained by multiplying the threshold voltage Vth of the transistor Tr13 with γ. By retaining this voltage, such a voltage is retained as the compensated gradation level voltage Vpix at the contact point N12 obtained by adding the original gradation level voltage Vorg to a voltage β times higher than the threshold voltage Vth, as shown in formula (22).

The following section examines, in the relationship between the compensated gradation level voltage Vpix and the gate-source voltage Vgs of the transistor Tr13 shown in formulas (22) and (24), a change γVth of Vgs(=Vd) when βVth is OFFSET to Vpix(=Vin).

Figure 40:
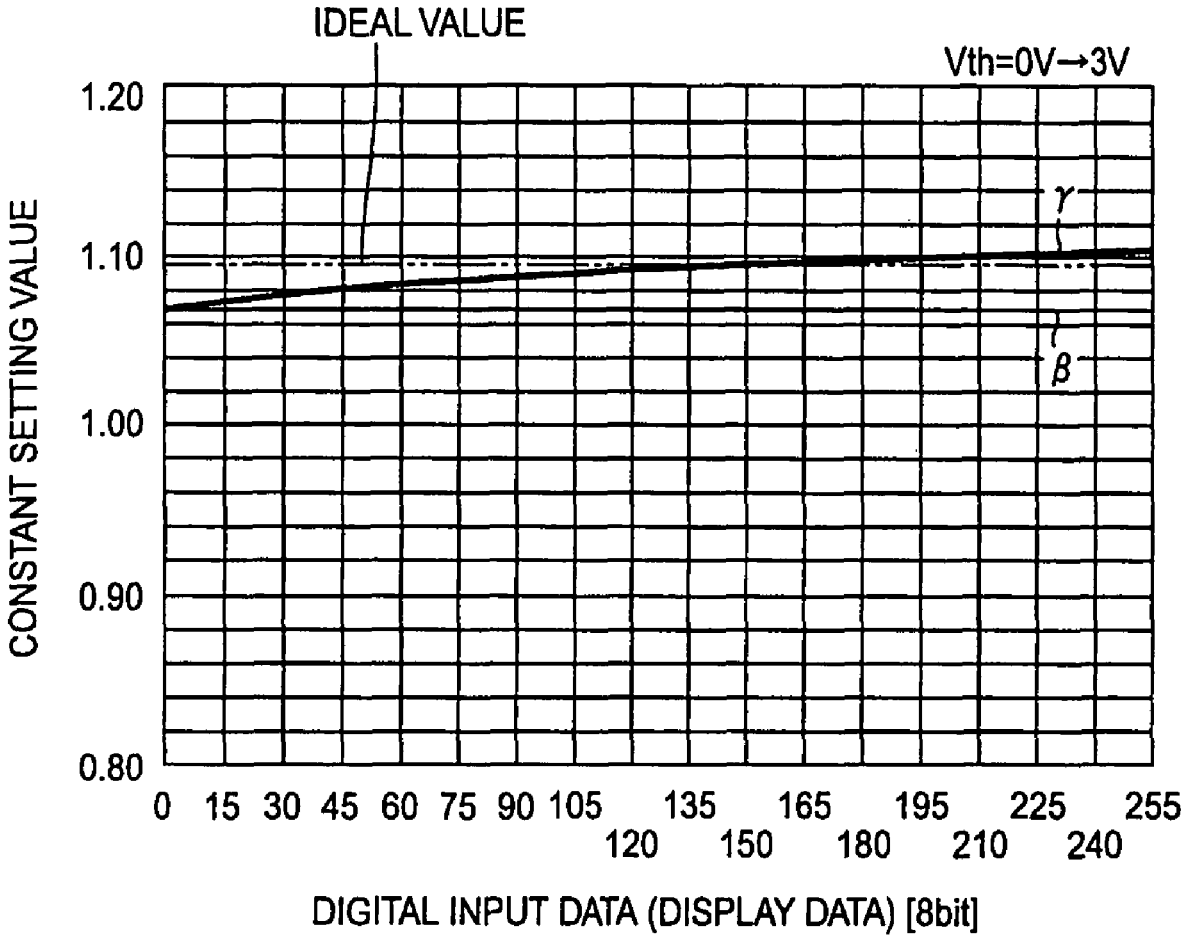
FIG. 40 illustrates a relationship between a constant and input data set to cause the effect of the present invention.

As shown in FIG. 40, when the threshold voltage Vth changes from 0 V to 3 V, the constant β determining the compensated gradation level voltage Vpix is fixed to the input data (specified gradation level). On the other hand, the constant γ determining the gate-source voltage Vgs of the transistor Tr13 changes to have a substantially fixed slope with regard to the input data (specified gradation level). In the example of FIG. 40, γ=1.097 may be set for β=1.08 in the intermediate gradation level (which is in the vicinity of the $128^{th}$ gradation level when the number of gradation levels are 256) so that the constant γ has an ideal value (which is shown by a dotted line in FIG. 40). Since the constant β and the constant γ can be set to relatively close values, β=γ may be set for a practical use.

In consideration of the above test results, a constant γ(=β) for determining the gate-source voltage Vgs of the driving transistor Tr13 is preferably at least 1.05. The compensated gradation level voltage Vpix may be set so that the voltage Vd retained in the source (contact point N12) of the transistor Tr13 in at least one gradation level of input data (specified gradation level) is the voltage (−Vd0−γVth) shown in formula (24).

Furthermore, the dimension of the transistor Tr13 (a ratio W/L between the channel width W and the channel length L) and the voltage of the selection signal Ssel (Vsh and −Vsl) are preferably set so that a change in the light emission driving current Iem in accordance with variation in the threshold voltage (Vth shift) is within about 2% of the maximum current value in an initial status.

The compensated gradation level voltage Vpix is a value obtained by adding the drain-source voltage of the transistor Tr12 to the source potential (−Vd) of the transistor Tr13. A larger absolute value of the difference between the power source voltage Vccw and the compensated gradation level voltage Vpix (Vccw−Vpix) causes the current flowing between the drain and the source of each of the transistors Tr12 and Tr13 during the writing operation to have a higher value. This causes an increased potential difference between the compensated gradation level voltage Vpix and the source potential (−Vd) of the transistor Tr13.

However, when the effect on the voltage drop by the drain-source voltage of the transistor Tr12 is reduced, an effect β times higher than the threshold voltage Vth directly appears in the "γ effect". Specifically, if the OFFSET voltage γVth that can satisfy formula (24) can be set, variation in the value of the light emission driving current Iem when the writing operation status shifts to the light-emitting operation status can be compensated. In this case, an influence by the drain-source voltage of the transistor Tr12 must be considered.

As shown in FIG. 35, the transistor Tr12 is designed so that the drain-source voltage of the transistor Tr12 is about 13 V at the maximum gradation level (the maximum drain-source voltage) in the writing operation. In this case, as can be seen from FIG. 40, a difference between a constant γ(≅1.07) at the lowest gradation level (the 0th gradation level) and a constant γ(≅1.11) at the highest gradation level (the 255th gradation level) is sufficiently small. Thus, the difference can be approximated to β shown in formula (22).

The voltage Vd0 of the gate-source voltage Vgs of the transistor Tr13 of a difference between the power source voltage Vccw and the compensated gradation level voltage Vpix (Vccw−Vpix) is the original gradation level voltage Vorg. The compensated gradation level voltage Vpix is set to a voltage obtained by adding the OFFSET voltage βVth to the original gradation level voltage Vorg to have a negative polarity. During the writing operation, this compensated gradation level voltage Vpix is set to satisfy formula (22). In this case, the maximum voltage between the drain and the source of the transistor Tr12 can be appropriately set to approximate the constant γ to the constant β. As a result, the respective gradation levels can be accurately displayed in a range from the lowest gradation level to the highest gradation level.

Figure 41:
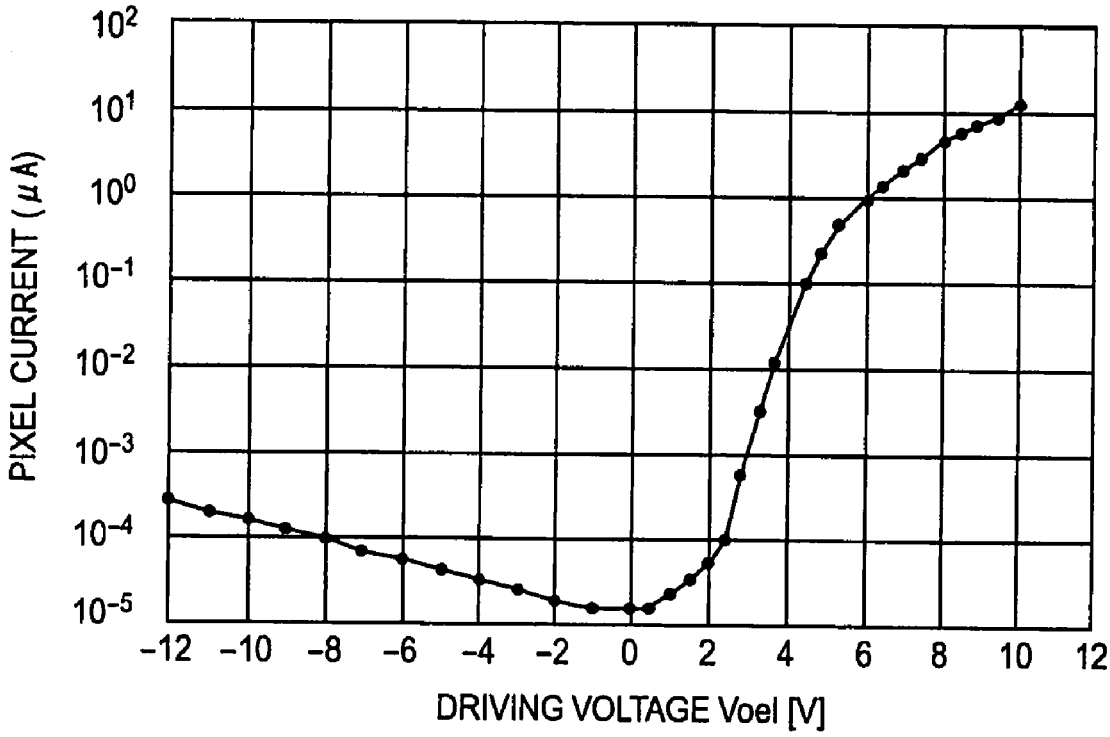
FIG. 41 illustrates a relationship between a voltage and a current of the organic EL element used for a test for checking the effect of the present invention.

The following section describes the characteristic of the change of the pixel current to the driving voltage of the organic EL element OLED (having a pixel size of 129 μm×129 μm and an aperture ratio of 60%) used for the test. As shown in FIG. 41, the pixel current of this organic EL element OLED has a small current value on the order of $10\times10^{-3}$ μA to $10\times10^{-5}$ μA in a zone in which the driving voltage is a negative voltage. The pixel current also showed the lowest value when the driving voltage is about 0V and sharply increases with an increase of the driving voltage in a zone in which the driving voltage is a positive voltage.

The following section describes a relationship between the in-channel parasitic capacitance of a transistor applied to the display pixel PIX and the voltage. First, based on a Meyer capacity model generally referred to with regard to the parasitic capacitance of the thin film transistor TFT, a relationship between the capacity and the voltage (capacity characteristic) is shown under conditions under which the gate-source voltage Vgs is higher than the threshold voltage Vth (Vgs>Vth) (i.e., conditions under which a channel is formed between the source and the drain).

The in-channel parasitic capacitance Cch of the thin film transistor is classified to a gate-source parasitic capacitance Cgs_ch and a gate-drain parasitic capacitance Cgd_ch. A capacity ratio between the respective parasitic capacitances Cgs_ch and Cgd_ch and the in-channel parasitic capacitance Cch (Cgs_ch/Cch, Cgd_ch/Cch) has a predetermined characteristic with regard to a difference between the gate-source voltage Vgs and the threshold voltage Vth (Vgs−Vth).

Figure 42:
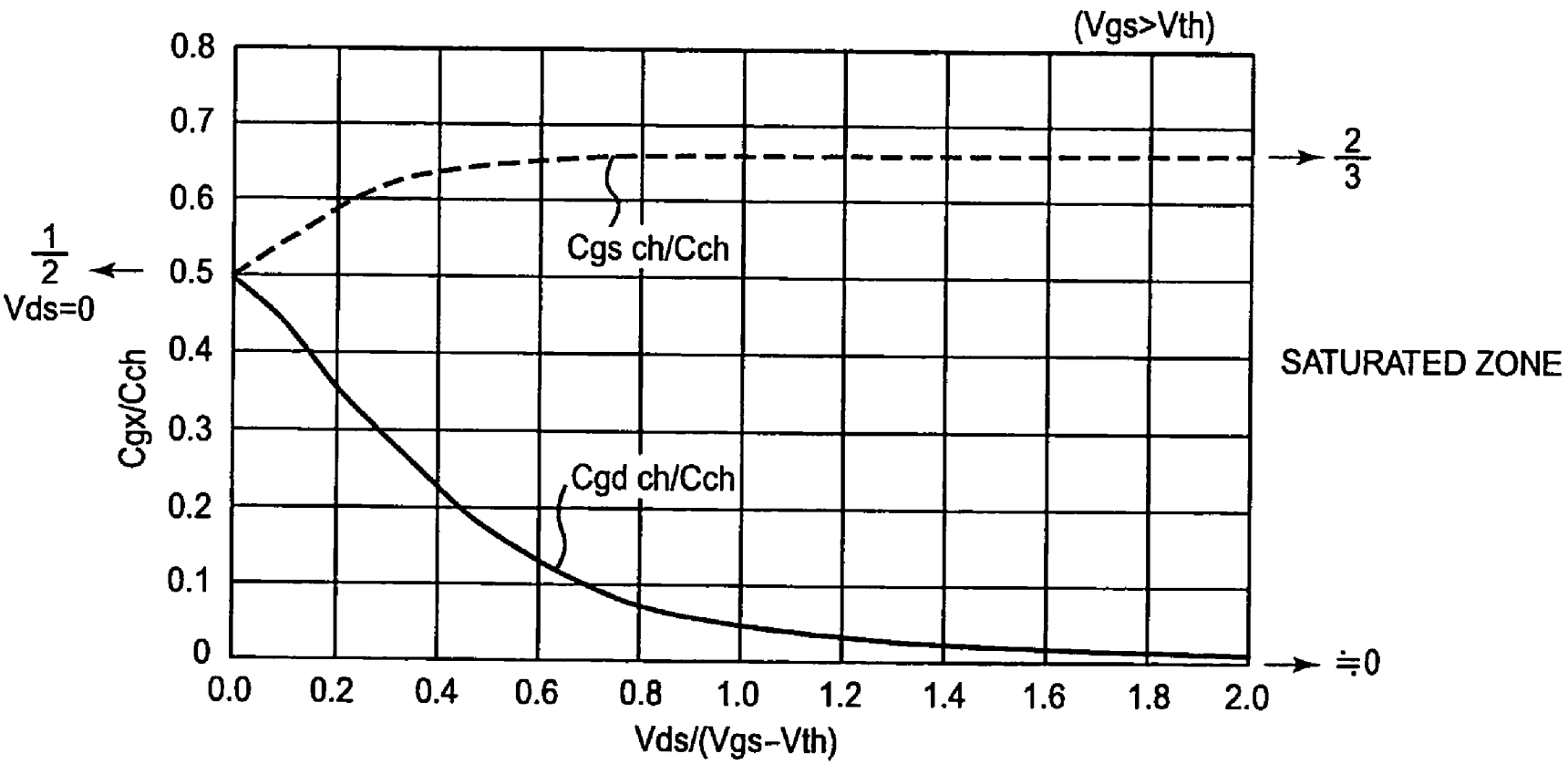
FIG. 42 illustrates a relationship between an in-channel parasitic capacitance and a voltage of a transistor used for a display pixel (pixel driving circuit).

As shown in FIG. 42, when the voltage ratio is 0 (the drain-source voltage Vds=0V), the capacity ratio Cgs_ch/Cch is equal to the capacity ratio Cgd_ch/Cch and both of the capacity ratios are ½. When the voltage ratio increases and the drain-source voltage Vds reaches the saturated zone, the capacity ratio Cgs_ch/Cch is about ⅔ and the capacity ratio Cgd_ch/Cch is asymptotic to 0.

As described above, in the second embodiment, the display apparatus 1 applies the compensated gradation level voltage Vpix having the voltage value shown in formula (50a) at the writing operation of the display pixel PIX. Thus, the voltage Vgs can be retained between the gate and the source of the transistor Tr13. This voltage Vgs corresponds to display data (gradation level values) and is set to compensate the effect of a voltage change in the pixel driving circuit DC so that the current value of the light emission driving current Iem supplied to the organic EL element OLED during a light-emitting operation can be compensated.

Specifically, the light emission driving current Iem having the current value corresponding to the display data flows in the organic EL element OLED. Thus, the organic EL element can be caused to emit light having a brightness depending on display data. This can suppress the dislocation of the gradation level in the respective display pixels to provide a display apparatus having a superior display quality. The second embodiment also can appropriately use a method for driving a display apparatus that is substantially the same as that of the first embodiment.

Various embodiments and changes may be made to the embodiments described above without departing from the broad spirit and scope of the invention. The above-described embodiments are intended to illustrate the present invention, not to limit the scope of the present invention. The scope of the present invention is shown by the attached claims rather than the embodiments. Various modifications made within the meaning of an equivalent of the claims of the invention and within the claims are to be regarded to be in the scope of the present invention.

What is claimed is:

1. A display apparatus, comprising:

a light-emitting element for emitting light having a gradation level depending on supplied current;

a pixel driving circuit for supplying the current to the light-emitting element depending on a voltage applied via a data line;

a precharge voltage source for applying a predetermined precharge voltage to the pixel driving circuit via the data line;

a voltage reader for reading the voltage of the data line a plurality of times with different timings in a predetermined transient response period after the application of the precharge voltage by the precharge voltage source; and a compensated gradation data signal generator for generating, based on a voltage difference among the voltages of the data line read at the different timings, a compensated gradation data signal having a voltage value corresponding to an element characteristic unique to the pixel driving circuit to apply the compensated gradation data signal to the pixel driving circuit.

2. The display apparatus according to claim 1, wherein:

the display apparatus includes an original gradation level voltage generator for generating an original gradation level voltage having a voltage value not depending on the element characteristic unique to the pixel driving circuit, and the original gradation level voltage is for causing the light-emitting element to emit light having a desired brightness corresponding to the gradation level.

3. The display apparatus according to claim 2, wherein:

the compensated gradation data signal generator generates the compensated gradation data signal based on the original gradation level voltage, a first compensation voltage generated based on the difference voltage, and a second compensation voltage determined based on the element characteristic unique to the pixel driving circuit.

4. The display apparatus according to claim 3, wherein:

the compensated gradation data signal generator comprises a calculation circuit for calculating the original gradation level voltage, the first compensation voltage, and the second compensation voltage to generate the compensated gradation data signal.

5. The display apparatus according to claim 1, wherein:

the display apparatus includes a black gradation level voltage source for applying, to the pixel driving circuit, a black gradation level voltage for causing the light-emitting element to perform a black display, and a switch for connecting the black gradation level voltage source to the data line at a predetermined timing.

6. The display apparatus according to claim 1, wherein:

the display apparatus includes a connection path switching switch for connecting the data line to the voltage reader, the compensated gradation data signal generator, and the precharge voltage source respectively with a predetermined timing.

7. The display apparatus according to claim 6, wherein:

the voltage reader is structured to read a plurality of times, after the precharge voltage is applied to the pixel driving circuit and the connection path switching switch is switched to block application of the precharge voltage by the precharge voltage source to the data line, the voltage of the data line with different timings within the transient response period, and the transient response period is shorter than a time required for the voltage of the data line to converge to a converge voltage value unique to the pixel driving circuit.

8. The display apparatus according to claim 7, wherein:

the precharge voltage source applies, when the connection switching switch is used to connect the precharge voltage source to the data line, the precharge voltage, and the precharge voltage has a voltage value having a higher absolute value than an absolute value of the converge voltage value unique to the pixel driving circuit.

9. The display apparatus according to claim 6, wherein:

the display apparatus further includes a controller for performing, within a predetermined period: (i) using the connection path switching switch to connect the precharge voltage source to the data line to apply the precharge voltage to the pixel driving circuit, (ii) using the connection path switching switch to connect the voltage reader to the data line to read, a plurality of times, the voltage of the data line corresponding to the element characteristic unique to the pixel driving circuit with different timings within the transient response period, and (iii) using the connection path switching switch to connect the compensated gradation data signal generator to the data line to apply the compensated gradation data signal to the pixel driving circuit.

10. The display apparatus according to claim 1, wherein:

the display apparatus includes: a selection driver for applying a selection signal to the pixel driving circuit via a selection line to cause the pixel driving circuit to be in a selected state, and a display panel in which a plurality of display pixels are arranged in a matrix manner, each of the plurality of display pixels including a pair of one said light-emitting element and one said pixel driving circuit, and wherein:

the plurality of display pixels are arranged in a row direction and a column direction, the data line is connected to the pixel driving circuits of a plurality of display pixels arranged in the column direction, and the selection line is connected to the pixel driving circuits of a plurality of display pixels arranged in the row direction.

11. The display apparatus according to claim 1, wherein:

the pixel driving circuit includes a driving transistor serially connected to the light-emitting element, and a variation amount of the element characteristic unique to the pixel driving circuit is a variation amount of a threshold voltage of the driving transistor.

12. The display apparatus according to claim 1, wherein the pixel driving circuit includes:

a driving transistor serially connected to the light-emitting element;

a selection transistor connected between the driving transistor and the data line; and a diode connection transistor for causing the driving transistor to be in a diode-connected state.

13. The display apparatus according to claim 12, wherein the pixel driving circuit is structured such that:

a first end of a current path of the driving transistor is connected with a power source voltage for which a potential is switched with a predetermined timing and a second end of the current path of the driving transistor is connected with a first end of the light-emitting element, a first end of a current path of the selection transistor is connected with the second end of the current path of the driving transistor and a second end of the current path of the selection transistor is connected with the data line, a first end of a current path of the diode connection transistor is connected with the power source voltage and a second end of the current path of the diode connection transistor is connected with a control terminal of the driving transistor, control terminals of the selection transistor and the diode connection transistor are connected to the selection line, and a second end of the light-emitting element is connected to a fixed reference voltage.

14. The display apparatus according to claim 11, wherein:

a voltage between a control terminal of the driving transistor and one terminal of a current path of the driving transistor is determined based on a sum of a first voltage component that does not depend on the element characteristic unique to the pixel driving circuit for causing the light-emitting element to emit light having a desired brightness corresponding the gradation level and a second voltage component that is at least 1.05 times the threshold voltage of the driving transistor.

15. The display apparatus according to claim 11, wherein:

a voltage retained between a control terminal of the driving transistor and one terminal of a current path of the driving transistor by the compensated gradation data signal that specifies a compensated gradation level is determined by a sum of a first voltage component that does not depend on the element characteristic unique to the pixel driving circuit for causing the light-emitting element to emit light having a desired brightness corresponding to the gradation level and a second voltage component that is higher than the threshold voltage of the driving transistor by a predetermined multiple.

16. The display apparatus according to claim 1, wherein the display apparatus includes: a selection driver for applying a selection signal to the pixel driving circuit via a selection line to cause the pixel driving circuit to be in a selected state, and a display panel in which a plurality of display pixels are arranged in a matrix manner, each of the plurality of display pixels including a pair of one said light-emitting element and one said pixel driving circuit, wherein the plurality of display pixels are arranged in a row direction and a column direction, the data line is connected to the pixel driving circuits of a plurality of the display pixels arranged in the column direction, and the selection line is connected to the pixel driving circuits of a plurality of the display pixels arranged in the row direction, wherein the pixel driving circuit includes a driving transistor serially connected to the light-emitting element, a selection transistor connected between the driving transistor and the data line, and a diode connection transistor for causing the driving transistor to be in a diode-connected state, and a variation amount of the element characteristic unique to the pixel driving circuit is a variation amount of a threshold voltage of the driving transistor, and wherein a driving current flowing in the light-emitting element via a current path of the driving transistor by the compensated gradation data signal and based on a voltage between a control terminal of the driving transistor and one terminal of the current path of the driving transistor is associated with an element size of the selection transistor and a voltage of the selection signal so that all gradation levels for causing the light-emitting element to emit light can cause a variation amount of a current value due to variation in the threshold voltage of the driving transistor that is within 2% of a maximum current value in an initial state under which the driving transistor has no variation in the threshold voltage.

17. The display apparatus according to claim 1, wherein:

the compensated gradation data signal generator generates, based on the voltage difference among the voltages of the data line read at the different timings and a voltage retained in the pixel driving circuit, the compensated gradation data signal having the voltage value corresponding to the element characteristic unique to the pixel driving circuit to apply the compensated gradation data signal to the pixel driving circuit.

18. A display apparatus, comprising:

a light-emitting element for emitting light having a gradation level depending on supplied current;

a pixel driving circuit for supplying the current to the light-emitting element depending on a voltage applied via a data line;

a precharge voltage source for applying a predetermined precharge voltage to the pixel driving circuit via the data line;

a voltage reader for reading the voltage of the data line a plurality of times with different timings in a predetermined transient response period after the application of the precharge voltage to the pixel driving circuit by the precharge voltage source; and a compensated gradation data signal generator for generating, based on a voltage difference among the voltages of the data line read at the different timings and a voltage retained in the pixel driving circuit, a compensated gradation data signal having a voltage value corresponding to a voltage characteristic unique to the pixel driving circuit to apply the compensated gradation data signal to the pixel driving circuit.

19. The display apparatus according to claim 18, wherein:

the display apparatus includes an original gradation level voltage generator for generating an original gradation level voltage having a voltage value not depending on the voltage characteristic unique to the pixel driving circuit, and the original gradation level voltage is for causing the light-emitting element to emit light having a desired brightness corresponding to the gradation level.

20. The display apparatus according to claim 19, wherein:

the compensated gradation data signal generator generates the compensated gradation data signal based on the original gradation level voltage and a compensation voltage generated based on the voltage difference and the voltage characteristic unique to the pixel driving circuit.

21. The display apparatus according to claim 20, wherein:

the compensated gradation data signal generator comprises a calculation circuit for calculating the original gradation level voltage and the compensation voltage to generate the compensated gradation data signal.

22. The display apparatus according to claim 18, wherein:

the pixel driving circuit includes a driving transistor serially connected to the light-emitting element, and the voltage characteristic unique to the pixel driving circuit is based on a change in a voltage between a control terminal of the driving transistor and one terminal of a current path of the driving transistor.

23. A method for driving a display apparatus, comprising:

applying a predetermined precharge voltage to a pixel driving circuit via a data line;

reading a plurality of times the voltage of the data line with different timings in a predetermined transient response period after the application of the precharge voltage, the transient response period being shorter than a time during which the voltage of the data line converges to a converge voltage value unique to the pixel driving circuit;

generating, based on one of: (i) a voltage difference among the voltages of the data line read at the different timings and (ii) the voltage difference among the voltages of the data line read at the different timings and a voltage retained in the pixel driving circuit, a compensated gradation data signal having a voltage value corresponding to an element characteristic unique to the pixel driving circuit;

applying the generated compensated gradation data signal to the pixel driving circuit; and supplying current depending on a voltage applied via the data line from the pixel driving circuit to a light-emitting element.

24. A display driving apparatus, comprising:

a precharge voltage source for applying, via a data line, a predetermined precharge voltage to a pixel driving circuit connected to a light-emitting element;

a voltage reader for reading a plurality of times the voltage of the data line at different timings in a predetermined transient response period after the application of the precharge voltage by the precharge voltage source; and a compensated gradation data signal generator for applying, based on one of: (i) a voltage difference among the voltages of the data line read at the different timings and (ii) the voltage difference among the voltages of the data line read at the different timings and a voltage retained in the pixel driving circuit, a compensated gradation data signal having a voltage value corresponding to an element characteristic unique to the pixel driving circuit to apply the compensated gradation data signal to the pixel driving circuit.

25. A method for driving a display driving apparatus, comprising:

applying, via a data line, a predetermined precharge voltage to a pixel driving circuit connected to a light-emitting element;

reading a plurality of times the voltage of the data line with different timings in a predetermined transient response period after the application of the precharge voltage;

generating, based on one of: (i) a voltage difference among the voltages of the data line read at the different timings and (ii) the voltage difference among the voltages of the data line read at the different timings and a voltage retained in the pixel driving circuit, a compensated gradation data signal having a voltage value corresponding to an element characteristic unique to the pixel driving circuit; and applying the generated compensated gradation data signal to the pixel driving circuit.

* * * * *